US006792224B2

(12) United States Patent
Ueda et al.

(10) Patent No.: US 6,792,224 B2
(45) Date of Patent: Sep. 14, 2004

(54) IMAGE FORMING APPARATUS AND IMAGE FORMING METHOD

(75) Inventors: Nobuyuki Ueda, Yamatokooriyama (JP); Yuji Okamoto, Souraku-gun (JP); Kaoru Ishikura, Kyoto (JP); Kenji Takahashi, Yamatokooriyama (JP); Takashi Imai, Nara (JP); Shuhji Fujii, Souraku-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/436,851

(22) Filed: May 12, 2003

(65) Prior Publication Data

US 2003/0210921 A1 Nov. 13, 2003

(30) Foreign Application Priority Data

May 13, 2002 (JP) ..... 2002-137302
Jul. 19, 2002 (JP) ..... 2002-211814

(51) Int. Cl.[7] ..... G03G 15/00

(52) U.S. Cl. ..... 399/82; 399/45; 399/364; 399/389; 399/401

(58) Field of Search ..... 271/186, 225, 271/902; 399/45, 82, 361, 364, 389, 401

(56) References Cited

U.S. PATENT DOCUMENTS 6,029,020 A * 2/2000 Blackman et al. ..... 399/45

FOREIGN PATENT DOCUMENTS

| | | |
|---|---|---|
| JP | 11-157725 | 6/1999 |
| JP | 2001-125439 | 5/2001 |

* cited by examiner

*Primary Examiner*—Hoang Ngo
(74) *Attorney, Agent, or Firm*—David G. Conlin; Steven M. Jensen; Edwards & Angell, LLP

(57) ABSTRACT

For performing double-side printing, an image forming apparatus forms an image on one side of a sheet and then reverses the sheet if the sheet has not been reversed, forms an image on the other side of the sheet and then reverses the sheet if the sheet has been reversed once, and performs idle conveyance in which an image is not formed on a sheet and then discharges the sheet if the sheet has been reversed twice. According to the image forming apparatus and a method of forming an image by this apparatus, procedures of image formation by a user can be prevented from becoming troublesome and the sheets can be discharged in order of the originals.

1 Claim, 39 Drawing Sheets

IMAGE FORMING APPARATUS AND IMAGE FORMING METHOD

BACKGROUND OF THE INVENTION

1. Field of the Invention

The present invention relates to an image forming apparatus and an image forming method for forming an image on one side or both sides of a sheet.

2. Description of Related Art

According to the conventional image forming apparatus disclosed in Japanese Patent Application Laid-Open No. 2001-125439, Japanese Patent Application Laid Open No. 11-157725 (1999) and the like, image data is generated by reading one side of an original, for example. The image forming apparatus then forms an image on one side of a sheet using the image data and discharges the sheet to a sheet receiving tray with said side down (face-down method).

FIG. 1 is a flowchart showing procedures of a user for forming an image with a conventional image forming apparatus 3 (see FIG. 3A). A sheet having the same attribute at both sides, on each of which sides image can be formed, is held in a sheet holding tray in the image forming apparatus 3. The image forming apparatus 3 forms an image on one side of the sheet when default image forming conditions (printing conditions) is used.

The user sets an original in an original retainer or an automatic original conveying unit provided in the image forming apparatus 3 (step S1). The user then determines whether an image is to be formed on both sides of the sheet (i.e., double-side printing is to be performed) or not (step S2). If the double-side printing is to be performed (YES at step S2), the user operates a double-side print key at an operation display provided in the image forming apparatus 3 (step S3). If an image is to be formed on one side of the sheet (i.e., single-side printing is to be performed) (NO at step S2), the user does not operate the double-side print key (the default printing conditions are used).

The user then determines whether a sheet having different attributes at respective sides (for example, a sheet having a letterhead on one side, an OHP sheet having one side on which printing is possible and the other side on which printing is not possible or the like, which is referred to as a special sheet hereinafter) is to be used or not (step S4). If the special sheet is to be used (YES at step S4), the user sets the special sheet in the sheet holding tray (step S5). At this time, the user sets the special sheet in the sheet holding tray with the front side up for performing single-side printing, or sets the special sheet in the sheet holding tray with the front side down for performing double-side printing.

If the special sheet is not to be used (NO at step S4), a sheet in a sheet holding tray is used.

Last of all, the user sets the printing conditions such as magnification or color strength of an image to be formed, the number of sheets or the like (step S6) and operates a printing key (step S7).

FIG. 2 is a flowchart showing processing procedures of image formation and sheet conveyance of the image forming apparatus 3.

The image forming apparatus 3 determines whether the printing key has been operated or not (step S11). If the printing key has not been operated (NO at step S11), the image forming apparatus 3 waits until the printing key is operated. If the printing key has been operated (YES at step S11), the image forming apparatus 3 starts to read the original set in the original retainer or the automatic original conveying unit (step S12) and generates image data from the read image.

The image forming apparatus 3 then determines whether the sheet is to be reversed or not by determining whether the double-side print key had been operated or not before the printing key was operated (step S13). More specifically, if the double-side print key had been operated, the image forming apparatus 3 forms the image on one side of the sheet and then reverses the sheet to form an image on the other side. If the double-side print key had not been operated, the image forming apparatus 3 forms the image on one side of the sheet and discharges the sheet without reversing the sheet.

If the double-side print key had not been operated (NO at step S13), the image forming apparatus 3 performs single-side printing process. In the first place, the image forming apparatus 3 supplies a sheet from a sheet holding tray to a printer provided in the image forming apparatus 3 (step S14), forms an image on one side of the sheet using the image data (step S15) and discharges the sheet to the sheet receiving tray (step S16).

Last of all, the image forming apparatus 3 determines whether the next original is to be read or not (for example, whether there is an unread original in the automatic original conveying unit or not) (step S17). If the original is to be read (YES at step S17), the operation returns to step S12. If no original is to be read (NO at step S17), the operation returns to step S11.

If the double-side print key had been operated (YES at step S13), the image forming apparatus 3 performs the double-printing process. In the first place, the image forming apparatus 3 stores the image data in an image memory provided in the image forming apparatus 3 as first image data (step S18), starts to read the next original (step S19) and generates the second image data from the read image.

The image forming apparatus 3 then supplies a sheet from the sheet holding tray to the printer (step S20) and forms the second image on one side of the sheet using the second image data (step S21).

The image forming apparatus 3 then reverses the sheet (step S22), forms the first image on the other side of the sheet using the first image data read from the image memory (step S23) and discharges the sheet to the sheet receiving tray (step S24). The operation then returns to step S17.

FIGS. 3A through 4 are explanatory drawings showing procedures of image formation and sheet conveyance of the image forming apparatus 3 with which the single-side printing is performed.

The image forming apparatus 3 comprises a sheet holding tray 210 for holding one or a plurality of sheets P, and a feeder 211 for supplying one sheet after another held in the sheet holding tray 210 to a printer 20. Each sheet P is held in the sheet holding tray 210 with one side PA (front side in case of the special sheet) of the sheet P up and the other side PB down.

The sheet P which has been supplied to the printer 20 from the sheet holding tray 210 by the feeder 211 is sequentially conveyed to the position between the photoconductor 200 and the imprinter 203 in the direction shown by an outline arrow such that the one side PA is in contact with the photoconductor 200. When the sheet P is disposed between the photoconductor 200 and the imprinter 203, an image is formed on the one side PA (referring to FIG. 3A).

The sheet P passes through a fixer 23 and the image is fixed onto the one side PA of the sheet P. The sheet P is then conveyed in the direction shown by an outline arrow by the guide-in/guide-out roller 28 to the transit conveyance unit 18 (referring to FIG. 3B) and reaches the transit conveyance unit 18 with the one side PA down and the other side PB up (referring to FIG. 3C). The sheet P is then discharged to the sheet receiving tray 56 by the guide-out roller 53 (referring to FIG. 4).

In a case where a plurality of sheets P are discharged by the guide-out roller 53, the sheets P are sequentially stacked in the sheet receiving tray 56 with the one side PA, on which an image is formed, facing down.

FIGS. 5A through 7C are explanatory drawings showing procedures of image formation and sheet conveyance of the image forming apparatus 3 with which the double-side printing is performed. Each sheet P is held in the sheet holding tray 210 with one side PA (front side in case of special sheet) of the sheet P down and the other side PB up.

The sheet P which has been supplied to the printer 20 from the sheet holding tray 210 by the feeder 211 is sequentially conveyed to the position between the photoconductor 200 and the imprinter 203 in the direction shown by an outline arrow such that the other side PB is in contact with the photoconductor 200. When the sheet P is disposed between the photoconductor 200 and the imprinter 203, a second image is formed on the other side PB (referring to FIG. 5).

The sheet P passes through the fixer 23 and the second image is fixed onto the other side PB. The sheet P is then conveyed in the direction shown by an outline arrow, by the guide-in/guide-out roller 28 rotating in the forward direction, to the transit conveyance unit 18 (referring to FIG. 5B) and reaches the transit conveyance unit 18 with the other side PB down and the one side PA up (referring to FIG. 5C). The sheet P is then conveyed in the backward direction (shown by an outline arrow) by the guide-in/guide-out roller 28 rotating in the backward direction (referring to FIG. 6A), to the reversal and conveyance unit 11 (referring to FIG. 6B) and is sequentially conveyed from the reversal and conveyance unit 11 to the position between the photoconductor 200 and the imprinter 203 of the printer 20 such that the one side PA is in contact with the photoconductor 200. When the sheet P is disposed between the photoconductor 200 and the imprinter 203, a first image is formed on the one side PA (referring to FIG. 6C).

The sheet P passes through the fixer 23 and the first image is fixed onto the one side PA of the sheet P. The sheet P is then conveyed in the direction shown by an outline arrow, by the guide-in/guide-out roller 28 rotating in the forward direction, to the transit conveyance unit 18 (referring to FIG. 7A) and reaches the transit conveyance unit 18 with the one side PA down and the other side PB up (referring to FIG. 7B). The sheet P is then discharged to the sheet receiving tray 56 by the guide-out roller 53 (referring to FIG. 7C).

In a case there a plurality of sheets P are discharged by the guide-out roller 53, the sheets P are sequentially stacked in the sheet receiving tray 56 with the one side PA, on which the first image is formed, facing down.

As described above, the image forming apparatus 3 can discharge sheets on which the image is formed in order of the originals.

However, for forming an image on a special sheet using the image forming apparatus 3 employing the face-down method, there arises a problem that the image forming apparatus 3, in which the special sheet is held in the sheet holding tray 210 with the front side thereof up, forms an image on the front side of the sheet if single-side printing is performed but forms the image to be formed on the front side of the special sheet on the back side thereof if double-side printing is performed.

Thus, for forming the image on one side of the special sheet, it is necessary for the user to set the special sheet in the sheet holding tray 210 with the front side up while, for forming the image on both sides thereof, it is necessary to set the special sheet in the sheet holding tray 210 with the back side thereof up. Consequently, the procedures of the image formation become troublesome.

In addition, it is necessary to store the first image data for forming the first image (image on the front side) in the image memory until formation of the second image using the second image data (image on the back side) is finished. As a result, it is necessary to provide an image memory having large capacity capable of storing both of the first and second image data.

Furthermore, according to an image forming apparatus which does not store the first image data in the image memory in a case where the double-side printing is performed, the first image is formed on the sheet conveyed to image forming means when the front side of the original is read, the sheet is reversed and the second image is formed when the back side of the original is read. Therefore, the sheet is discharged in the sheet receiving tray with the back side down, so that the sheet can not be discharged in order of the originals. If the aforementioned image forming apparatus is used, it is necessary to read the originals from back side thereof in order to discharge the sheets in order of the originals. As a result, the procedures in forming the image become complicated.

BRIEF SUMMARY OF THE INVENTION

The present invention has been made to solve the above problems and it is an object thereof to provide an image forming apparatus which can discharge the sheets in order of the originals without troublesome procedures of a user for forming an image.

It is another object of the present invention to provide an image forming apparatus which can discharge sheets in order of the originals without troublesome procedures of a user for forming an image in a case where an image is formed on a special sheet having different attributes at respective sides, and can improve efficiency in forming an image in a case where an image is formed on a sheet other than the special sheet.

It is a further object of the present invention to provide an image forming apparatus which can discharge sheets in order of the originals without troublesome procedures of a user for forming an image in a case where an image is formed on both sides of a sheet and can improve efficiency in forming an image in a case where an image is formed on one side of the sheet.

It is still another object of the present invention to provide an image forming apparatus which can discharge sheets in order of the originals without troublesome procedures of a user for forming an image in a case where an image is formed on one side of the sheet and can prevent deterioration of a sheet and occurrence of conveyance miss while the sheet is conveyed in a case where an image is formed on both side of the sheet.

It is still a further object of the present invention to provide an image forming apparatus which can improve efficiency of image formation and prevent deterioration of a sheet and occurrence of conveyance miss while the sheet is conveyed.

It is still a further object of the present invention to provide an image forming method which can reduce storage capacity of storage means (an image memory) which stores data of the image until the image is formed on the sheet.

It is still another object of the present invention to provide an image forming method which can prevent a jam of the image-formed sheet from occurring while an image is formed on both sides of a sheet.

It is still another object of the present invention to provide an image forming method which can prevent a jam of an image-formed sheet from occurring while an image is formed on one side of a sheet.

It is still a further object of the present invention to provide an image forming method which can discharge sheets in order of the originals in a case where a sheet, for which it is to be determined whether an image is to be formed or not on the sheet conveyed to image forming means, and a sheet, for which it is not to be determined whether an image is to be formed or not on the sheet conveyed to the image forming means, are sequentially processed.

An image forming apparatus according to the present invention comprises image forming means for forming an image on a sheet; conveying means for conveying the sheet to the image forming means; reversal means for reversing the sheet; and control means for determining whether the sheet is to be reversed or not and controlling the conveying means and the reversal means to reverse the sheet and convey it to the image forming means when it has been determined that the sheet is to be reversed. The control means includes means for determining whether an image is to be formed on the sheet conveyed to the image forming means or not; means for controlling the conveying means and the image forming means to convey the sheet to the image forming means and to form the image on the sheet when it has been determined that the image is to be formed; and means for controlling the conveying means to convey the sheet to the image forming means when it has been determined that the image is not to be formed.

The image forming apparatus discharges the sheet to a sheet receiving part (sheet receiving tray, for example) by a face-down method.

The controlling means determines whether an image is formed or not on the sheet conveyed to the image forming means. If it has been determined that the image is to be formed, the control means controls the conveying means and the image forming means to convey the sheet to the image forming means, form the image on the sheet and let the sheet pass through the image forming means. Alternatively, if it has been determined that the image is not to be formed, the control means controls the conveying means to convey the sheet to the image forming means and let the sheet pass through the image forming means. At this time, the control means prohibits the image forming means from forming an image (referred to as idle conveyance hereinafter).

For example, when a sheet is held in supply means for supplying the sheet (a sheet holding tray, for example) with one side thereof up, the sheet supplied from the sheet holding tray is conveyed to the image forming means with the one side facing toward the image forming means.

At the time of single-side printing, when the original was read, the control means controls the image forming means to form an image on the sheet conveyed to the image forming means and discharges the sheet to the sheet receiving tray. In this case, the sheet is discharged to the sheet receiving tray with the image-formed side down.

At the time of double-side printing, when the original was read, the control means determines whether an image is to be formed or not on a sheet (one side) conveyed to the image forming means. At this time, the control means determines to form the image and forms the image corresponding to the image of the front surface of the original on the sheet. The control means controls the reversal means to reverse the sheet and conveys the sheet to the image forming means. Then, when the back side of the original was read, the control means determines whether an image is to be formed or not on the sheet (the other side) conveyed to the image forming means. At this time, the control means determines to form the image and forms the image corresponding to the image of the back surface of the original on the sheet. The control means controls the reversal means to reverse the sheet and conveys the sheet to the image forming means. The control means then determines whether an image is to be formed or not on a sheet (one side on which the image has been already formed) conveyed to the image forming means. At this time, the control means determines not to form the image and performs the idle conveyance to discharge the sheet to the sheet receiving tray. In this case, the sheet is discharged to the sheet receiving tray with the one side, on which the image corresponding to the image on the front side of the original was formed, facing down.

The above-described image forming apparatus can discharge sheets (special sheets) in order of the originals read. In addition, the image forming apparatus can form the image in such a manner that the front surface of the original corresponds to the one side of the sheet (the front side of the special sheet). Therefore, even when the special sheet is set in the sheet holding tray, it is not necessary for the user to determine whether the front side of the special sheet is to face up or down. Thus, even when the special sheet is set in the sheet holding tray upside down, it is not necessary to reverse the sheet manually. In other words, user convenience can be improved.

The image forming apparatus according to the present invention may further comprise obtaining means for obtaining information on whether the sheet has a predetermined attribute or not. In this case, according to the presence or absence of the attribute, the control means determines whether an image is to be formed or not on the sheet conveyed to the image forming means.

The image forming apparatus comprises, as the obtaining means, a sheet attribute key corresponding to the predetermined attribute and a printing key which instructs the apparatus to start sheet conveyance and image formation processing, in an operation part thereof, for example. If the user operated the printing key after operating the sheet attribute key, the control means determines that information that the sheet has the attribute corresponding to the sheet attribute key was obtained. If the user operated the printing key without operating the sheet attribute key, the control means determines that the information that the sheet does not have the attribute corresponding to the sheet attribute key was obtained.

Furthermore, if there are a first attribute (attribute such as a special sheet, for example) of a sheet on which an image is not formed often and a second attribute (attribute such as a standard sheet other than the special sheet) of a sheet, other than the first attribute, on which an image is formed often, the control means may be structured to determine that the information that the sheet has the second attribute was obtained when the user operated the printing key without operating the sheet attribute key corresponding to the first attribute. At this time, since the user can omit the procedure of operating the sheet attribute key in a case where the image is formed on the sheet of the attribute for which the image is formed often, the user convenience can be improved.

As described above, if the control means has determined that the sheet has the predetermined attribute (or does not have the predetermined attribute), the control means determines whether an image is to be formed on the sheet conveyed to the image forming means or not. When the image is formed, the control means conveys the sheet to the image forming means and forms an image on the sheet while, when the image is not formed, the control means conveys the sheet to the image forming means but does not form an image. Therefore, sheets can be discharged in order of the originals without complicating the procedures of a user for forming the image.

According to the image forming apparatus of the present invention, the obtaining means may obtain information on whether the sheet has different attributes at respective sides or not. In this case, if the information that the sheet has different attributes at respective sides has been obtained, the control means determines whether an image is to be formed or not on the sheet conveyed to the image forming means.

According to this image forming apparatus, when a special sheet is held in the sheet holding tray with front side thereof up, for example, and the special sheet supplied from the sheet holding tray is conveyed to the image forming means with the front side facing toward the image forming means, the image forming apparatus forms an image on the special sheet (front side) conveyed to the image forming means and discharges the sheet to the sheet receiving tray when the original was read at the time of the single-side printing. In this case, the special sheet is discharged to the sheet receiving tray with the image-formed side down.

At the time of the double-side printing, when the original was read, the control means determines whether the image is to be formed or not on a special sheet (front side) conveyed to the image forming means. At this time, the control means determines to form the image and forms the image corresponding to the image of the front surface of the original on the special sheet. The control means reverses the special sheet and conveys the sheet to the image forming means. Then, when the back side of the original was read, the control means determines whether an image is to be formed or not on the special sheet (the back side) conveyed to the image forming means. At this time, the control means determines to form the image and forms the image corresponding to the image of the back surface of the original on the special sheet. The control means reverses the special sheet and conveys the sheet to the image forming means. The control means then determines whether an image is to be formed or not on a special sheet (front side on which the image has been already formed) conveyed to the image forming means. At this time, the control means determines not to form the image and performs the idle conveyance to discharge the special sheet to the sheet receiving tray. In this case, the special sheets are discharged to the sheet receiving tray with the front side, on which the image corresponding to the image on the front surface of the original is formed, facing down.

The above-described image forming apparatus can discharge the special sheets in order of the original read. In addition, the image forming apparatus can form the image in such a manner that the front surface of the original corresponds to the front side of the sheet.

Furthermore, since the above image forming apparatus does not determine whether the image is to be formed on the sheet or not nor perform the idle conveyance when an image is formed on the sheet other than the special sheet, conveying time of the sheet is decreased and the efficiency of the image formation can be improved.

The image forming apparatus according to the present invention may further comprises means for obtaining information on whether an image is to be formed on one side or both sides of the sheet. In this case, if the information that the image is to be formed on both sides of the sheet was obtained, the control means determines whether the image is to be formed or not on the sheet conveyed to the image forming means.

Since this image forming apparatus does not determine whether the image is to be formed or not on the sheet nor perform the idle conveyance when the single-side printing is performed, conveying time of the sheet is decreased and the efficiency of the image formation can be improved.

The image forming apparatus according to the present invention may further comprise means for obtaining information on whether an image is to be formed on one side or both sides of the sheet. In this case, if the information that the image is to be formed on single side of the sheet was obtained, the control means determines whether the image is to be formed or not on the sheet conveyed to the image forming means.

According to the present invention, for example, if the special sheet is held in the sheet holding tray with back side thereof up, the special sheet supplied from the sheet holding tray is conveyed to the image forming means with the back side of the sheet facing toward the image forming means.

For performing double-side printing, similar to the well-known image forming apparatus, when the front surface of the original was read, the control means stores the data of the read image (data corresponding to the image on the front surface of the original) in the image memory. Then, when the back surface of the original was read, the control means forms an image corresponding to the image on the back surface of the original on the special sheet (back side), reverses the special sheet and conveys it to the image forming means. Then, the control means forms an image corresponding to the image on the front surface of original on the special sheet (front side) using the stored data and discharges the special sheet to the sheet receiving tray. In this case, the special sheet is discharged to the receiving tray with the side, on which the image corresponding to the image on the front surface of the original is formed, facing down.

For performing single-side printing, when the front surface of the original was read, the control means stores data of the read image (data corresponding to the image on the front surface of the original) in the image memory and determines whether an image is to be formed or not on the special sheet (back side) conveyed to the image forming means. At this time, the control means determines not to form the image, performs idle conveyance, controls the reversal means to reverse the special sheet and conveys the special sheet to the image forming means. The control means then determines whether an image is to be formed or not on the special sheet (front side) conveyed to the image forming means. At this time, the control means determines to form the image, forms the image on the special sheet using the stored data and discharges the sheet to the sheet receiving tray. In this case, the special sheet is discharged to the sheet receiving tray with the image-formed side down.

Since the above-described image forming apparatus does not determine whether an image is to be formed or not on the sheet nor perform the idle conveyance when the double-side printing is performed, sheet conveyance time is reduced and efficiency at the time of image formation can be improved as compared with a case where conveyance and idle conveyance are performed to form an image on both sides of the sheet. In addition, since the conveyance distance of the sheet is reduced, a conveyance miss (jam, for example), deterioration of the sheet caused by the conveyance or the like can be prevented.

Although the image forming apparatus performs the conveyance and idle conveyance in order to form the image on the single side of the sheet for performing single-side printing, since the conveyance time and the conveyance distance are approximately the same as those of double-side printing, adverse effects on the sheet (a jam, deterioration of the sheet or the like) counts for nothing.

The image forming apparatus of the present invention may further comprise means for prohibiting determining whether an image is to be formed or not on the sheet conveyed to the image forming means when the obtained information is other than the information which requires determining whether the image is to be formed or not on the sheet conveyed to the image forming means.

For example, when the single-side printing is performed on the special sheet, since the special sheet has different attributes at respective sides, the image forming apparatus performs the conveyance and idle conveyance for forming the image on the single side of the sheet to form the image on the front side of the special sheet. Meanwhile, when the single-side printing is performed on the sheet other than the special sheet, since the sheet has the same attribute at both sides, only the conveyance for forming the image on the single side of the sheet is performed and it is not necessary to perform the idle conveyance.

In this case, the information that the sheet is the special sheet is the information (information corresponding to the sheet to be conveyed if it was determined that the image is to be formed and to be idly conveyed if it was determined that the image is not to be formed) to determine whether an image is to be formed or not on the sheet conveyed to the image forming means. In addition, the information that the sheet is other than the special sheet is other than the information which requires determining whether the image is to be formed or not on the sheet conveyed to the image forming means.

At this time, obtaining the information that the sheet is other than the special sheet, the image forming apparatus does not perform the idle conveyance by not determining whether the image is to be formed or not on the sheet conveyed to the image forming means. As a result, only the conveyance for forming the image on the single side of the sheet is performed.

Since the above image forming apparatus performs the image forming processing without performing the idle conveyance for the sheet which does not need the idle conveyance, the efficiency of the image formation is improved. Furthermore, deterioration of the sheet caused by the idle conveyance of the sheet, occurrence of a jam and the like can be prevented.

An image forming method according to the present invention is for forming an image on both sides of a sheet using the image forming apparatus of the present invention. The image forming method comprises a step of conveying a sheet to image forming means by conveying means with one side of the sheet facing toward the image forming means; a step of forming the image on the one side by the image forming means; a step of reversing the sheet by reversal means; a step of conveying the reversed sheet to the image forming means by the conveying means; a step of forming an image on the other side of the sheet by the image forming means; and a step of reversing the sheet by the reversal means.

According to the present invention, first of all, an original is read. In this case, it is determined that a front face of the original has been read. Then, a sheet is supplied by supply means and conveyed to image forming means by conveying means. Then, it is determined whether an image is to be formed or not on a sheet (one side) conveyed to the image forming means. At this time, it is determined to form the image and the image corresponding to the image on the front surface of the original is formed on the sheet.

Then, the original is read. In this case, it is determined that a back surface of the original has been read. Then, the sheet is reversed by reversal means and conveyed to the image forming means. Then, it is determined whether an image is to be formed or not on the sheet (the other side) conveyed to the image forming means. At this time, it is determined to form the image and the image corresponding to the image on the back surface of the original is formed on the sheet.

Last of all, the sheet is reversed by the reversal means and conveyed to the image forming means. Then, it is determined whether an image is to be formed or not on a sheet (the image-formed side) conveyed to the image forming means. At this time, it is determined not to form the image and the idle conveyance is performed to discharge the sheet to the sheet receiving tray.

In other words, double-side printing is performed and the idle conveyance is then performed.

As described above, sheets can be discharged to the sheet receiving tray in order of the originals with the side, on which the image corresponding to the image on the front surface of the original is formed, facing down.

In addition, since the sheet is idly conveyed after the image is formed on both sides of the sheet, image data for one surface of the original is stored in the image memory and the image is then formed. If image data for the other surface is stored, the image data is overwritten on the image data for the one surface and the image is then formed. Thus, it is not necessary to store the image data for both surfaces of the original in the image memory, whereby storage capacity of the image memory can be reduced.

An image forming method according to the present invention is for forming an image on both sides of a sheet using the image forming apparatus of the present invention. The image forming method comprises a step of conveying a sheet to image forming means by conveying means with one side of the sheet facing toward the image forming means; a step of reversing the sheet by reversal means; a step of conveying the reversed sheet to the image forming means by the conveying means; a step of forming an image on the other side of the sheet by the image forming means; a step of reversing the sheet by the reversal means; a step of conveying the reversed sheet to the image forming means by the conveying means; and a step of forming an image on the one side of the sheet by the image forming means.

According to the present invention, first of all, an original is read to generate first image data. In this case, it is determined that a front surface of the original has been read. Then, a sheet is supplied to supply means and conveyed to image forming means by conveying means. Then, it is determined whether an image is to be formed or not on a sheet (one side) conveyed to the image forming means. At this time, it is determined not to form the image and the idle conveyance is performed. In addition, the first image data is stored in an image memory.

Then, the original is read to generate second image data. In this case, it is determined that a back surface of the original has been read. Then, the sheet is reversed by reversal means and conveyed to the image forming means. Then, it is determined whether an image is to be formed or not on the sheet (the other side) conveyed to the image forming means. At this time, it is determined to form the image and the image to be generated using the second image data, i.e., the image corresponding to the image on the back surface of the original is formed on the sheet.

Last of all, the sheet is reversed by the reversal means and conveyed to the image forming means. Then, it is determined whether an image is to be formed or not on a sheet (one side) conveyed to the image forming means. At this time, it is determined to form the image and the image to be generated using the first image data stored in the image memory, i.e., the image corresponding to the image on the front surface of the original is formed on the sheet and the sheet is then discharged to the sheet receiving tray.

In other words, the idle conveyance is performed and double-side printing is then performed.

As described above, sheets can be discharged to the sheet receiving tray in order of the originals with the side, on which the image corresponding to the image on the front surface of the original is formed, facing down.

In addition, since the sheet on which image is not performed is idly conveyed and then, the image is formed on both sides of the sheet, even when a jam occurs during the idle conveyance, the image-formed sheet is not contaminated nor damaged. As a result, the image forming steps are not wasted.

An image forming method according to the present invention is for performing an image on one side of a sheet using the image forming apparatus of the present invention. The image forming method comprises a step of conveying a sheet to image forming means by conveying means with one side of the sheet facing toward the image forming means; a step of reversing the sheet by reversal means; a step of conveying the reversed sheet to the image forming means by the conveying means; and a step of forming an image on the other side of the sheet by the image forming means.

According to the present invention, first of all, an original is read to generate image data. Then, a sheet is supplied to supply means and conveyed to image forming means by conveying means. Then, it is determined whether an image is to be formed or not on a sheet (one side) conveyed to the image forming means. At this time, it is determined not to form the image and the idle conveyance is performed. In addition, the generated image data is stored in an image memory. Then, the sheet is reversed by the reversal means and conveyed to the image forming means. Then, it is determined whether an image is to be formed or not on a sheet conveyed to the image forming means. At this time, it is determined to form the image and the image generated using the stored image data is formed on the sheet (the other side) and the sheet is then discharged to the sheet receiving tray.

In other words, the idle conveyance is performed and single-side printing is then performed.

As described above, sheets can be discharged to the sheet receiving tray in order of the originals with the other side, on which the image is formed, facing down.

In addition, since the sheet on which no image is formed is idly conveyed and then, the image is formed on both sides of the sheet, even when a jam occurs during the idle conveyance, the image-formed sheet is not contaminated nor damaged. As a result, the image forming steps are not wasted.

An image forming method according to the present invention is for forming an image using the image forming apparatus of the present invention. According to the image forming method, if a plurality of sheets are sequentially processed, a plurality of pieces of information is sequentially obtained corresponding to the sheets and one of two pieces of information sequentially obtained is information for which it is to be determined whether an image is to be formed or not on a sheet conveyed to the image forming means and the other piece is information other than that information, the processing of the sheet corresponding to the other piece of information is started when the processing of the sheet corresponding to the one piece of information is completed.

According to the present invention, for performing the single-side printing on the special sheet, for example, since the special sheet has different attributes at respective sides, the special sheet is conveyed idly, reversed and then conveyed for forming the image on one side of the sheet in order to form the image on the front side of the special sheet. Meanwhile, for performing the single-side printing on the sheet other than the special sheet, since the sheet has the same attribute at both sides, only conveyance for forming the image on one side of the sheet is performed.

For sequentially performing the single-side printing for the special sheet after the single-side printing for the special sheet, even if the first special sheet in the subsequent single-side printing is fed when the last special sheet was reversed in the former single-side printing, the first special sheet in the subsequent single-side printing is also reversed and conveyed idly. As a result, the first special sheet is discharged to the sheet receiving tray after the last special sheet was discharged to the sheet receiving tray. In other words, each sheet is discharged to the sheet receiving tray in order of the originals.

However, for sequentially performing the single-side printing for the sheet other than the special sheet after the single-side printing for the special sheet, if the first sheet in the subsequent single-side printing is fed when the last special sheet in the former single-side printing is reversed and is not conveyed idly and not reversed, the fist sheet is sometimes discharged to the sheet receiving tray before the last special sheet is discharged to the sheet receiving tray. In addition, when the sheet is conveyed idly and reversed, although the first sheet is discharged after the last special sheet is discharged to the sheet receiving tray, since the idle conveyance is performed for the sheet which is not necessarily conveyed idly, a jam or deterioration of the sheet could occur and efficiency of image formation is decreased.

For performing the single-side printing for the sheet other than the special sheet when the single-side printing for the special sheet is completed (when the last special sheet is discharged to the sheet receiving tray or when the reversal and idle conveyance of the special sheet is completed, for example), the first sheet is prevented from being discharged to the sheet receiving tray before the last special sheet is discharged to the sheet receiving tray. In other words, each sheet can be discharged to the sheet receiving tray in order of the originals.

Thus, for sequentially processing a plurality of the sheets, if a plurality of pieces of information (information that the single-side printing is performed on the special sheet or information that the single-side printing is performed on the sheet other than the special sheet) is sequentially obtained corresponding to the sheets, one of two pieces of information sequentially obtained is information (in this case, the information that the single-side printing is performed on the special sheet) for which it is to be determined whether an image is to be formed or not on a sheet conveyed to the image forming means and the other piece of information is other than that information (the information that the single-side printing is performed for the sheet other than the special sheet), the processing (the single-side printing for the sheet other than the special sheet) of the sheet corresponding to the other piece of information is started when the processing (the single-side printing for the special sheet) of the sheet corresponding to the one piece of information is completed,. As a result, while the plurality of the sheets is sequentially processed, occurrence of a jam, deterioration of the sheet or decrease of efficiency of image formation is prevented and the sheets can be discharged in order of the originals.

The above and further objects and features of the present invention will more fully be apparent from the following detailed description with accompanying drawings.

DETAILED DESCRIPTION OF THE INVENTION

Hereinafter, preferred embodiments of the present invention will be described with reference to the accompanying drawings.

First Embodiment

Figure 1:
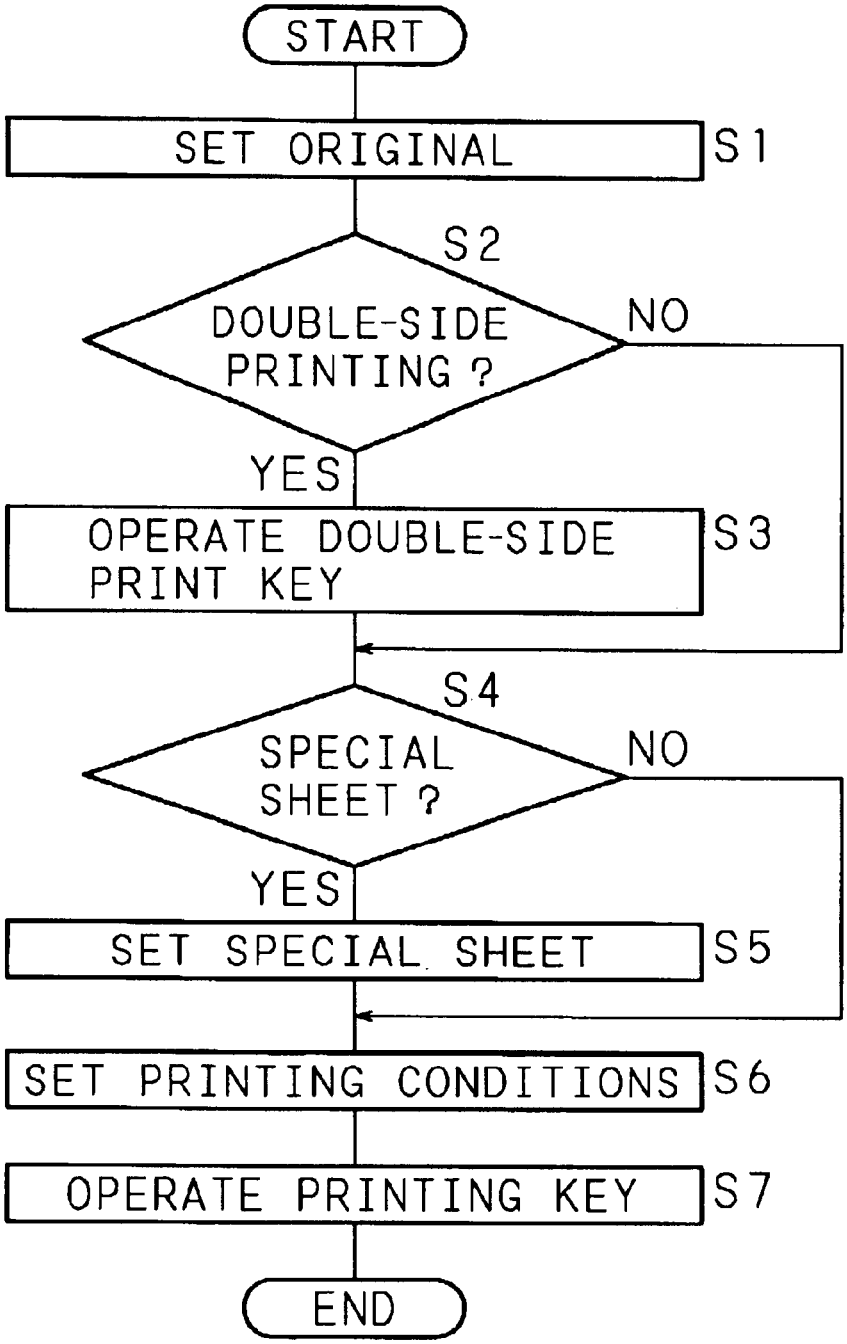
FIG. 1 PRIOR ART
FIG. 1 is a flowchart showing procedures of a user for forming an image with a conventional image forming apparatus.
Figure 2:
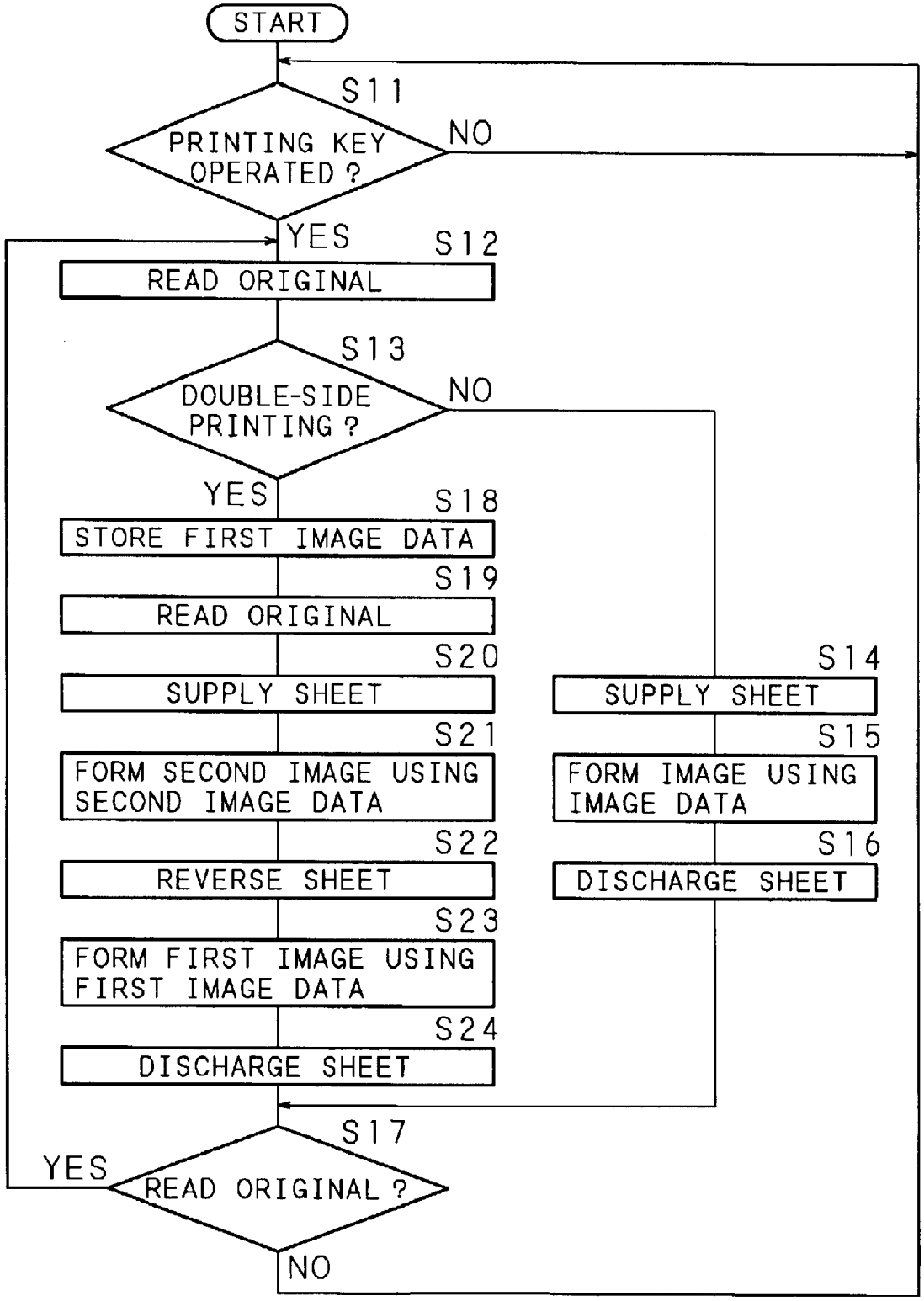
FIG. 2 PRIOR ART
FIG. 2 is a flowchart showing processing procedures of image formation and sheet conveyance by the conventional image forming apparatus.
Figure 3A:
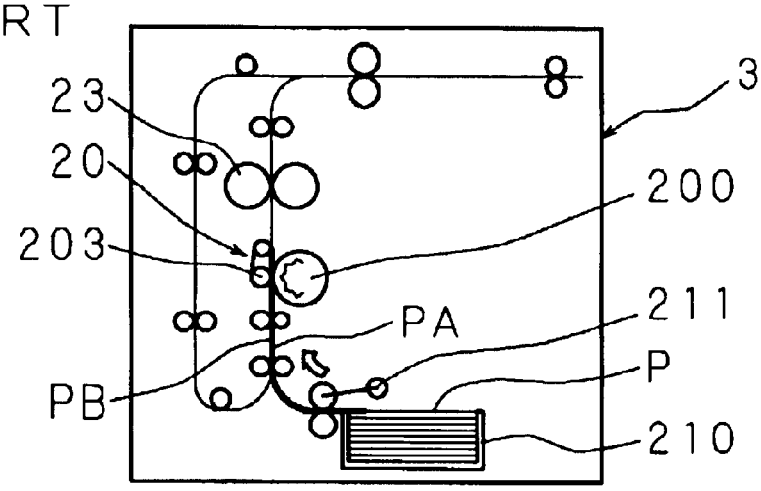
FIG. 3A PRIOR ART
FIGS. 3A through 4 are explanatory views showing procedures of image formation and sheet conveyance by the conventional image forming apparatus.
Figure 3B:
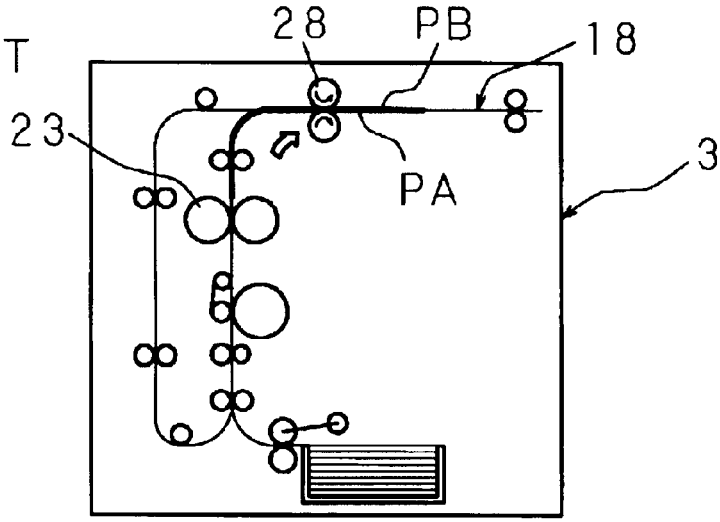
FIG. 3B PRIOR ART
Figure 3C:
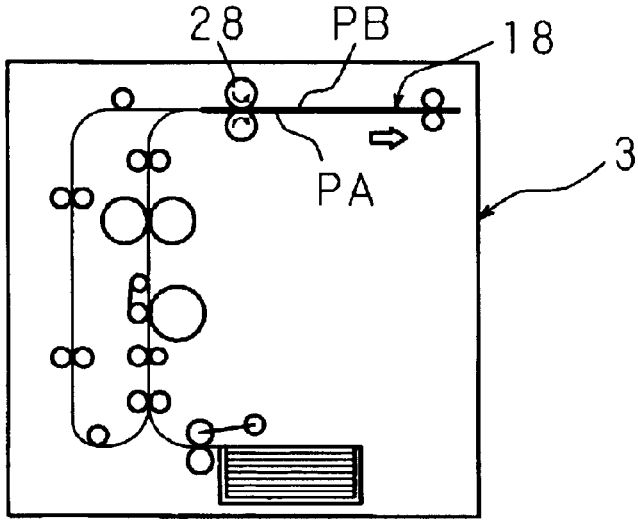
FIG. 3C PRIOR ART
Figure 4:
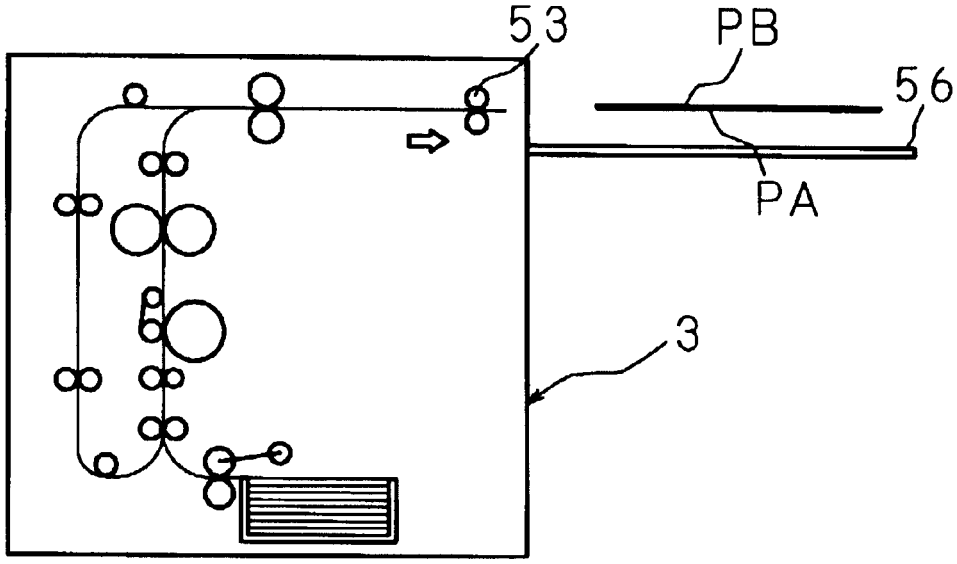
FIG. 4 PRIOR ART
Figure 5A:
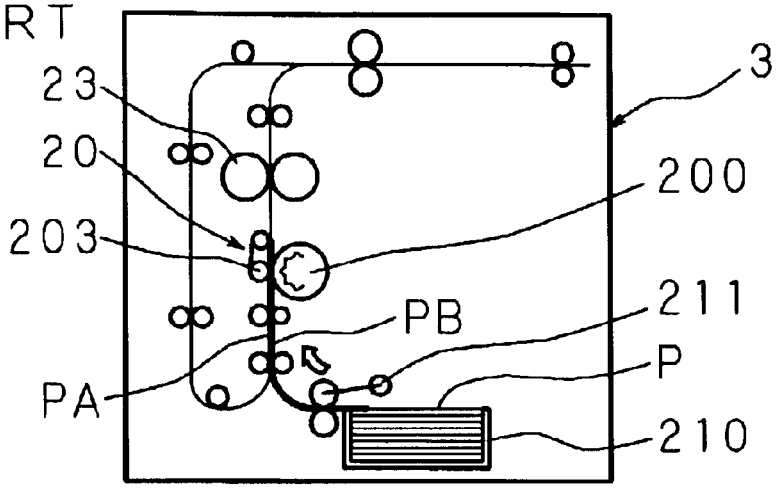
FIG. 5A PRIOR ART
FIGS. 5A through 7C are explanatory views showing procedures of image formation and sheet conveyance by the conventional image forming apparatus.
Figure 5B:
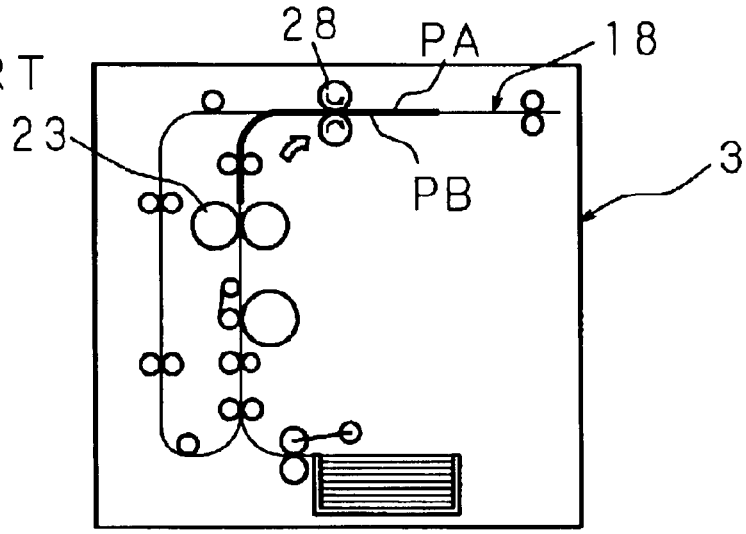
FIG. 5B PRIOR ART
Figure 5C:
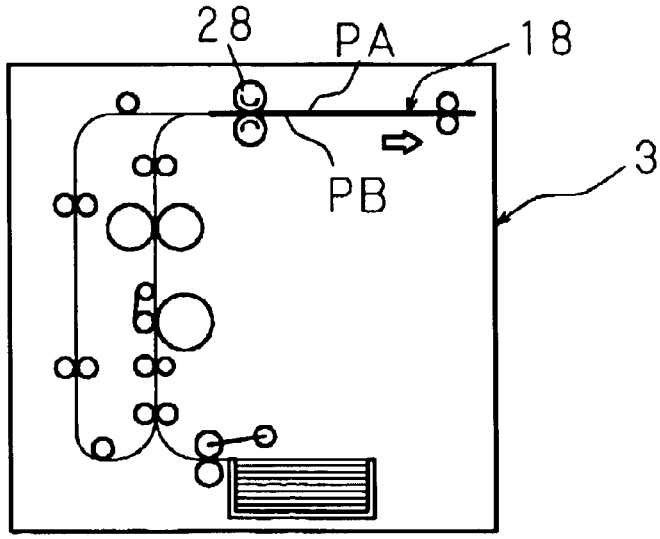
FIG. 5C PRIOR ART
Figure 6A:
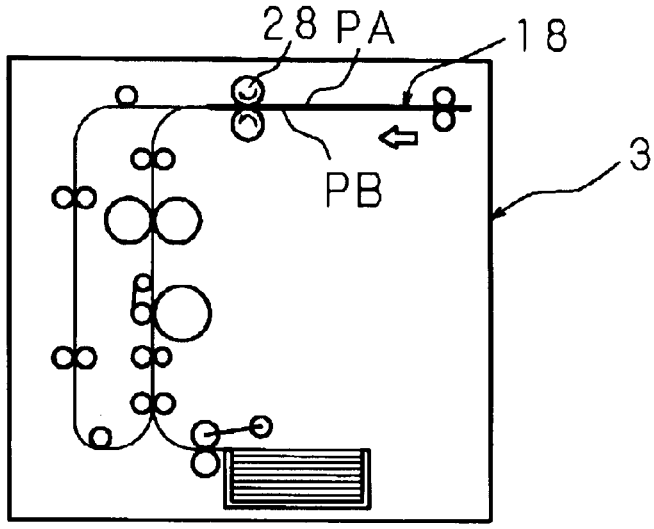
FIG. 6A PRIOR ART
Figure 6B:
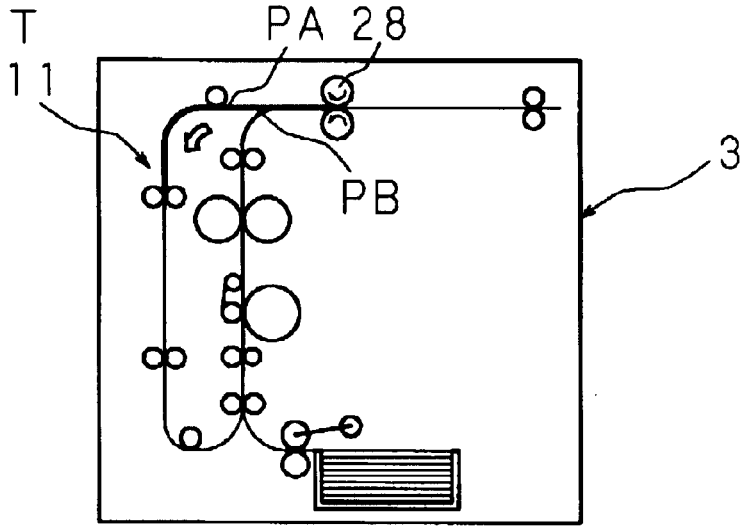
FIG. 6B PRIOR ART
Figure 6C:
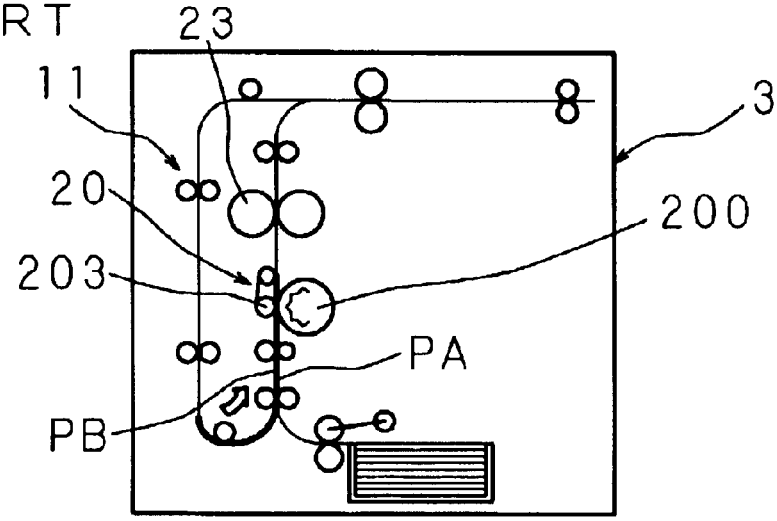
FIG. 6C PRIOR ART
Figure 7A:
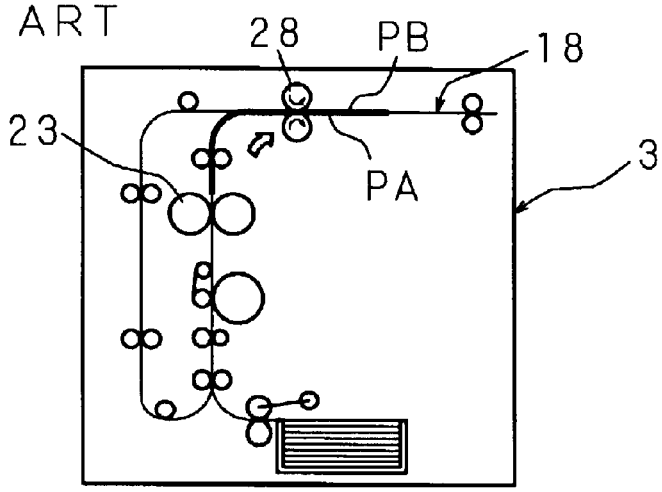
FIG. 7A PRIOR ART
Figure 7B:
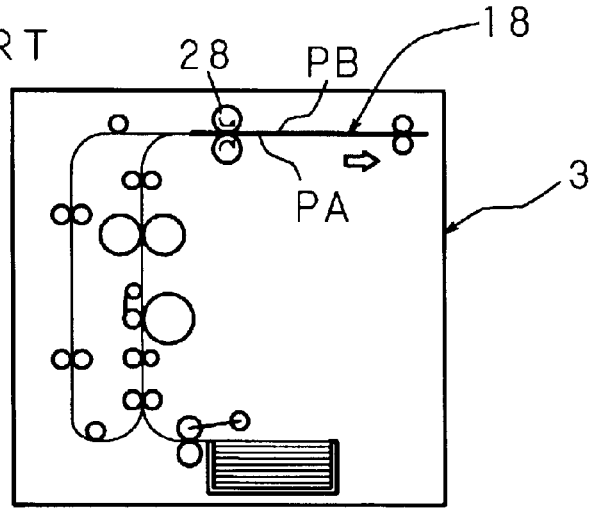
FIG. 7B PRIOR ART
Figure 7C:
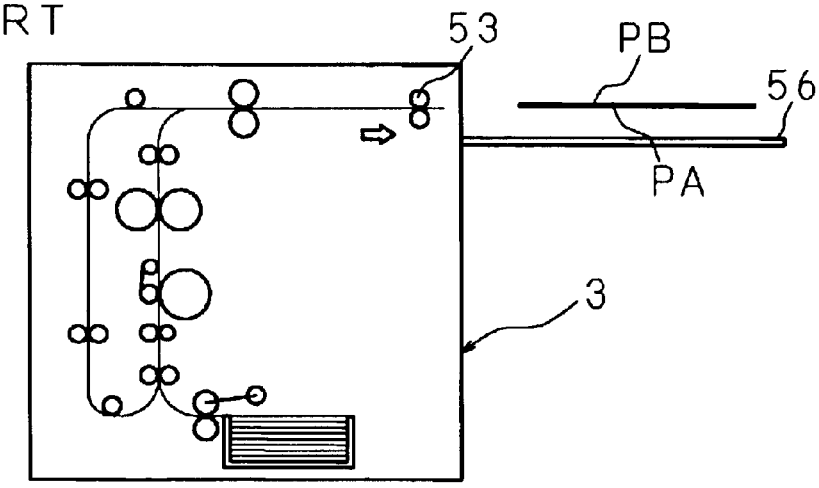
FIG. 7C PRIOR ART
Figure 8:
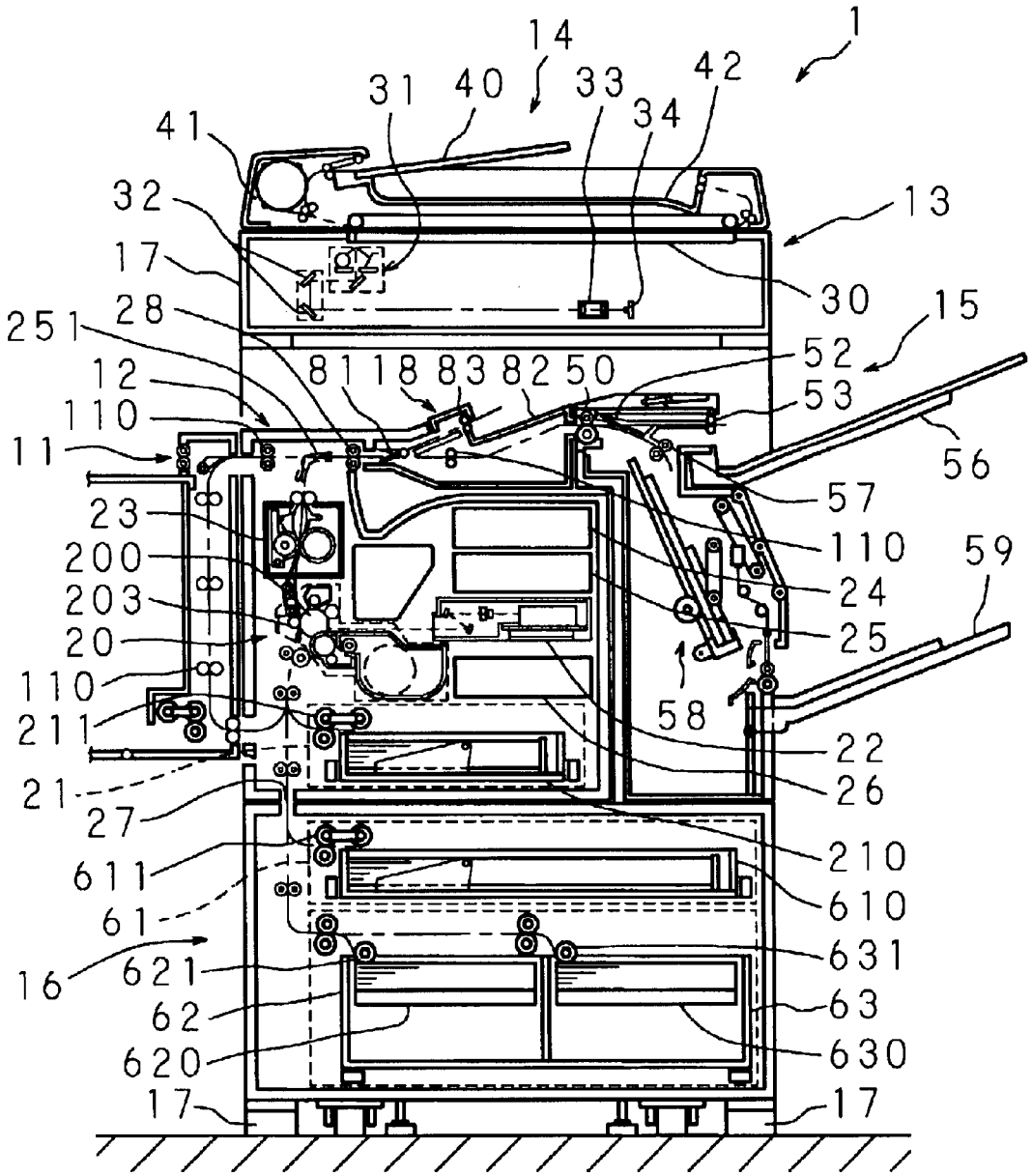
FIG. 8 is a front view showing a structure of an image forming apparatus according to the first embodiment of the present invention.
Figure 9:
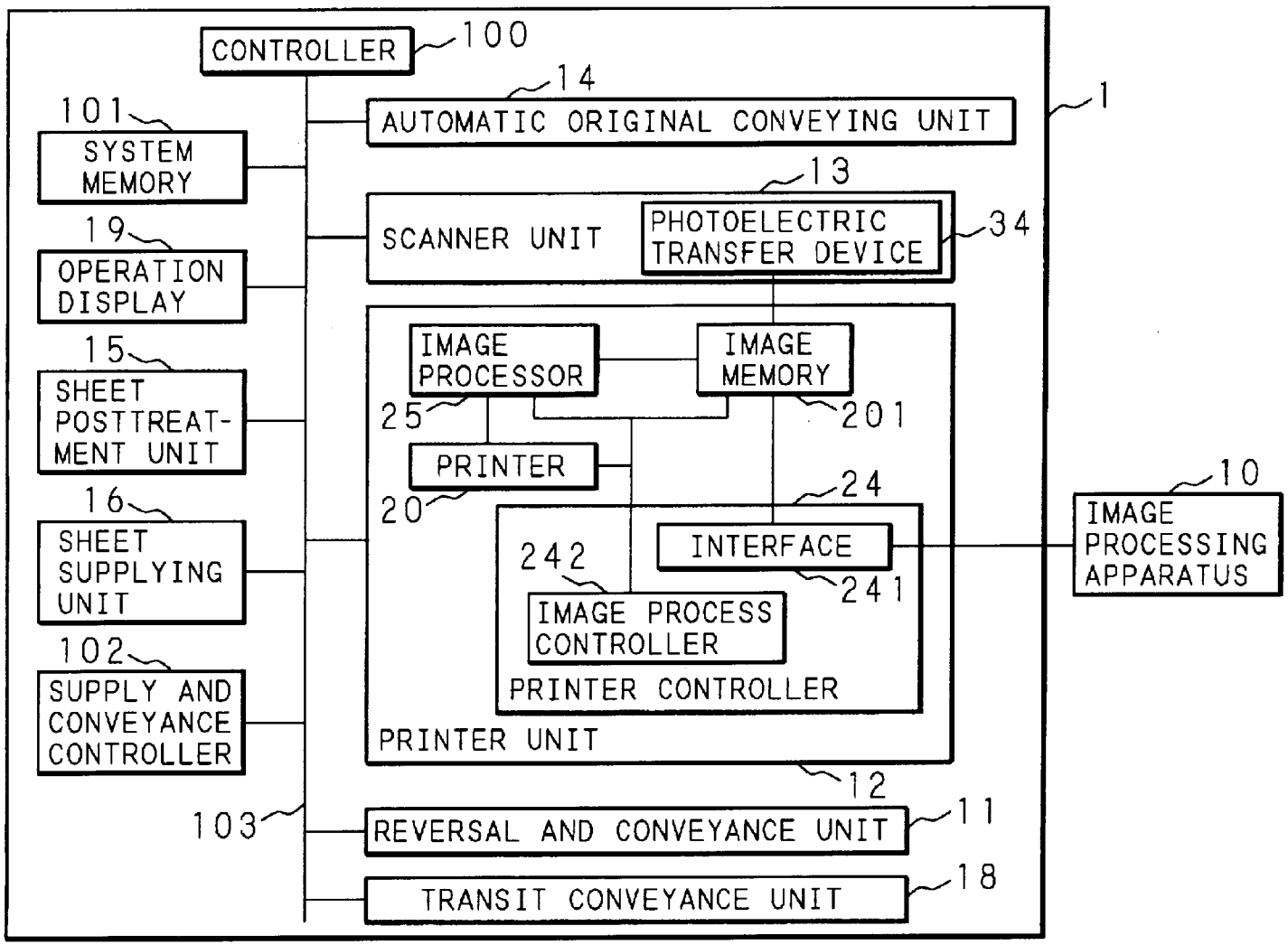
FIG. 9 is a block diagram showing the image forming apparatus according to the first embodiment of the present invention.
Figure 10:
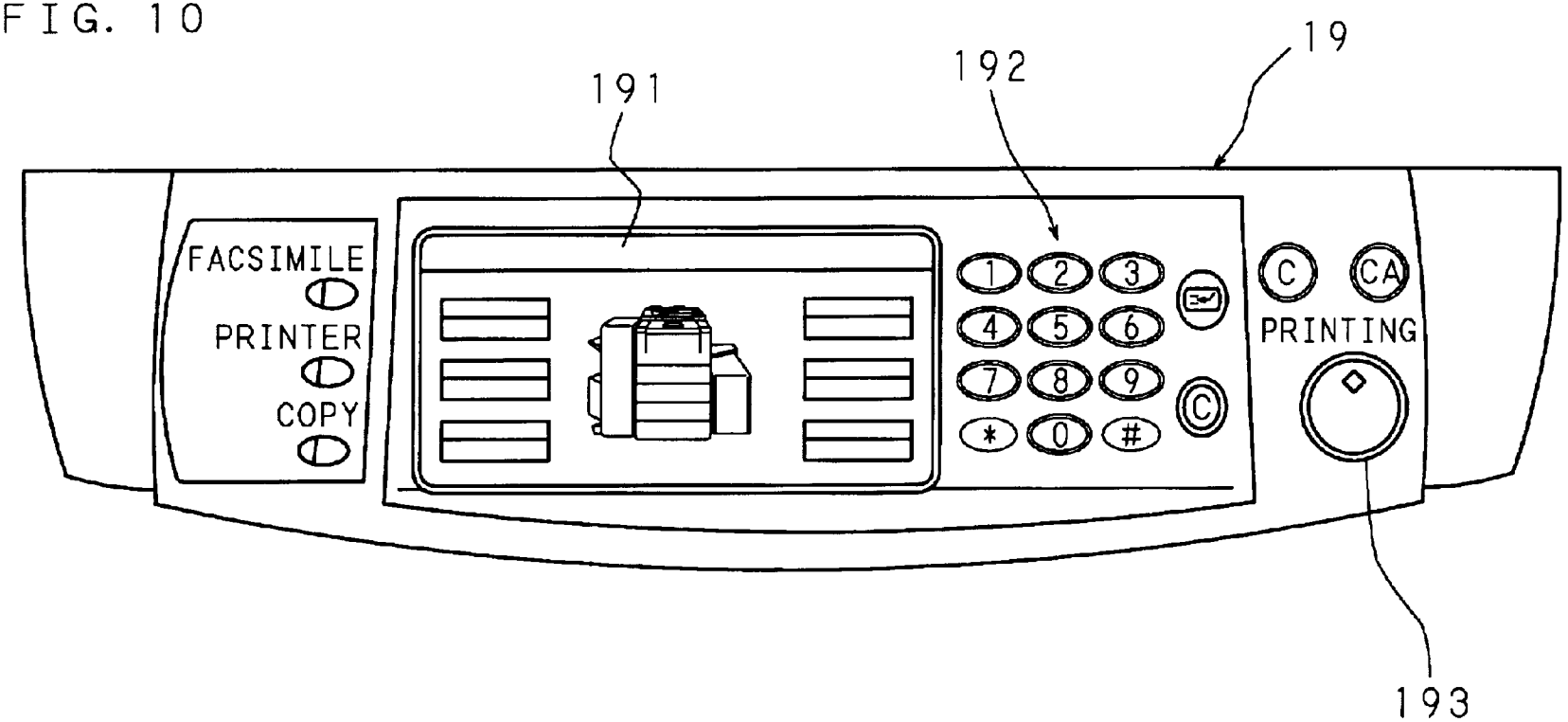
FIG. 10 is a view showing an operation display constituting the image forming apparatus according to the first embodiment of the present invention.

FIG. 8 is a front view showing a structure of an image forming apparatus 1 according to the first embodiment of the present invention. FIG. 9 is a block diagram of the image forming apparatus 1. FIG. 10 is a view showing an operation display 19 constituting the image forming apparatus 1.

The image forming apparatus 1 comprises a printer unit 12, a transit conveyance unit 18 provided on the upper side of the printer unit 12, a scanner unit 13 and an automatic original conveying unit 14, a sheet supplying unit 16 provided on the lower side of the printer unit 12, a reversal and conveyance unit 11 provided on one side of the printer unit 12, and a sheet posttreatment unit 15 disposed on the other side thereof.

The operation display 19 is provided on an upper surface of the scanner unit 13. The scanner unit 13 and the automatic original conveying unit 14 disposed on the upper side of the scanner unit 13 are supported by a system rack 17 and disposed on the upper side of the printer unit 12 and the sheet posttreatment unit 15.

The image forming apparatus 1 is connected to an image processing apparatus 10 (for example, a personal computer in which an image processing software is installed) through an interface 241 provided in the printer unit 12. The image processing apparatus 10 inputs data, such as image data and printing condition data for forming an image, into the image forming apparatus 1.

The image forming apparatus 1 further comprises a controller 100 which is a main control part of the image forming apparatus 1. The controller 100 is connected to each part, such as a system memory 101 and the operation display 19, through a system bus 103. The controller 100 controls each part according to a control program stored in the system memory 101 and temporally stores data generated at this time or data (for example, printing condition data), which are inputted from the operation display 19 or the image processing apparatus 10, in the system memory 101 to execute various kinds of processing.

The operation display 19 is constituted of a touchpanel and controlled by the controller 100, which comprises a display panel 191 for displaying an operation condition of the apparatus, an input instruction to a user or the like, a ten-key keypad 192 through which the user inputs numerals while watching the display panel 191, a printing key 193 which is operated to make the image forming apparatus 1 start operations of sheet conveyance and image forming and the like. In addition, various kinds of function keys are provided at appropriate timing in the display panel 191 (a double-side print key 19*a*, a first special sheet key 961 and the like, referring to FIGS. 11A through 12B).

In the scanner unit 13, an image of an original set on a translucent original retainer 30 is exposed and scanned by a scanner 31 moving along the original retainer 30 at predetermined speed and reflected light from the original is guided by a plurality of optical elements such as a reflecting mirror 32 and an imaging lens 33 and focused onto a photoelectric transfer device 34. Thus, the scanner 13 reads the original at predetermined resolution, converts the read image to image data of an electrical signal and inputs the image data to the printer unit 12.

The automatic original conveying unit 14 is disposed so as to cover the original retainer 30 and comprises an original conveyer 41 for conveying the original set on the original retaining tray 40 by the user onto the original retainer 30 of the scanner 13 and discharging the scanned original to an original receiving tray 42. The apparatus can be opened so as to pivot on the backside thereof such that the original retainer 30 is exposed. Thus, the user can set the original by hand on the original retainer 30. As described above, the image forming apparatus 1 has an automatic reading function for automatically conveying the original sheet to the scanner 13 by the automatic original conveying unit 14, setting the original on the original retainer 30, exposing and scanning the original sequentially one sheet after another so as to read the original image, and a manual reading function in which the image of the original set on the original retainer 30 is read manually by the user.

The printer unit 12 includes a printer 20 having a drum-shaped photoconductor 200 and an imprinter 201 in an approximately central portion thereof and a sheet supplier 21 in a lower portion thereof. The sheet supplier 21 has a sheet holding tray 210 which holds one or a plurality of sheets and a feeder 211 which supplies the sheet held in the sheet holding tray 210 to the printer 20 one sheet after another. The sheet holding tray 210 is provided detachably so as to be drawn out when the user supplies the sheet. The sheet holding tray 210 holds a standard sheet having the same attribute at both sides, on each of which sides image can be printed.

The printer unit 12 comprises a sheet receiving slit 27 for receiving the sheet supplied from the sheet supplying unit 16 in an under surface.

The sheet supplying unit 16 has three sheet suppliers 61, 62 and 63. The sheet suppliers 61, 62 and 63 have sheet holding trays 610, 620 and 630 for holding one or a plurality of sheets and feeders 611, 621 and 631 for supplying the sheet in the sheet holding trays 610, 620 and 630 through the sheet receiving slit 27 to the printer 20 one sheet after another. The sheet holding trays 610, 620 and 630 are provided detachably so as to be drawn out when the user supplies the sheet. The sheet holding tray 610 holds a special sheet with the front side thereof up, on both sides of which image can be printed and which has a letterhead on the front side thereof. The sheet holding tray 620 holds a standard sheet whose size is larger than that held in the sheet holding tray 210. The sheet holding tray 630 holds a special sheet with the front side thereof up, on both sides of which image can be and which has a punch hole on the left side of the front side.

The printer unit 12 includes a light scanner 22 adjacent to the printer 20. In addition, it includes a printer controller 24 in the upper portion of the light scanner 22. The printer controller 24 holds an image process controller 242 using a process control unit (PCU) substrate which controls the image forming process and an interface 241 which receives image data from the outside (the image processing apparatus 10 in this case) of the image forming apparatus 1. The printer unit 12 further includes an image memory 201 which can store image data for one side of the original. The image process controller 242 is controlled by the controller 100 to store the image data inputted from the scanner unit 13 in the image memory 201. The controller 100 and the image process controller 242 store the image data in the image memory 201 and the printing condition data in the system memory 101 when the image data and the printing condition data are inputted through the interface 241.

The printer unit 12 further includes an image processor 25 provided with an image control unit (ICU) substrate, which is controlled by the image process controller 242 to execute a predetermined process to the image data stored in the image memory 201 such that the image data is scanned by a light scanner 22 to be recorded on the photoconductor 200 as an electrostatic latent image. The printer unit 12 further includes a power supplying unit 26 in the lower portion for supplying power to each part.

A supply and conveyance controller 102 is controlled by the controller 100 to rotate or switch supplying means provided in each part (feeders 211, 611, 621 and 631), conveying means and reversal means (conveyance rollers 110, guide-in/guide-out rollers 28 and 83 and the like to be described later) and destination switching means (gates 251 and 81 and the like to be described later).

When the sheet is supplied to the printer 20 by the feeders 211, 611, 621 and 631 controlled by the supply and conveyance controller 102 and an image is formed on the sheet, the photoconductor 200 and the imprinter 203 are controlled by the supply and conveyance controller 102 to rotate so as to form an image on the sheet while conveying the sheet supplied to a position between the photoconductor 200 and the imprinter 203 to the upper part of the printer 20. In this case, the image process controller 242 controls the light scanner 22 such that an electrostatic latent image is formed on the peripheral surface of the photoconductor 200 according to the image data and developed to form a toner image. The toner image is transferred by the imprinter 203 to the sheet supplied to a position between the photoconductor 200 and the imprinter 203. In other words, the image is formed on the surface of the sheet which is in contact with the photoconductor 200.

A fixer 23 is provided at an upper part of the printer 20. The fixer 23 is controlled by the supply and conveyance controller 102 to rotate and sequentially receives the sheet (on which the image was formed) conveyed from the printer 20. The fixer 23 fixes the image onto the sheet by heating up a developer transferred onto the sheet and then conveys the sheet to an upper part of the fixer 23.

Furthermore, when the sheet is supplied to the printer 20 by the feeders 211, 611, 621 and 631 controlled by the supply and conveyance controller 102 but no image is to be formed thereon, the image forming apparatus 1 performs idle conveyance. In this case, the photoconductor 200 and the imprinter 203 are controlled by the supply and conveyance controller 102 to rotate and convey the sheet supplied to a position between the photoconductor 200 and the imprinter 203 to the upper portion of the printer 20. The fixer 23 is controlled by the supply and conveyance controller 102 to rotate so as to sequentially receive the sheet (on which the image is not formed) conveyed from the printer 20 and then convey the sheet to an upper part of the fixer 23.

A gate 251 is disposed on the upper side of the fixer 23. When the sheet is conveyed from the fixer 23 to the upper portion of the fixer 23, the gate 251 is controlled by the supply and conveyance controller 102 to be switched so as to convey the sheet from the printer unit 12 to the transit conveyance unit 18. Therefore, the sheet conveyed to the upper portion of the fixer 23 abuts on the gate 251 and is conveyed to the guide-in/guide-out roller 28 for conveying the sheet to the transit conveyance unit 18.

The guide-in/guide-out roller 28 is provided between the printer unit 12 and the transit conveyance unit 18 and controlled by the supply and conveyance controller 102 so as to rotate in the forward and backward directions. The guide-in/guide-out roller 28 conveys the sheet from the printer unit 12 to the transit conveyance unit 18 while it rotates in the forward direction, and conveys the sheet from the transit conveyance unit 18 to the printer unit 12 while it rotates in the backward direction. The supply and conveyance controller 102 rotates the guide-in/guide-out roller 28 in the forward or backward direction when the sheet is reversed and only in the forward direction when the sheet is not reversed.

When the sheet is conveyed from the transit conveyance unit 18 to the printer unit 12 by the guide-in/guide-out roller 28, the gate 251 is switched so that the sheet is conveyed to a reversal and conveyance unit 11. Therefore, the sheet passes through the gate 251 and is conveyed to the conveyance roller 110 for conveying the sheet to the reversal and conveyance unit 11.

The transit conveyance unit 18 includes a gate 81 adjacent to the guide-in/guide-out roller 28. When the sheet is conveyed from the printer unit 12 to the transit conveyance unit 18 and is not reversed, the gate 81 is controlled by the supply and conveyance controller 102 to be switched such that the sheet is conveyed to the sheet posttreatment unit 15. Therefore, the sheet conveyed to the transit conveyance unit 18 passes through the gate 81 and is conveyed to a lower portion of the transit conveyance unit 18 and then to the conveyance roller 110 for conveying the sheet to the sheet posttreatment unit 15.

The transit conveyance unit 18 further comprises a guide-in/guide-out roller 83 disposed at the upper portion of the transit conveyance unit 18 and a reversal tray 82 disposed on an upper surface of the transit conveyance unit 18. When the sheet is conveyed from the pointer unit 12 to the transit conveyance unit 18 and is reversed, the gate 81 is switched such that the sheet is conveyed from the inside of the transit conveyance unit 18 to the reversal tray 82. Therefore, the sheet conveyed to the transit conveyance unit 18 abuts on the gate 81 and is conveyed to the guide-in/guide-out roller 83 for conveying the sheet to the reversal tray 82.

The guide-in/guide-out roller 83 is controlled by the supply and conveyance controller 102 so as to rotate in the forward and backward directions. The guide-in/guide-out roller 83 conveys the sheet from the guide-in/guide-out roller 28 to the reversal tray 82 through the inside of the transit conveyance unit 18 (gate 81) while rotating in the forward direction and conveys the sheet from the reversal tray 82 to the guide-in/guide-out roller 28 through the gate 81 while rotating in the backward direction. For reversing the sheet, the supply and conveyance controller 102 rotates the guide-in/guide-out roller 83 in the forward direction to convey the sheet to the reversal tray 82 and then rotates the guide-in/guide-out roller 83 in the backward direction to convey the sheet on the reversal tray 82 to the inside of the transit conveyance unit 18.

The reversal and conveyance unit 11 includes conveyance rollers 110 therein. The sheet conveyed to the reversal and conveyance unit 11 through the gate 251 by the guide-in/guide-out roller 28 rotating in the backward direction is made to pass through the inside of the reversal and conveyance unit 11 by the conveyance rollers 110 and is conveyed to the printer unit 12 and then to the printer 20.

The supply and conveyance controller 102 counts the number of reverses of the sheet (in this case, the number of detections of the sheet) and stores the number in the system memory 101 when the sheet is reversed (for example, sheet detecting means for detecting the sheet is provided in the reversal and conveyance unit 11 and the sheet detecting means detects the sheet).

The sheet posttreatment unit 15 has a function of performing a posttreatment (stapling process, for example) for the sheet. The sheet posttreatment unit 15 includes a guide-in roller 50 between the sheet posttreatment unit 15 and the transit conveyance unit 18. The guide-in roller 50 is controlled by the supply and conveyance controller 102 to convey the sheet conveyed from the transit conveyance unit 18 to the inside of the sheet posttreatment unit 15.

The sheet posttreatment unit 15 further includes a gate 52. The supply and conveyance controller 102 switches the gate 52 according to the conditions inputted through the operation display 19 by a user. For example, when the sheet is to be stapled, the supply and conveyance controller 102 switches the gate 52 such that the sheet conveyed to the inside of the sheet posttreatment unit 15 is conveyed to the conveyance roller 57, and when the sheet is not to be stapled, it switches the gate 52 such that the sheet is conveyed to a guide-out roller 53.

The sheet posttreatment unit 15 further includes sheet receiving trays 56 and 59, which protrude outside of the apparatus, for receiving the sheet on which the image was formed and the guide-out roller 53 for guiding the sheet to the sheet receiving tray 56. The sheet conveyed to the guide-out roller 53 is guided out to the sheet receiving tray 56 by the guide-out roller 53. The sheet conveyed to the conveyance roller 57 is stapled by the stapling processor 58 and then discharged to the sheet receiving tray 59.

The stapling processor 58 includes a staple tray, a matching plate for aligning the sheets in the direction perpendicular to the conveying direction, a roller belt pair conveying means for conveying the sheet on the staple tray, an abutting guide for aligning the sheet ends on the staple tray, a stapler for performing stapling process, and a guide for guiding out the stapled sheets to the guide-out roller. The stapled sheets are discharged to the sheet receiving tray 59 by the guide-out roller.

The end of the sheet in the conveying direction on the staple tray of the stapling processor 58 contacts with the roller belt pair conveying means and runs into the abutting guide by the roller belt pair conveying means. The sheet ends in the direction perpendicular to the conveying direction are aligned by the matching plate. When the predetermined number of sheets is stacked on the staple tray, the sheets are stapled by the stapler.

FIGS. 11A through 12B show examples of input instructions displayed on and function keys provided in the operation display 19 which constitutes the image forming apparatus 1.

Figure 11A:
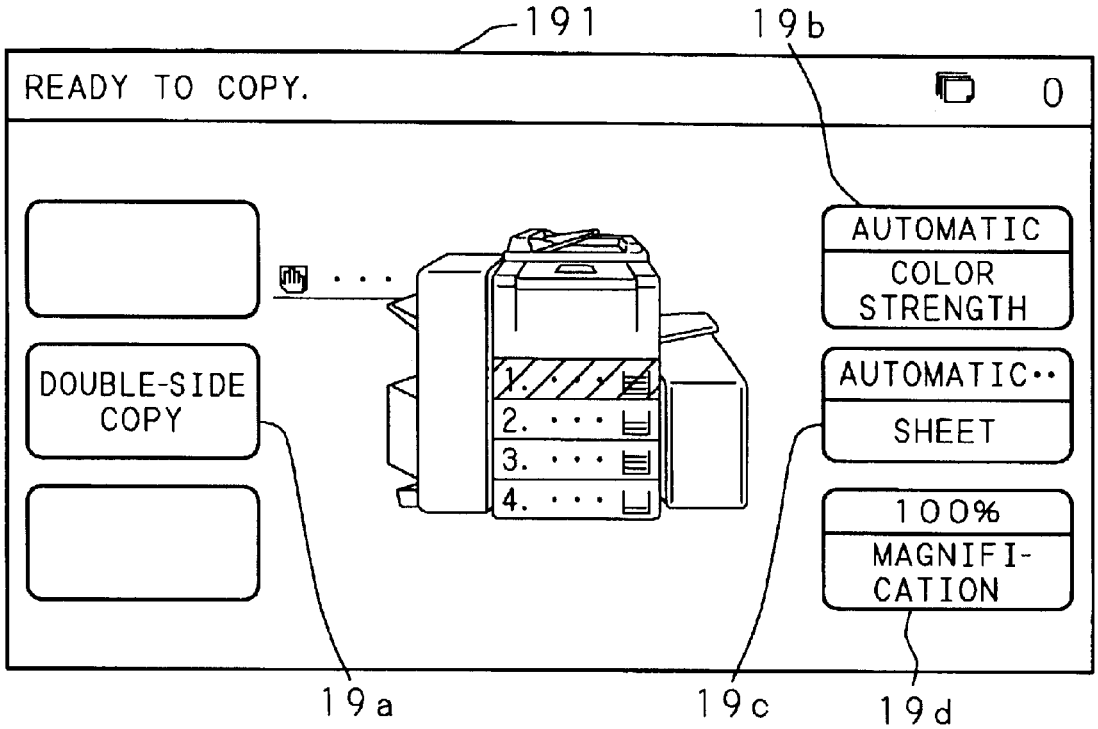
FIGS. 11A through 12B show examples of input instructions displayed on the operation display and function keys provided in the operation display constituting the image forming apparatus according to the first embodiment of the present invention.

FIG. 11A shows a basic display image usually displayed on a display panel 191. The display panel 191 is provided with a double-side print key 19*a* which is operated when the user performs double-side printing.

The controller 100 determines whether the sheet is to be reversed or not and whether the idle conveyance is to be performed or not, by determining whether the double-side print key 19*a* has been operated or not. If the double-side print key 19*a* has been operated, the controller 100 obtains information that an image is to be formed on both sides of the sheet. At this time, the controller 100 forms the image on one side of the sheet and then reverses the sheet to form the image on the other side of the sheet so as to form the image on both sides of the sheet (double-side printing). Then the controller 100 further reverses the sheet for idle conveyance and discharges the sheet. If the double-side print key 19*a* has not been operated, the controller 100 obtains information that an image is to be formed on one side of the sheet. At this time, the controller 100 forms an image on one side of the sheet and then discharges the sheet without reversing the sheet. The image is thus formed on one side of the sheet (single-side printing) and the idle conveyance is not performed.

The display panel 191 includes a color strength selecting key 19*b* to be operated by the user when the color strength of the image to be formed on the sheet is set, a sheet selecting key 19*c* to be operated by the user when the kind of the sheet on which the image is to be formed is selected, and a magnification key 19*d* to be operated by the user when the magnification of expansion or reduction of the image to be formed on the sheet is set.

Figure 11B:
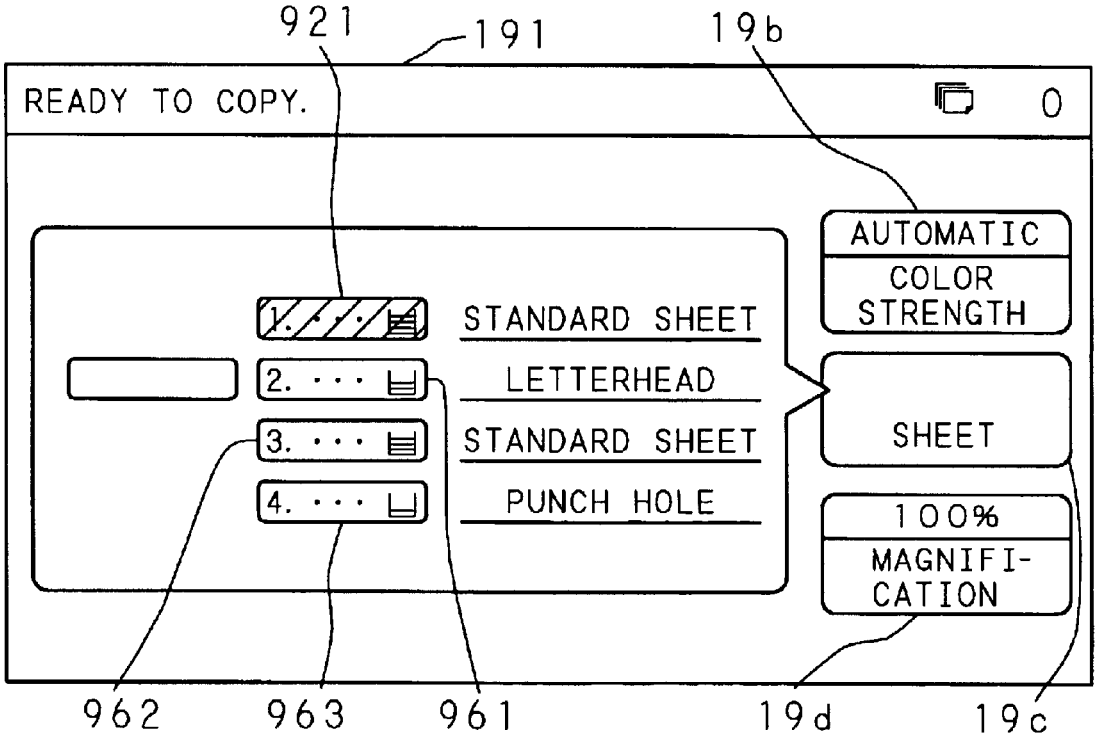

FIG. 11B shows a sheet selecting screen displayed when the sheet selecting key 19*c* was operated in FIG. 11A. The display panel 191 includes a first standard sheet key 921 to be operated when the standard sheet having the same attribute at both sides, on each of which sides image can be formed, is selected, a first special sheet key 961 to be operated when the special sheet on both sides of which image can be printed and which has a letterhead on the front side is selected, a second standard sheet key 962 to be operated when the standard sheet whose size is larger than the above standard sheet is selected, and a second special sheet key 963 to be operated when the special sheet on both sides of which image can be printed and which has a punch hole on the left side of the front side is selected.

If the first standard sheet key 921 has been operated, the controller 100 controls the supply and conveyance controller 102 to selectively operate the sheet supplier 21 to supply the standard sheet held in the sheet holding tray 210. If the first special sheet key 961, the second standard sheet key 962 or the second special sheet key 963 has been operated, the controller 100 controls the supply and conveyance controller 102 to selectively operate the sheet supplier 61, 62 or 63 to supply the standard or special sheet held in the sheet holding tray 610, 620 or 630, respectively.

More specifically, if the first special sheet key 961 or the second special sheet key 963 has been operated, the controller 100 obtains the information that the sheet has different attributes at respective sides, and if the first standard sheet key 921 or the second standard sheet key 962 has been operated, the controller 100 obtains the information that the sheet has the same attribute at both sides.

In FIG. 11B, the first standard sheet key 921 has been previously selected and the first standard sheet key 921 is displayed inverted.

Figure 12A:
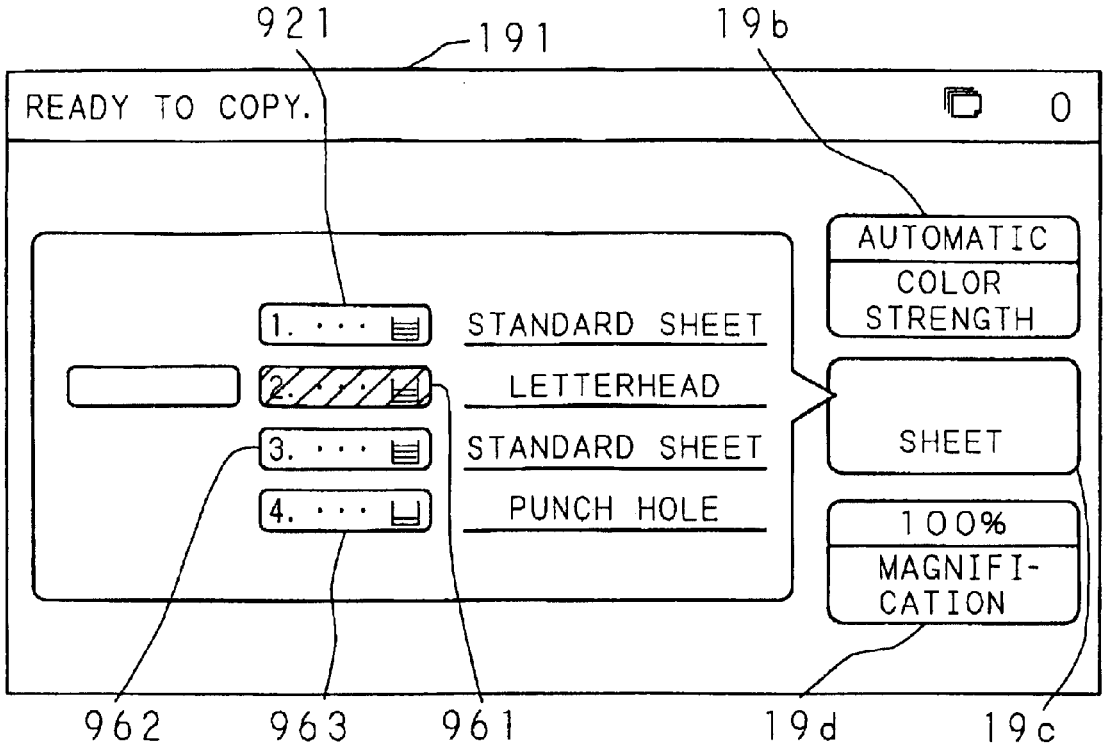

FIG. 12A shows a sheet selecting screen displayed when the first special sheet key 961 was operated in FIG. 11B. The operated first special sheet key 961 is displayed inverted. The first standard sheet key 921 is displayed normally. As described above, the used can see the key selected at the present since the key is displayed inverted.

Figure 12B:
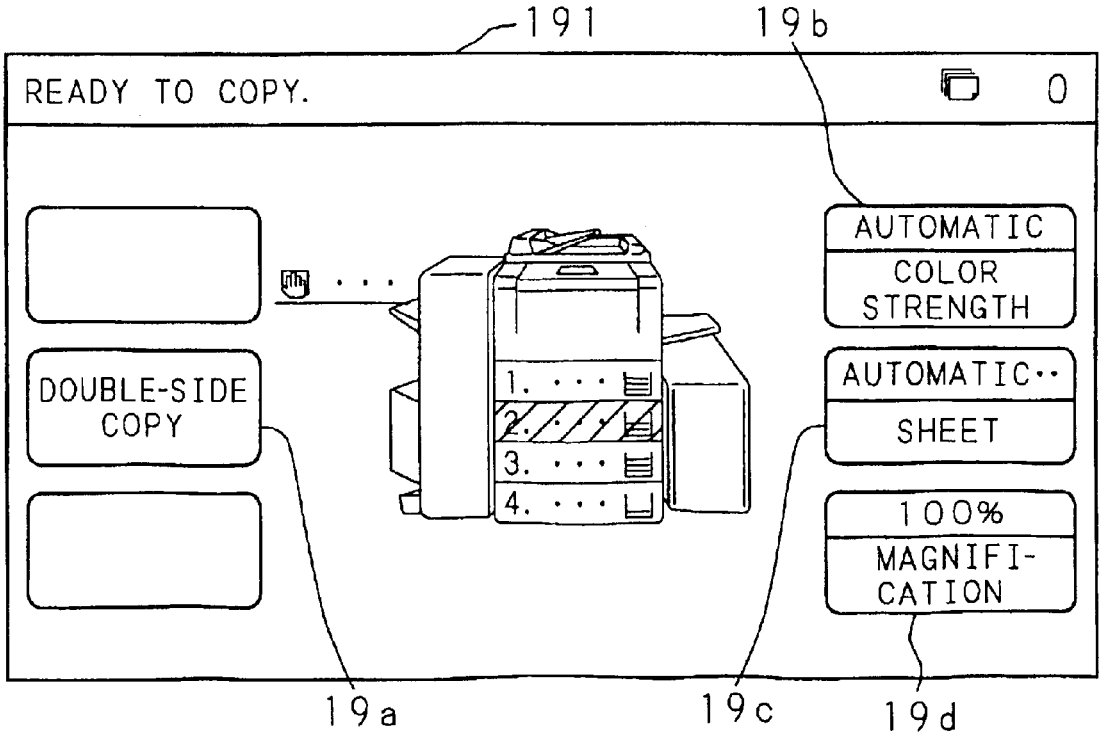

FIG. 12B shows a sheet selecting screen displayed when the sheet selecting key 19*c* was operated in FIG. 12A or when a predetermined time has been elapsed since the first special sheet key 961 was operated.

As described above, when each sheet key such as the first standard sheet key 921 or the first special sheet key 961 has been operated, the controller 100 determines whether the special sheet has been selected or the sheet other than the special sheet has been selected, i.e., whether the sheet on which the image is to be formed has different attributes at respective sides or not.

Figure 13:
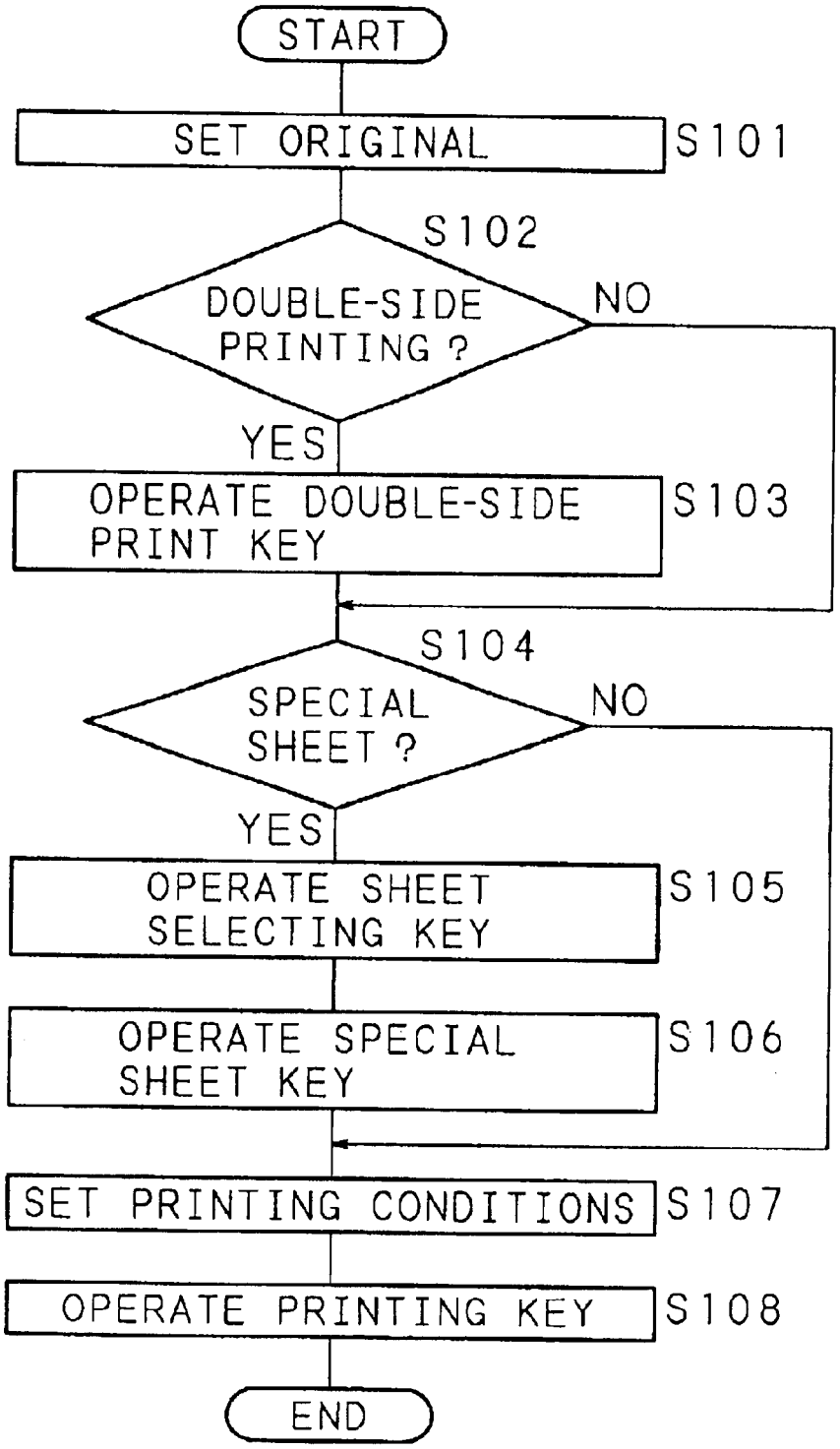
FIG. 13 is a flowchart showing procedures of a user for forming an image with the image forming apparatus according to the first embodiment of the present invention.

FIG. 13 is a flowchart showing procedures of the user for forming an image with the image forming apparatus 1.

The user sets an original on the original retainer 30 or the original retaining tray 40 (step S101). At this time, a basic display image is displayed on the display panel 191 of the operation display 19.

The user then determines whether the double-side printing is to be performed or not (step S102). If the double-side printing is to be performed (YES at step S102), the user operates the double-side print key 19*a* provided on the display panel 191 (step S103). When the single-side printing is to be performed (NO at step S102), the user does not operate the double-side print key 19*a*.

The user then determines whether the special sheet is to be used or not (step S104). When the special sheet is to be used (YES at step S104), the user operates the sheet selecting key 19*c* provided on the display panel 191 to display the sheet selecting screen (step S105). The user then operates the first special sheet key 961 or the second special sheet key 963 according to a required special sheet (step S106). When the special sheet is not to be used (NO at step S104), the user does not operate the sheet selecting key 19*c*, or does not operate the first special sheet key 961 nor the second special sheet key 963 on the sheet selecting screen.

Last of all, the user sets printing conditions such as a color strength, magnification of the image to be formed or the number of sheets using the color strength selecting key 19*b*, the magnification key 19*d* or the ten-key keypad 192 (step S107) and then operates a printing key 193 (step S108).

Figure 14:
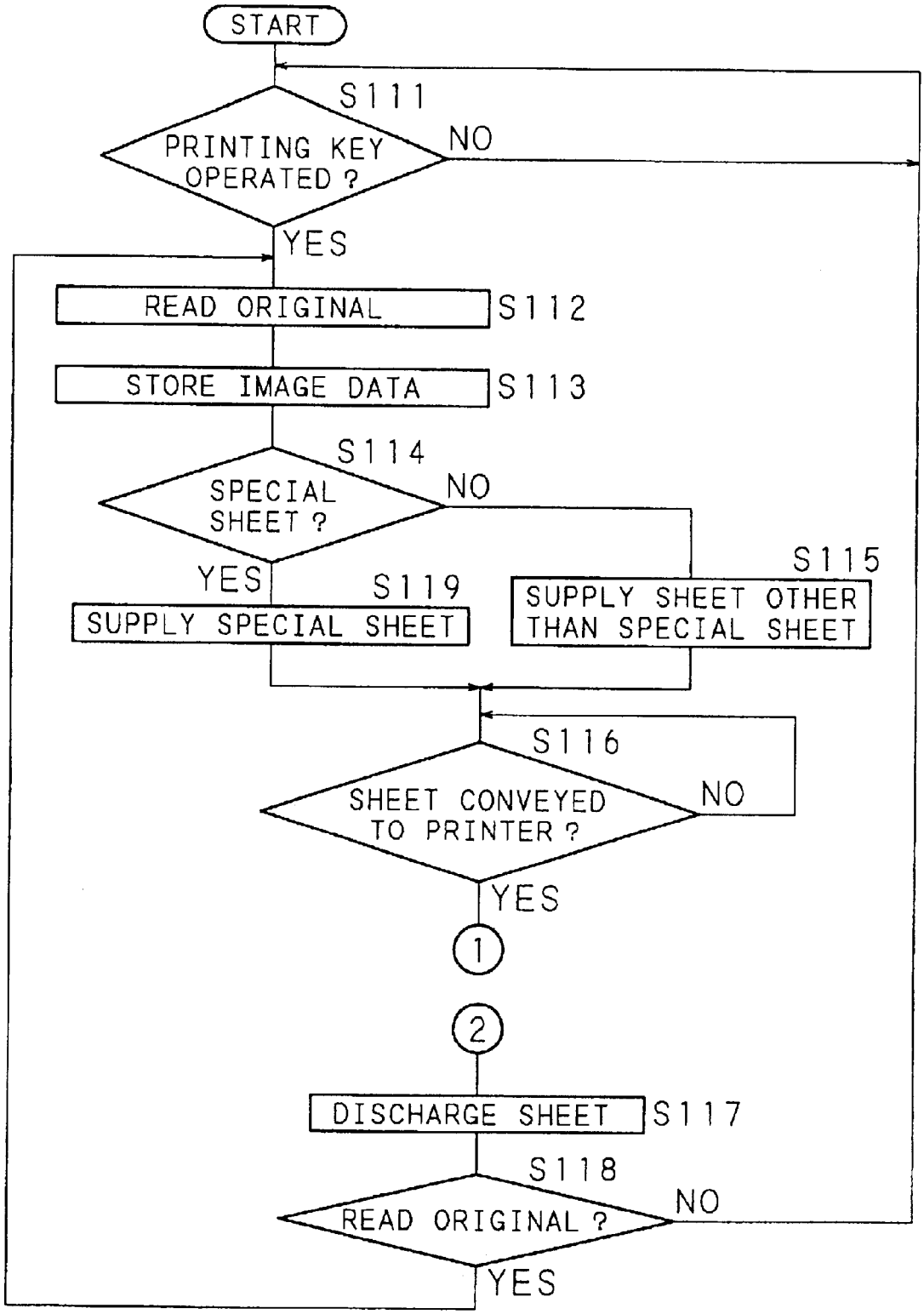
FIGS. 14 and 15 are flowcharts showing processing procedures of image formation and sheet conveyance by the image forming apparatus according to the first embodiment of the present invention.
Figure 15:
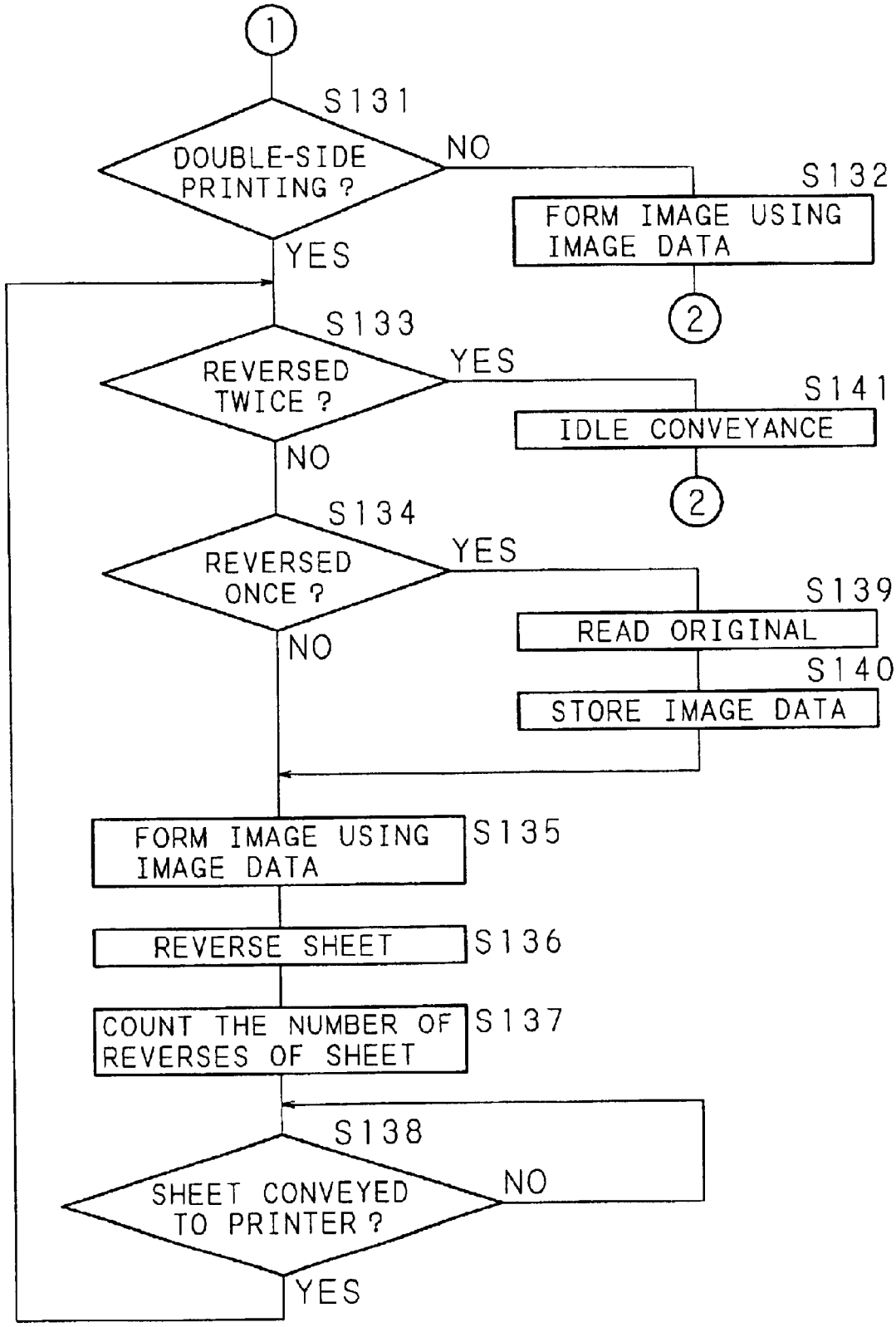

FIGS. 14 and 15 are flowcharts showing processing procedures of the image formation and the sheet conveyance of the image forming apparatus 1.

The controller 100 determines whether the printing key 193 has been operated or not (step S111). If the printing key 193 has been operated (YES at step S111), the controller 100 starts to read the original in the original retainer 30 or the original retaining tray 40 (step S112) and generates image data from the read image to store the image data in an image memory 201 (step S113). If the printing key 193 has not been operated (NO at step S111), the controller 100 waits until the key is operated.

The controller 100 then determines whether the first special sheet key 961 or the second special sheet key 963 had been operated or not before the printing key 193 was operated (step S114).

If neither the first special sheet key 961 nor the second special sheet key 963 has been operated (NO at step S114, i.e., if the sheet selecting key 19*c* has not been operated, or if the sheet selecting key 19*c* has been operated and the first standard sheet key 921 or the second standard sheet key 962 has been operated), the controller 100 drives the feeder 211 or the feeder 621 to supply one sheet other than the special sheet (i.e., the standard sheet held in the sheet holding tray 210 or the standard sheet held in the sheet holding tray 620) to the printer 20 (step S115).

The controller 100 then determines whether the sheet has been conveyed to the printer 20 or not (step S116). At this time, for example, sheet detecting means is provided in front of the printer 20 and it is determined whether the sheet has been conveyed to the printer 20 or not by determining whether the sheet detecting means has detected the sheet or not.

If the sheet has not been conveyed to the printer 20 (NO at step S116), the controller 100 continues to drive the feeder 211 or the feeder 621 until the sheet is conveyed to the printer 20. If the sheet has been conveyed to the printer 20 (YES at step S116), the controller 100 determines whether the double-side print key 19*a* had been operated or not before the printing key 193 was operated (step S131).

If the printing key 193 had not been operated (NO at step S131), the controller 100 performs the single-side printing. An image is formed on the sheet by the printer 20 using the printing conditions stored in the system memory 101 and the image data stored in the image memory 201 at step S113 (step S132) and the image is fixed onto the sheet by the fixer 23. Then, the controller 100 discharges the sheet (step S117). In this case, the controller 100 switches the gates 251 and 81 and rotates the guide-in/guide-out roller 28 in the forward direction to convey the sheet to the transit conveyance unit 18 and further to the sheet posttreatment unit 15. Furthermore, the sheet is discharged to the sheet receiving trays 56 (59) by the guide-out roller 53 (57). At this time, the sheet is discharged to the sheet receiving tray 56 (59) with the image-formed side down.

Last of all, the controller 100 determines whether the next original is to be read or not (for example, there is an original or not in the original retaining tray 40) (step S118). If the-next original is to be read (YES at step S118), the operation returns to step S112. If the next original is not to be read (NO at step S118), the operation returns to step S111.

If the double-side print key 19*a* had been operated before the printing key 193 was operated (YES at step S131), the controller 100 performs the double-side printing. First, the controller 100 determines whether the sheet has been reversed twice or not referring to the system memory 101 to determine whether an image is to be formed or not on the sheet conveyed to the printer 20 (step S133). In this case, if the sheet has not been reversed twice (NO at step S133), the controller 100 determines whether the sheet has been reversed once or not (step S134).

If the sheet has not been reversed (NO at step 134), the controller 100 forms an image on the sheet by the printer 20 using the printing conditions stored in the system memory 101 and the image data stored in the image memory 201 (in this case, the image data stored in the image memory 201 at step S113) (step S135) and the image is fixed by the fixer 23.

Then, the controller 100 reverses the sheet. In this case, the controller 100 switches the gates 251 and 81 and rotates the guide-in/guide-out rollers 28 and 83 in the forward direction to convey the sheet to the reversal tray 82 of the transit conveyance unit 18. The controller 100 then switches the gate 251 and rotates the guide-in/guide-out rollers 28 and 83 in the backward direction to draw back the sheet to the printer unit 12, makes the sheet pass through the gate 251 and conveys the sheet to the reversal and conveyance unit 11 (step S136). At this time, the controller 100 counts the number of reverses of the sheet (in this case, once) and stores the number in the system memory 101 (step S137).

The controller 100 then determines whether the sheet has been conveyed to the printer 20 or not (step S138). If it has not been conveyed (NO at step S138), the controller 100 continues to drive the conveyance rollers 110 of the reversal and conveyance unit 11 until the sheet is conveyed. If the sheet has been conveyed to the printer 20 (YES at step S138), the controller 100 returns the operation to step S133 and determines whether the sheet has been reversed twice or not referring to the system memory 101 to determine whether the image is to be formed on the sheet or not. If the sheet has not been reversed twice, the controller 100 determines whether the sheet has been reversed once or not at S134.

When the sheet has been reversed once (YES at step S134), the controller 100 reads the original set in the original retainer 30 or the original retaining tray 40 (step S139), generates image data from the read image, stores the image data in the image memory 201 (step S140) and returns the operation to step S135. When the image data is stored in the image memory 201 at step S140, the image data is overwritten onto the image data stored in the image memory 201 at step S113.

At step S135, the controller 100 forms an image on the sheet by the printer 20 using the printing conditions stored in the system memory 101 and the image data stored in the image memory 201 (in this case, the image data stored in the image memory 201 at step S140) and fixes the image by the fixer 23.

Then, the controller 100 reverses the sheet at step S136, counts the number of reverses of the sheet (in this case, twice) and stores the number in the system memory 101 at step S137.

At step S138, the controller 100 determines whether the sheet has been conveyed to the printer 20 or not. If the sheet has been conveyed, the operation returns to step S133 and it is determined whether the sheet has been reversed twice or not referring to the system memory 101.

If the sheet has been reversed twice (YES at step S133), the controller 100 deletes the data of the number of reverses stored in the system memory 101. The controller 100 then performs idle conveyance (step S141) and the operation returns to step S117. In this case, the sheet is discharged to the sheet receiving tray 56 (59) with the side, on which the image corresponding to the image of the original read at step S112 has been formed, facing down.

If the first special sheet key 961 or the second special sheet key 963 has been operated (YES at S144), the controller 100 drives the feeder 611 or the feeder 631 to supply one special sheet (i.e., the special sheet held in the sheet holding tray 610 or the special sheet held in the sheet holding tray 630) to the printer 20 (step S119). The controller 100 then shifts the operation to step S116 at which an image is formed in the same manner as the sheet other than the special sheet.

FIGS. 16A through 20C are explanatory drawings showing procedures of image formation and sheet conveyance of the image forming apparatus 1. Hereinafter, description will be made of a case in which an image is printed on both sides of a sheet P (a special sheet in this case) stored in the sheet holding tray 610 with the front side Pa up and the back side Pb down. At this time, it is assumed that the stapling process is not performed.

Figure 16A:
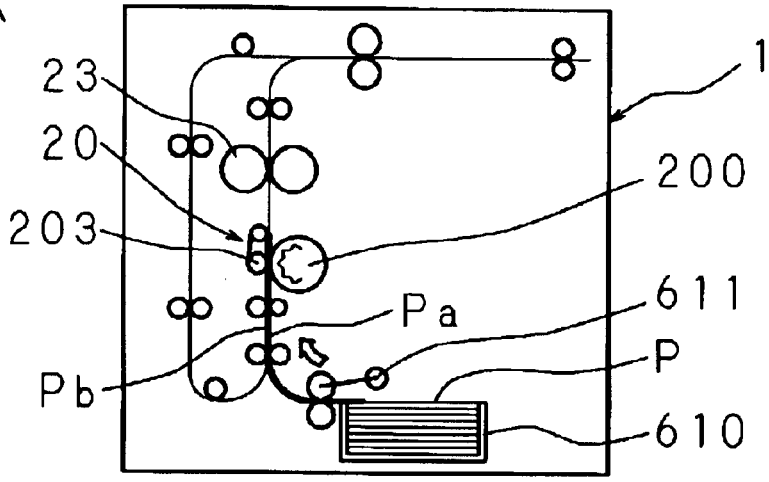
FIGS. 16A through 20C are explanatory views showing procedures of image formation and sheet conveyance by the image forming apparatus according to the first embodiment of the present invention.
Figure 16B:
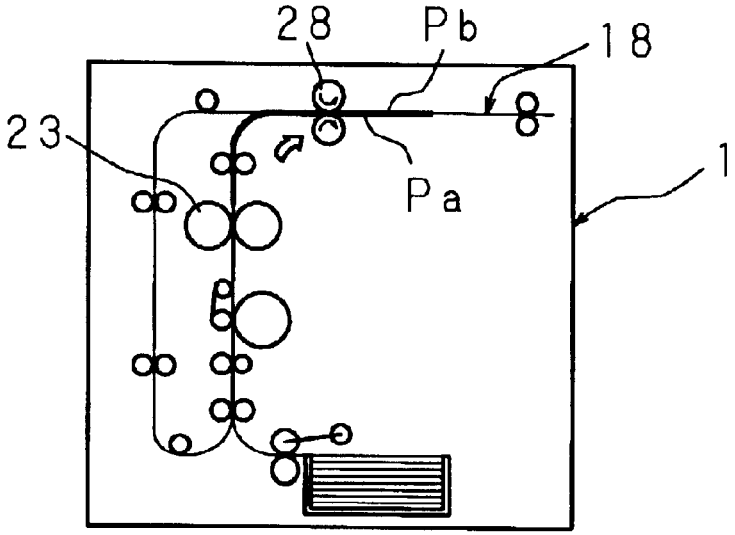

The sheet P which has been supplied to the printer 20 from the sheet holding tray 610 by the feeder 611 is conveyed to a position between the photoconductor 200 and the imprinter 203 in the direction shown by an outline arrow such that the front side Pa is in contact with the photoconductor 200, whereby an image is formed on the front side Pa (referring to FIG. 16A).

Figure 16C:
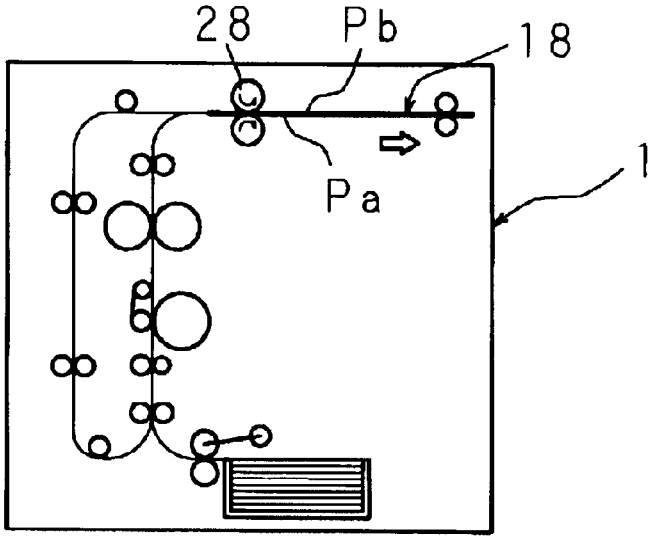
Figure 17A:
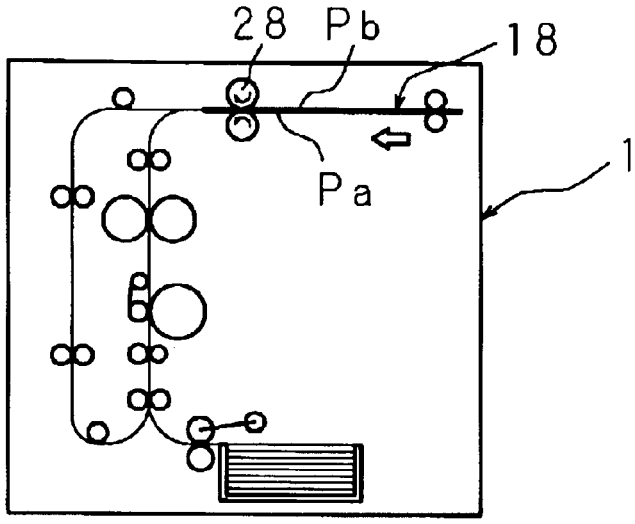
Figure 17B:
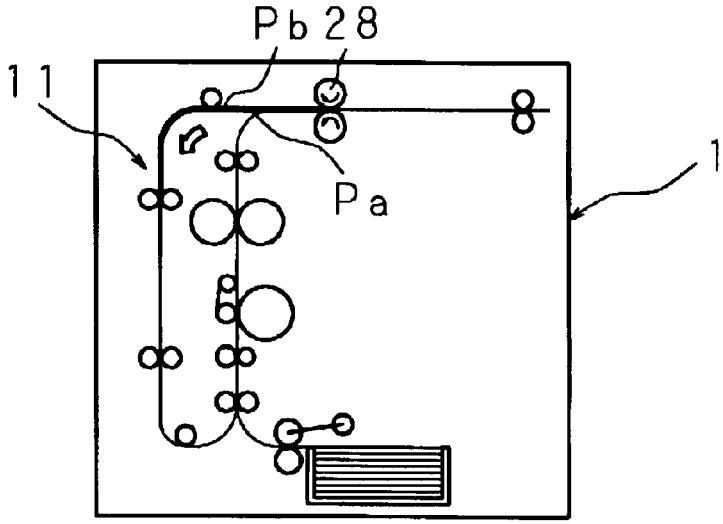
Figure 17C:
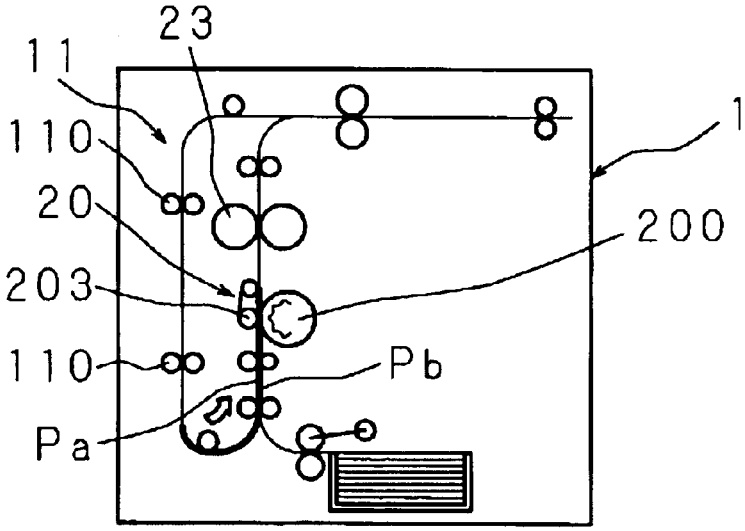

The sheet P on which the image was fixed onto the front side Pa by the fixer 23 is conveyed in the direction shown by an outline arrow by the guide-in/guide-out roller 28 rotating in the forward direction to the transit conveyance unit 18 (referring to FIG. 16B) and reaches the transit conveyance unit 18 with the front side Pa down and the back side Pb up (referring to FIG. 16C). The sheet P is then conveyed in the backward direction (shown by an outline arrow) by the guide-in/guide-out roller 28 rotating in the backward direction (referring to FIG. 17A) to the reversal and conveyance unit 11 (referring to FIG. 17B) and is made to pass through the reversal and conveyance unit 11 by the conveyance rollers 110 of the reversal and conveyance unit 11. The sheet P is then conveyed to a position between the photoconductor 200 and the imprinter 203 of the printer 20 such that the back side Pb is in contact with the photoconductor 200, whereby the image is formed on the back side Pb (referring to FIG. 17C).

Figure 18A:
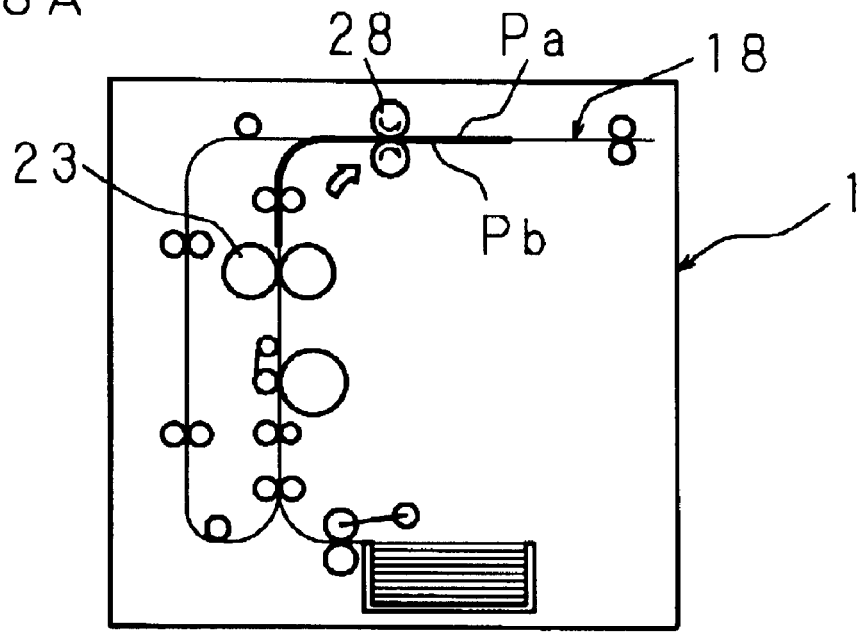
Figure 18B:
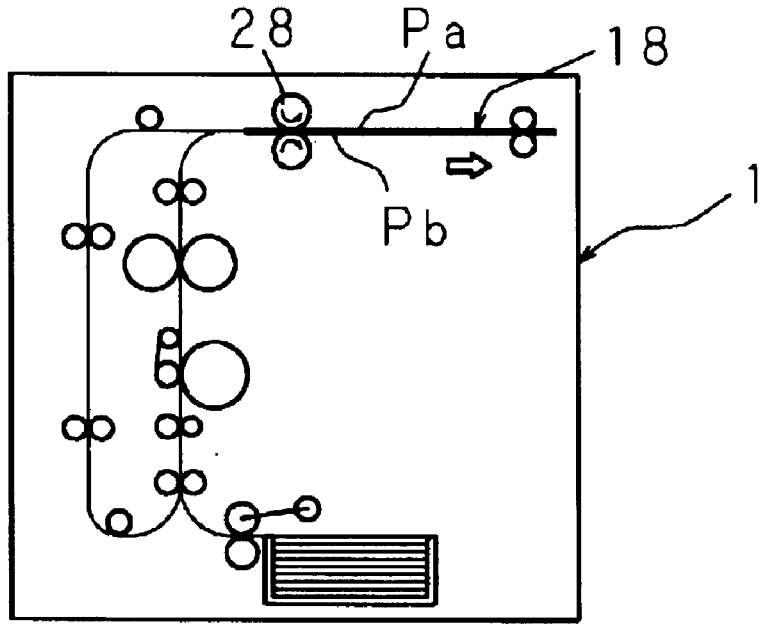
Figure 19A:
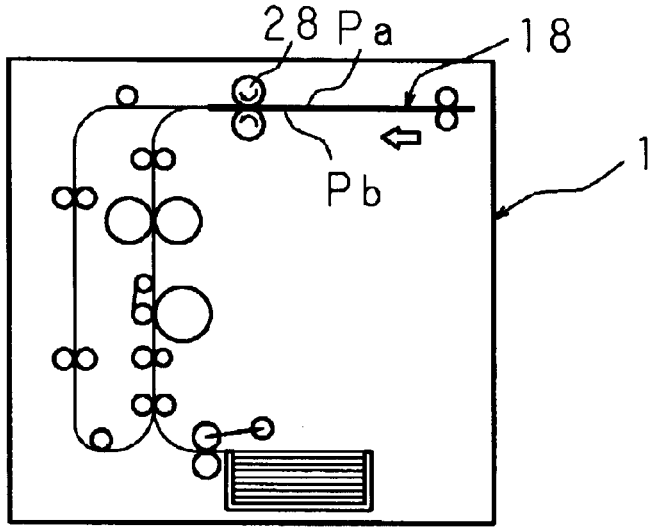
Figure 19B:
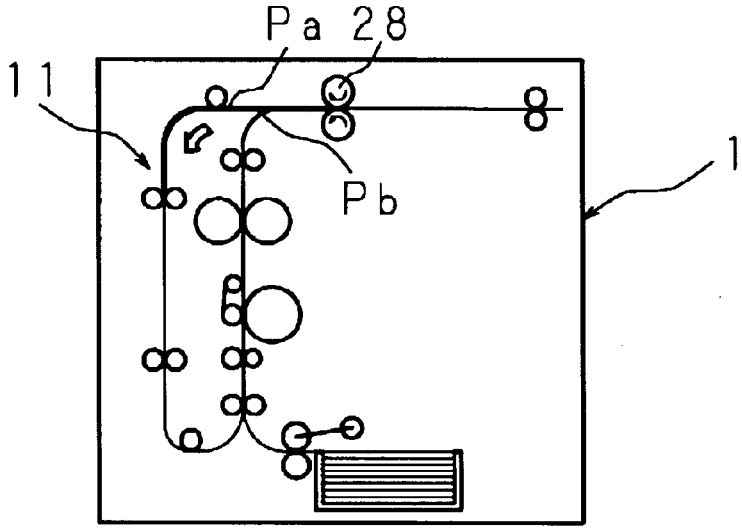
Figure 19C:
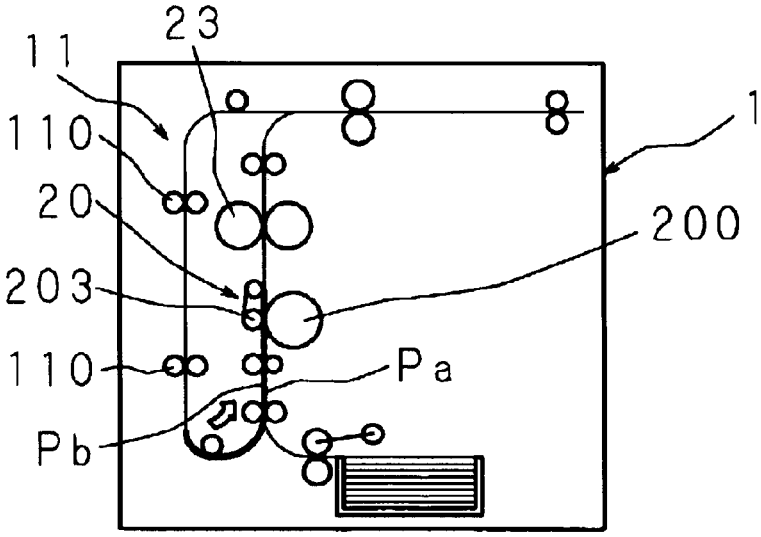

The sheet P on which the image was fixed onto the back side Pb by the fixer 23 is conveyed in the direction shown by an outline arrow by the guide-in/guide-out roller 28 rotating in the forward direction to the transit conveyance unit 18 (referring to FIG. 18A) and reaches the transit conveyance unit 18 with the back side Pb down and the front side Pa up (referring to FIG. 18B). The sheet P is then conveyed in the backward direction (shown by an outline arrow) by the guide-in/guide-out roller 28 rotating in the backward direction (referring to FIG. 19A) to the reversal and conveyance unit 11 (referring to FIG. 19B) and is made to pass through the reversal and conveyance unit 11 by the conveyance rollers 110 of the reversal and conveyance unit 11. The sheet P is then conveyed to a position between the photoconductor 200 and the imprinter 203 of the printer 20 such that the front side Pa is in contact with the photoconductor 200 (referring to FIG. 19C). At this time, the image is not formed.

Figure 20A:
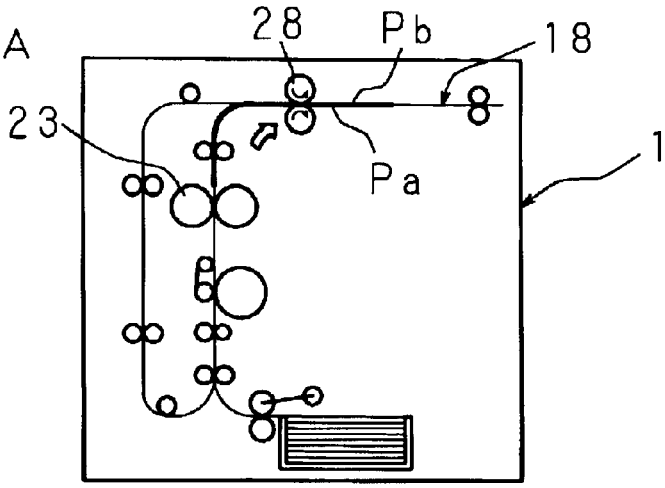
Figure 20B:
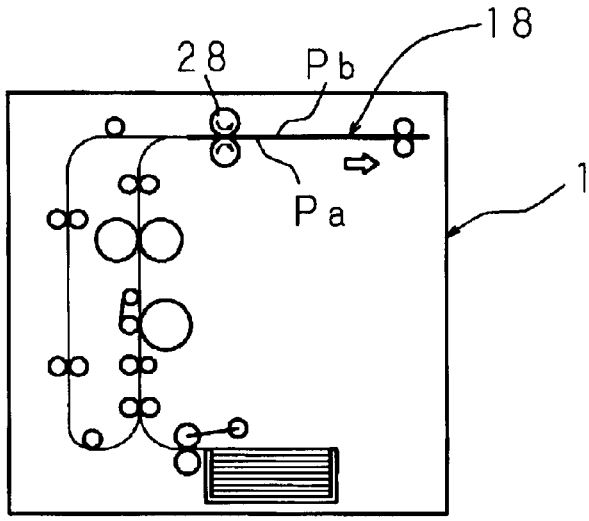
Figure 20C:
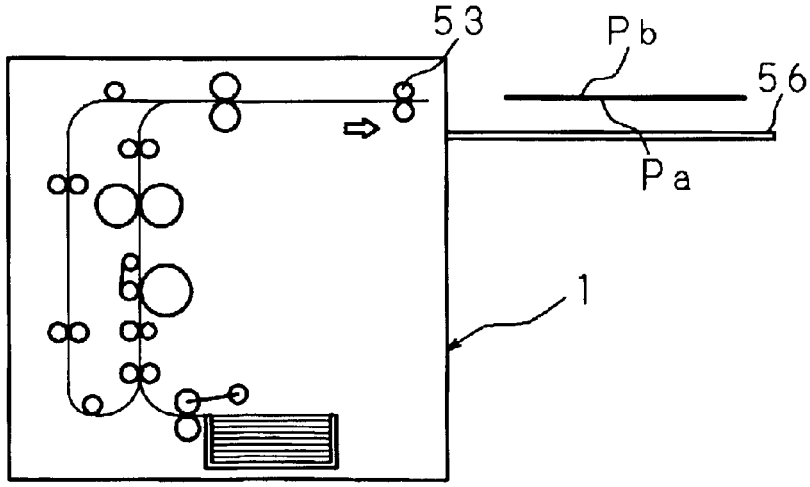

The sheet P which has passed through the fixer 23 is conveyed in the direction shown by an outline arrow by the guide-in/guide-out roller 28 rotating in the forward direction to the transit conveyance unit 18 (referring to FIG. 20A) and reaches the transit conveyance unit 18 with the front side Pa down and the back side Pb up (referring to FIG. 20B). The sheet P is then discharged to the sheet receiving tray 56 by the guide-out roller 53 (referring to FIG. 20C).

In a case where a plurality of sheets P are discharged by the guide-out roller 53, the sheets P are sequentially stacked in the sheet receiving tray 56 with the front side Pa down.

According to the above-described image forming apparatus 1, the single-side printing is performed by the conventional image forming method, and when the double-side printing is performed, idle conveyance is performed and then the image is formed on both sides of the sheet by determining whether the image is to be formed or not on the sheet which has been conveyed to the printer 20 according to the number of reverses. As a result, the image-formed sheets can be discharged in order of the originals.

Furthermore, according to the above image forming apparatus 1, it is not necessary to provide an image memory which can store image data for two sides of the original.

Second Embodiment

Figure 21:
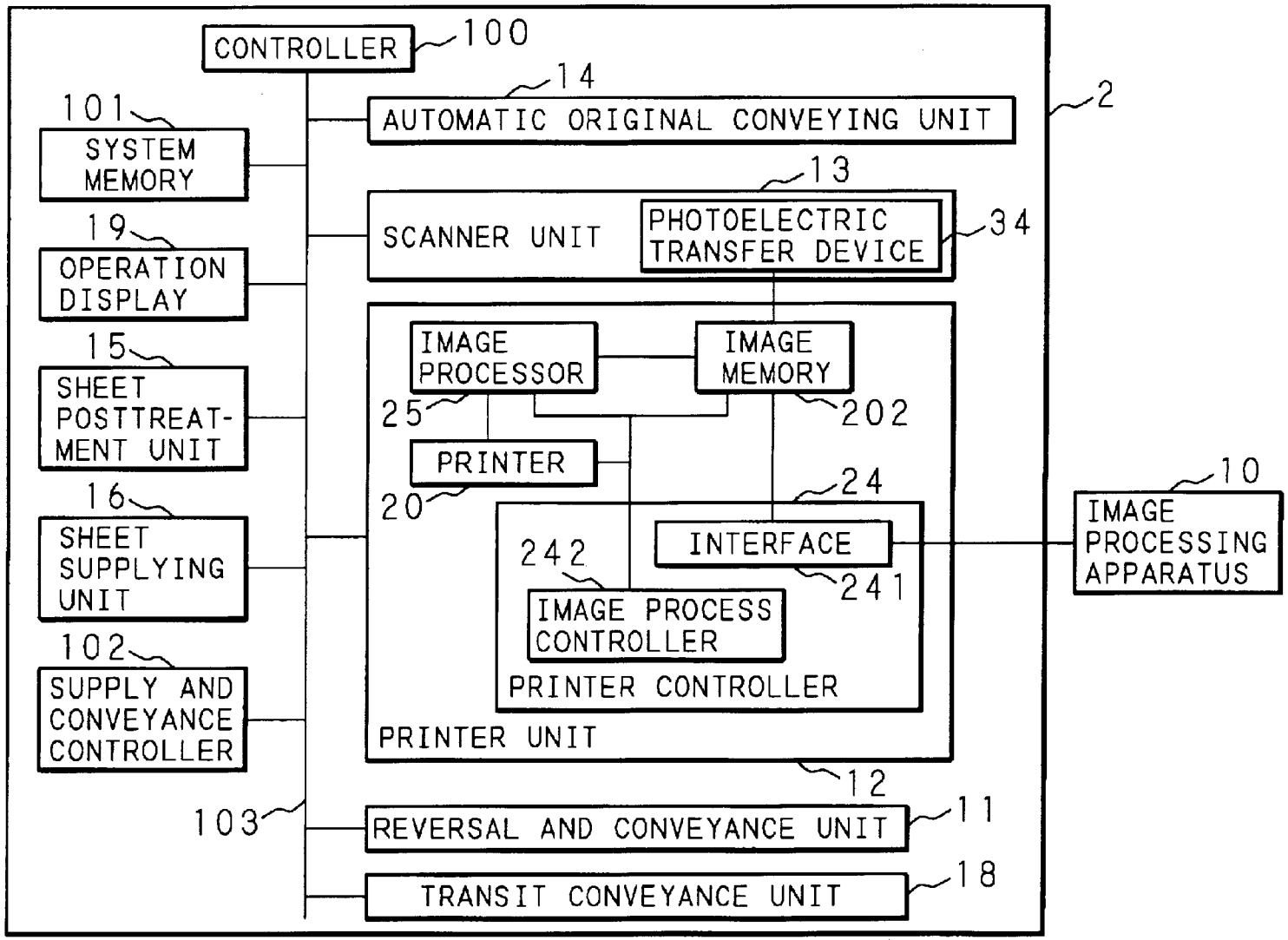
FIG. 21 is a block diagram showing an image forming apparatus according to the second embodiment of the present invention.

FIG. 21 is a block diagram showing an image forming apparatus 2 according to the second embodiment of the present invention. A printer unit 12 comprises an image memory 202 which can store image data for two sides of the original.

The same reference numerals are allotted to the same or corresponding parts as in the first embodiment and description thereof will be omitted.

A controller 100 determines whether the sheet is to be reversed or not and whether idle conveyance is to be performed or not by determining whether a double-side print key 19*a* has been operated or not and whether the first special sheet key 961 or the second special sheet key 963 has been operated or not. If the double-side print key 19*a* has not been operated, the controller 100 does not perform the reversing operation nor idle conveyance (single-side printing is performed). If the double-side print key 19*a* has been operated and neither the first special sheet key 961 nor the second special sheet key 963 has been operated, the controller 100 performs the reversing operation but does not perform the idle conveyance (double-side printing is performed). In addition, if the double-side print key 19*a* has been operated and the first special sheet key 961 or the second special sheet key 963 has been operated, the controller 100 performs the reversing operation and the idle conveyance (idle conveyance and the double-side printing are performed).

Figure 22:
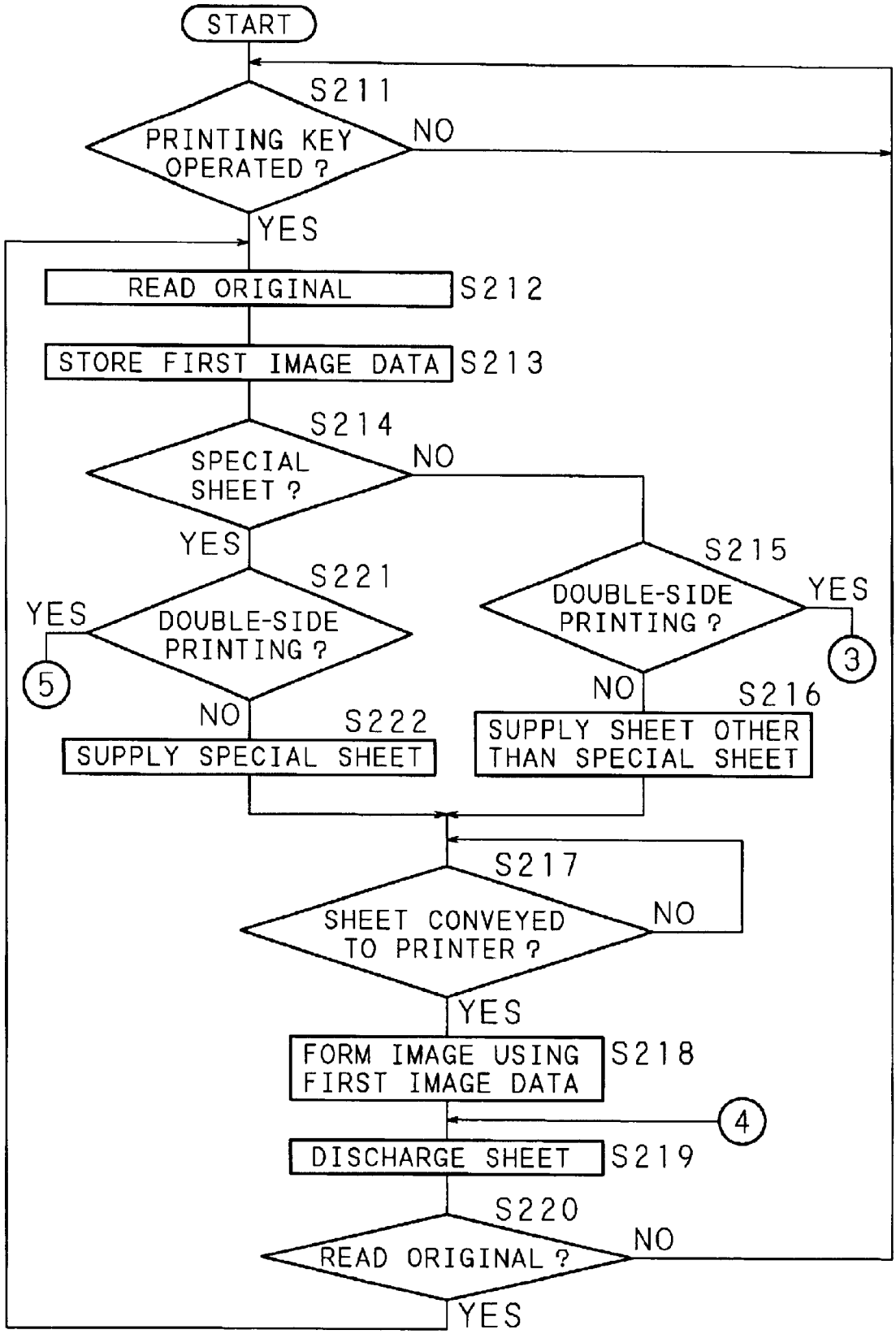
FIGS. 22 through 24 are flowcharts showing processing procedures of image formation and sheet conveyance by the image forming apparatus according to the second embodiment of the present invention.
Figure 23:
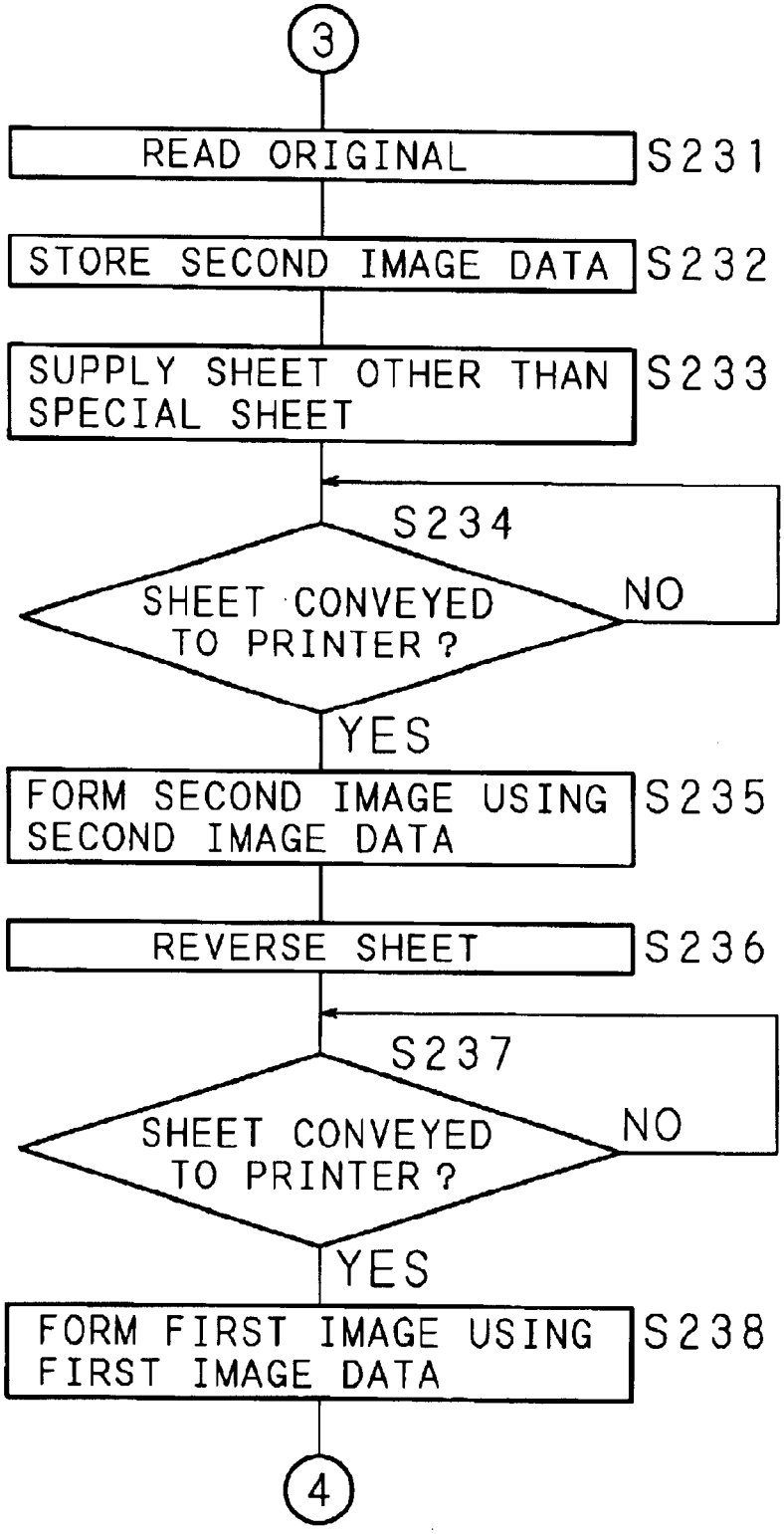
Figure 24:
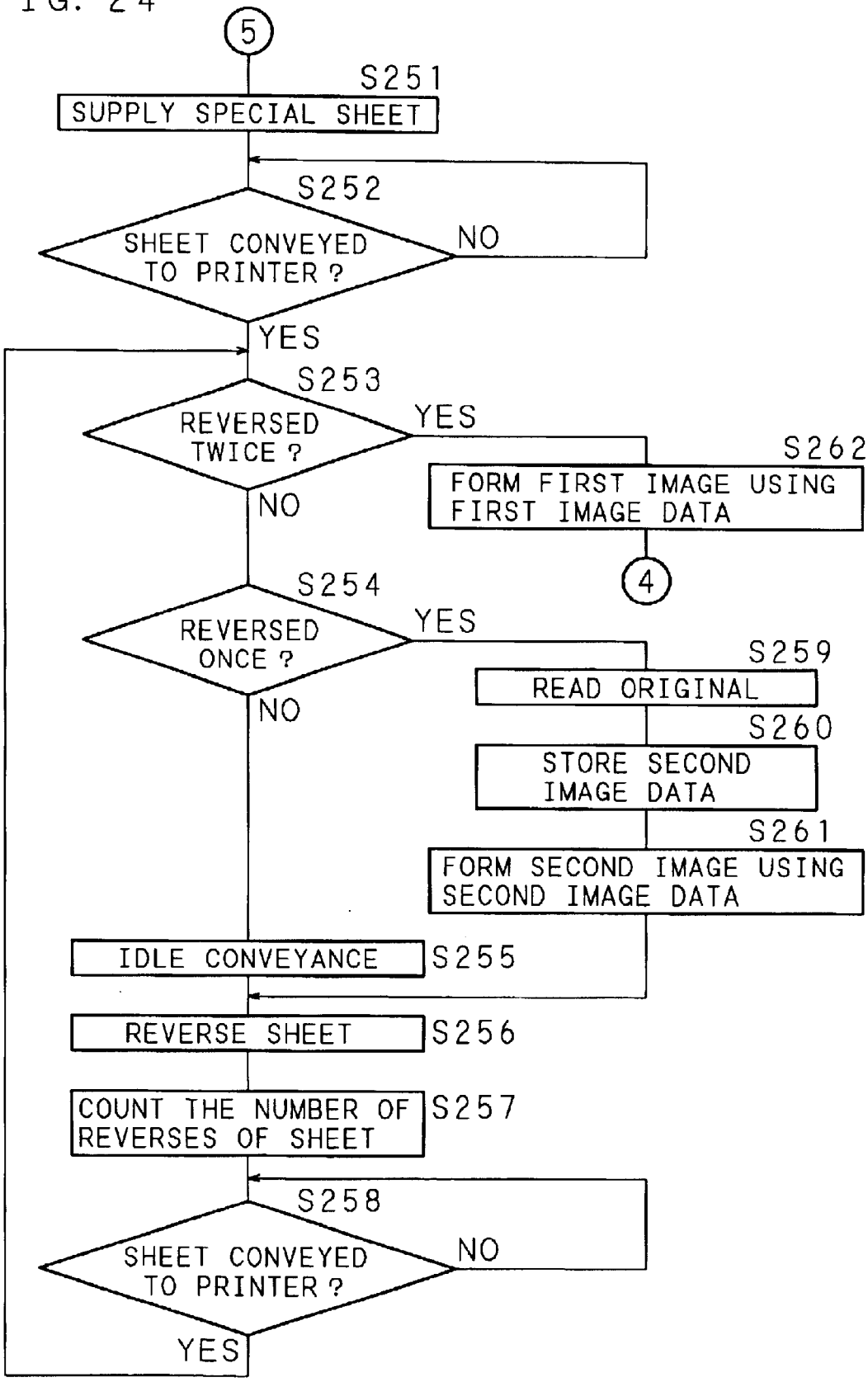

FIGS. 22 through 24 are flowcharts showing processing procedures of image formation and sheet conveyance of the image forming apparatus 2.

The controller 100 determines whether a printing key 193 has been operated or not (step S211). If the printing key 193 has not been operated (NO at step S211), the controller 100 waits until the printing key 193 is operated. If the printing key 193 has been operated (YES at step S211), the controller 100 stars to read the original set in the original retainer 30 or the original retaining tray 40 (step S212), and image data is generated from the read image and stored in the image memory 202 as first image data (step S213).

Then, it is determined whether the first special sheet key 961 or the second special sheet key 963 had been operated or not before the printing key 193 was operated (step S214).

If neither the first special sheet key 961 nor the second special sheet key 963 had been operated (NO at step S214), the controller 100 determines whether the double-side print key 19*a* had been operated or not before the printing key 193 was operated (step S215). If the double-side print key 19*a* had not been operated (NO at step S215), the controller 100 drives the feeder 211 or the feeder 621 to supply one sheet other than the special sheet (i.e., the standard sheet held in the sheet holding tray 210 or the standard sheet held in the sheet holding tray 620) to the printer 20 (step S216) and the single-side printing operation is performed.

The controller 100 then determines whether the sheet has been conveyed to the printer 20 or not (step S217). If the sheet has not been conveyed (NO at step S217), the controller 100 continues to drive the feeder 211 or the feeder 621 until the sheet is conveyed to the printer 20. If the sheet has been conveyed to the printer 20 (YES at step S217), the controller 100 forms an image on the sheet by the printer 20 using the printing conditions stored in the system memory 101 and the first image data stored in the image memory 202 at step S213 (step S218) and the image is fixed onto the sheet by the fixer 23.

The controller 100 then discharges the sheet (step S219). In this case, the controller 100 switches the gates 251 and 81 and rotates the guide-in/guide-out roller 28 in the forward direction to convey the sheet to the transit conveyance unit 18 and then to the sheet posttreatment unit 15. Furthermore, the controller 100 discharges the sheet to the sheet receiving tray 56 (59) by the guide-out roller 53 (57). At this time, the sheet is discharged to the sheet receiving tray 56 (59) with the image-formed side down.

Last of all, the controller 100 determines whether the next original is to be read or not (step S220). If the next original is to be read (YES at step S220), the operation returns to step S212. If the next original is not to be read (NO at step S220), the operation returns to step S211.

If the first special sheet key 961 or the second special sheet key 963 had been operated (YES at step S214), the controller 100 determines whether the double-side print key 19*a* had been operated or not before the printing key 193 was operated (step S221). If the printing key 193 had not been operated (NO at step S221), the controller 100 drives the feeder 611 or the feeder 631 to supply one special sheet (i.e., the special sheet held in the sheet holding tray 610 or the special sheet held in the sheet holding tray 630) to the printer 20 (step S222). The controller 100 then shifts the operation to step S217 and the single-side printing operation is performed in the same manner as that of the sheet other than the special sheet.

If the double-side print key 19*a* had been operated before the printing key 193 was operated for the sheet other than the special sheet (YES at step S215), the controller 100 performs the double-side printing for the sheet other than the special sheet. The controller 100 starts to read the original set in the original retainer 30 or the original retaining tray 40 (step S231), generates image data from the read image and stores the image data in the image memory 202 as second image data so as not to overwrite the first image data (step S232).

The controller 100 then drives the feeder 211 or the feeder 621 to supply one sheet other than the special sheet (i.e., the standard sheet held in the sheet holding tray 210 or the standard sheet held in the sheet holding tray 620) to the printer 20 (step S233).

The controller 100 then determines whether the sheet has been conveyed to the printer 20 or not (step S234). If the sheet has not been conveyed (NO at step S234), the printer 20 continues to drive the feeder 211 or the feeder 621 until the sheet is conveyed to the printer 20. If the sheet has been conveyed to the printer 20 (YES at step 234), the controller 100 forms the second image on the sheet by the printer 20 using the printing conditions stored in the system memory 101 and the second image data stored in the image memory 202 at step S232 (step S235) and the image is fixed onto the sheet by the fixer 23.

The controller 100 then reverses the sheet (step S236). In this case, the controller 100 switches the gates 251 and 81 and rotates the guide-in/guide-out rollers 28 and 83 in the forward direction to convey the sheet to the reversal tray 82 of the transit conveyance unit 18. The controller 100 then switches the gate 251 and rotates the guide-in/guide-out rollers 28 and 83 in the backward direction to draw back the sheet to the printer unit 12, makes the sheet pass through the gate 251 and conveys it to the reversal and conveyance unit 11.

The controller 100 then determines whether the sheet has been conveyed to the printer 20 or not (step S237). If the sheet has not been conveyed (NO at step S237), the controller 100 continues to drive the conveyance rollers 110 of the reversal and conveyance unit 11 until the sheet is conveyed to the printer 20. If the sheet has been conveyed to the printer 20 (YES at step S237), the controller 100 forms first image on the sheet by the printer 20 using the printing conditions stored in the system memory 101 and the first image data stored in the image memory 202 at step S213 (step S238) and the image is fixed onto the sheet by the fixer 23. The controller 100 then shifts the operation to step S219. In this case, the sheet is discharged to the sheet receiving tray 56 (59) with the side, on which the first image is formed corresponding to the image of the original read at step S212, facing down.

If the double-side print key 19*a* had been operated before the printing key 193 was operated for the special sheet (YES at step S221), the controller 100 performs the double-side printing for the special sheet.

The controller 100 drives the feeder 611 or the feeder 631 to supply one special sheet (i.e., the special sheet held in the sheet holding tray 610 or the special sheet held in the sheet holding tray 630) to the printer 20 (step S251).

The controller 100 then determines whether the sheet has been conveyed to the printer 20 or not (step S252). If the sheet has not been conveyed (NO at step S252), the controller 100 continues to drive the feeder 611 or the feeder 631 until the sheet is conveyed. If the sheet has been conveyed to the printer 20 (YES at step S252), the controller 100 determines whether the sheet has been reversed twice or not referring to the system memory 101 to determine whether an image is to be formed on the sheet conveyed to the printer 20 or not (step S253). In this case, if the sheet has not been reversed twice (NO at step S253), the controller 100 determines whether the sheet has been reversed once or not (step S254).

If the sheet has not been reversed (NO at step S254), the controller 100 performs idle conveyance (step S255) and then reverses the sheet (step S256). At this time, the controller 100 counts the number of reverses of the sheet (in this case, once) and stores the number in the system memory 101 (step S257). The controller 100 then determines whether the sheet has been conveyed to the printer 20 or not (step S258). If the sheet has not been conveyed (NO at step S258), the controller 100 continues to drive the conveyance rollers 110 of the reversal and conveyance unit 11 until the sheet is conveyed to the printer 20. If the sheet has been conveyed to the printer 20 (YES at step S258), the controller 100 returns the operation to step S253 and determines whether the sheet has been reversed twice or not. If the sheet has not been reversed twice, it is determined whether the sheet has been reversed once or not at step S254.

If the sheet has been reversed once (YES at step S254), the controller 100 starts to read the original set in the original retainer 30 or the original retaining tray 40 (step S259), generates image data from the read image and stores the image data in the image memory 202 as the second image data so as not to overwrite the first image data (step S260). The controller 100 then forms a second image on the sheet by the printer 20 using the printing conditions stored in the system memory 101 and the second image data stored in the image memory 202 at step S260 (step S261) and fixes the image onto the sheet by the fixer 23. Then, the operation goes to step S256.

The controller 100 reverses the sheet at step S256, counts the number of reverses of the sheet (in this case, twice) and stores the number in the system memory 101 at step S257.

If it is judged at step S258 that the sheet has been conveyed to the printer 20, the controller 100 determines whether the sheet has been reversed twice or not at step S253. If the sheet has been reversed twice (YES at step S253), the controller 100 deletes the data of the number of reverses stored in the system memory 101.

The controller 100 then forms a first image on the sheet by the printer 20 using the printing conditions stored in the system memory 101 and the first image data stored in the image memory 202 at step S213 (step S262) and the image is fixed onto the sheet by the fixer 23. Then, the controller 100 shifts the operation to step S219. In this case, the sheet is discharged to the sheet receiving tray 56 (59) with the side, on which the first image was formed corresponding to the image of the original read at step S212, facing down.

FIGS. 25A through 29C are explanatory drawings showing procedures of image formation and sheet conveyance of the image forming apparatus 2. Hereinafter, description will be made of a case where an image is printed on both sides of a sheet P (a special sheet in this case) stored in the sheet holding tray 610 with the front side Pa up and the back side Pb down. At this time, it is assumed that the stapling process is not performed.

Figure 25A:
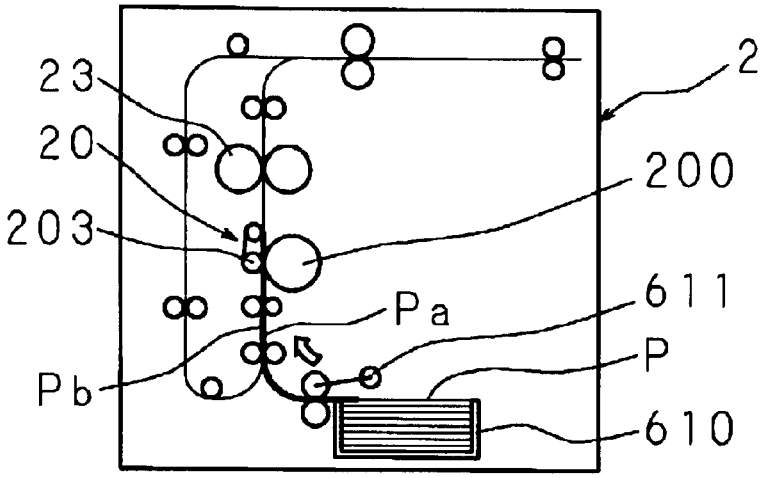
FIGS. 25A through 29C are explanatory views showing procedures of image formation and sheet conveyance by the image forming apparatus according to the second embodiment of the present invention.
Figure 25B:
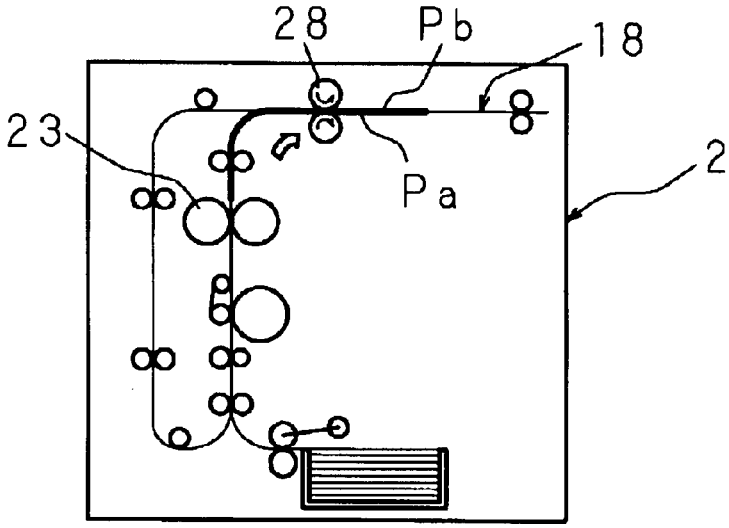

The sheet P which has been supplied to the printer 20 from the sheet holding tray 610 by the feeder 611 is conveyed to a position between the photoconductor 200 and the imprinter 203 in the direction shown by an outline arrow such that the front side Pa is in contact with the photoconductor 200 (referring to FIG. 25A). At this time, an image is not formed.

Figure 25C:
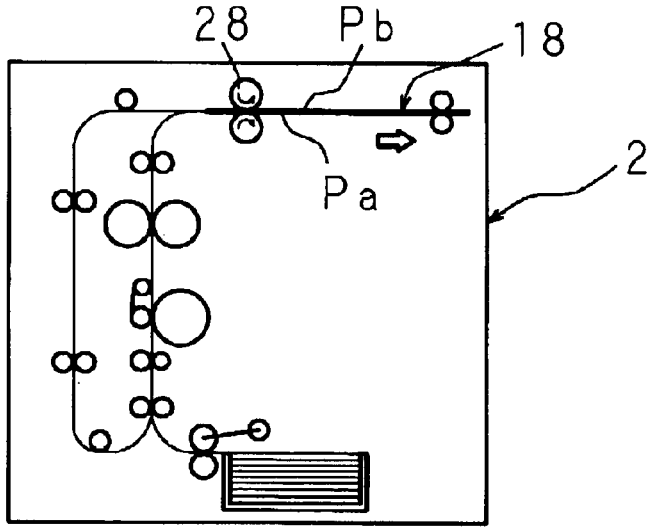
Figure 26A:
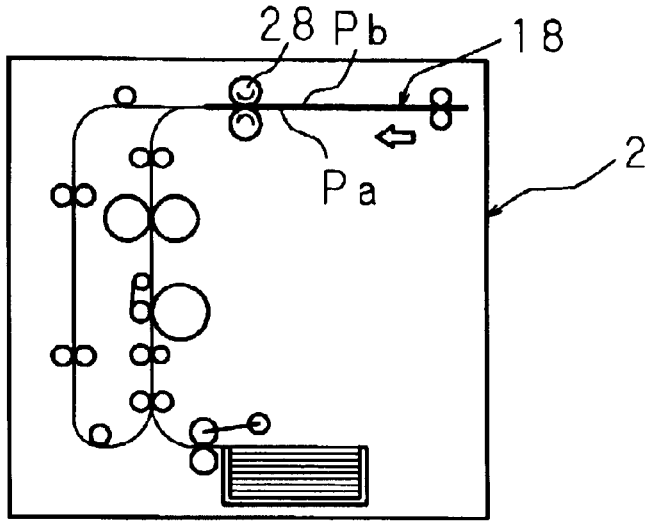
Figure 26B:
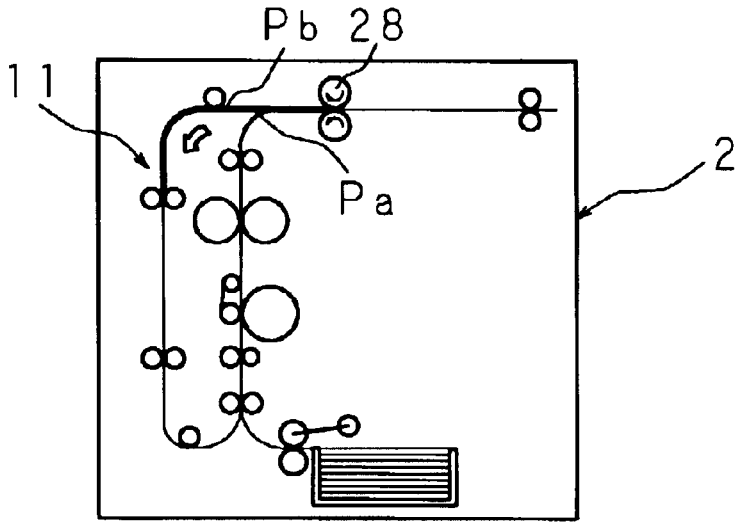
Figure 26C:
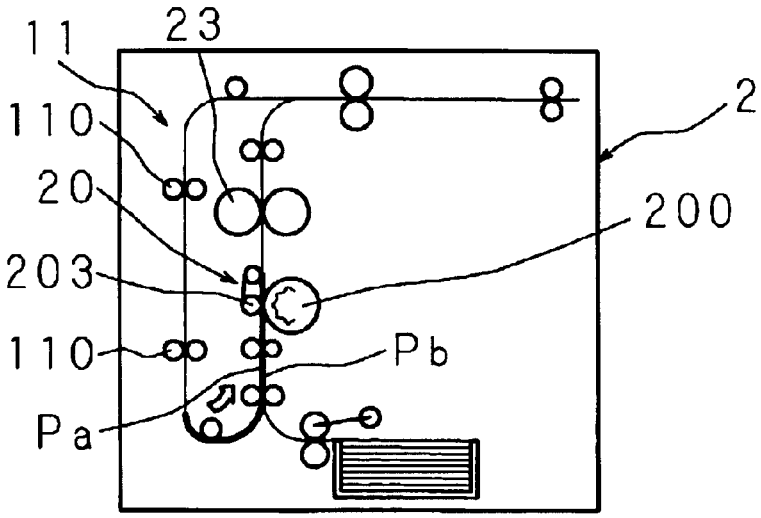

The sheet P which has passed through the fixer 23 is conveyed in the direction shown by an outline arrow by the guide-in/guide-out roller 28 rotating in the forward direction to the transit conveyance unit 18 (referring to FIG. 25B) and reaches the transit conveyance unit 18 with the front side Pa down and the back side Pb up (referring to FIG. 25C). The sheet P is then conveyed in the backward direction (shown by an outline arrow) by the guide-in/guide-out roller 28 rotating in the backward direction (referring to FIG. 26A) to the reversal and conveyance unit 11 (referring to FIG. 26B) and is made to pass through the reversal and conveyance unit 11 by the conveyance rollers 110 of the reversal and conveyance unit 11. The sheet P is then conveyed to a position between the photoconductor 200 and the imprinter 203 of the printer 20 such that the back side Pb is in contact with the photoconductor 200, whereby the second image is formed on the back side Pb (referring to FIG. 26C).

Figure 27A:
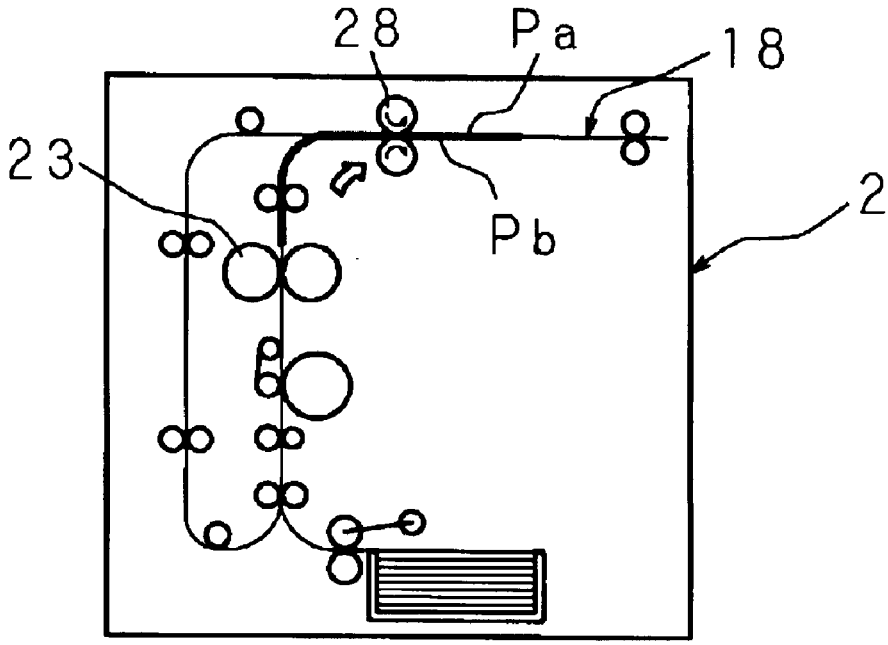
Figure 27B:
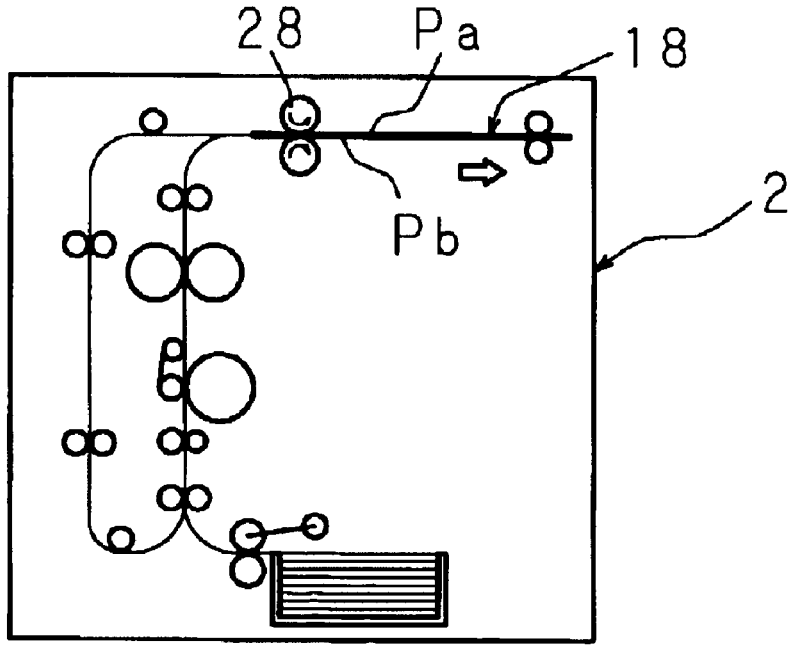
Figure 28A:
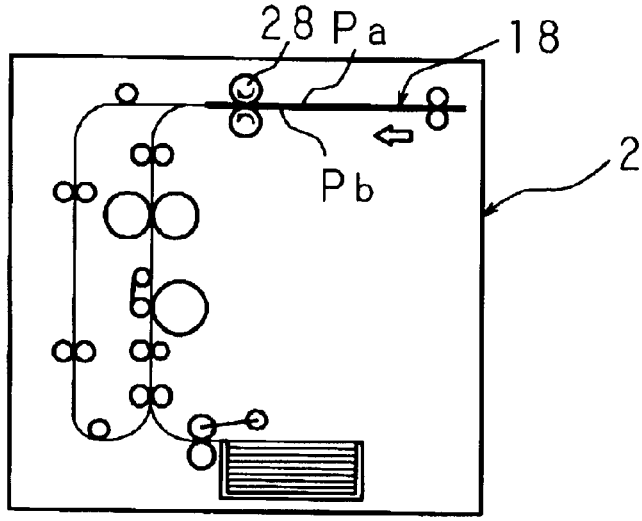
Figure 28B:
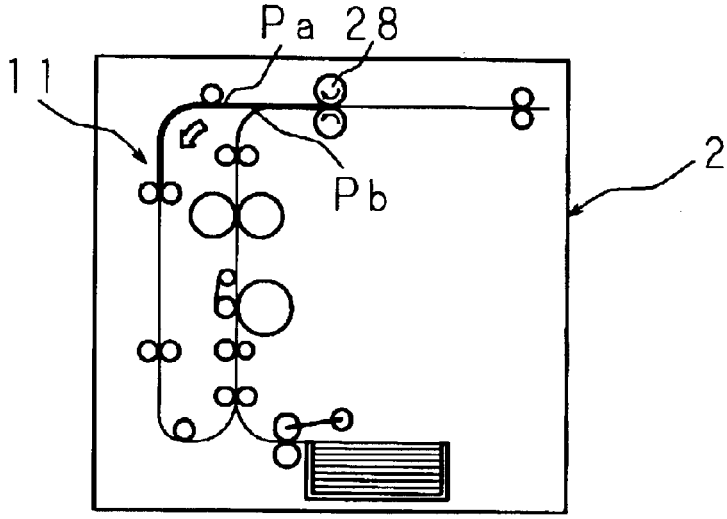
Figure 28C:
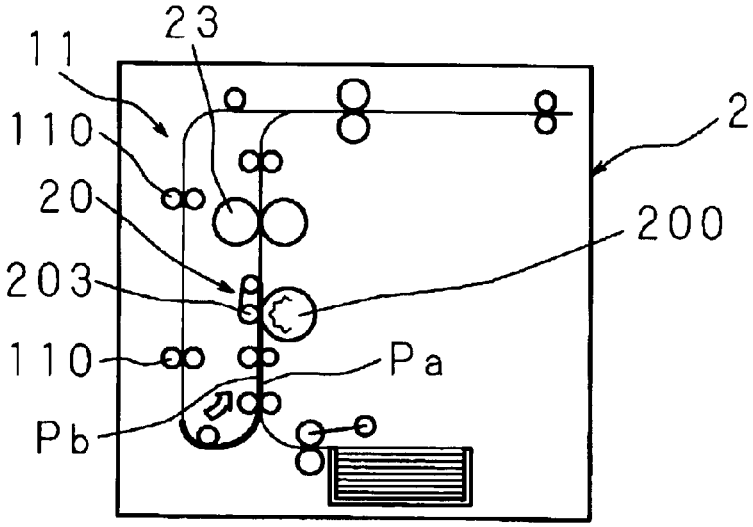

The sheet P on which the second image was fixed onto the back side Pb by the fixer 23 is conveyed in the direction shown by an outline arrow by the guide-in/guide-out roller 28 rotating in the forward direction to the transit conveyance unit 18 (referring to FIG. 27A) and reaches the transit conveyance unit 18 with the back side Pb down and the front side Pa up (referring to FIG. 27B). The sheet P is then conveyed in the backward direction (shown by an outline arrow) by the guide-in/guide-out roller 28 rotating in the backward direction (referring to FIG. 28A) to the reversal and conveyance unit 11 (referring to FIG. 28B) and is made to pass through the reversal and conveyance unit 11 by the conveyance rollers 110 of the reversal and conveyance unit 11. The sheet P is then conveyed to a position between the photoconductor 200 and the imprinter 203 of the printer 20 such that the front side Pa is in contact with the photoconductor 200 and the first image is formed on the front side Pa (referring to FIG. 28C).

Figure 29A:
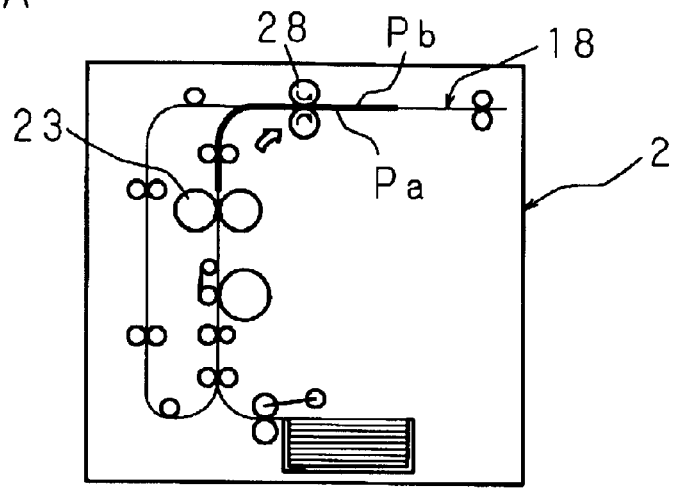
Figure 29B:
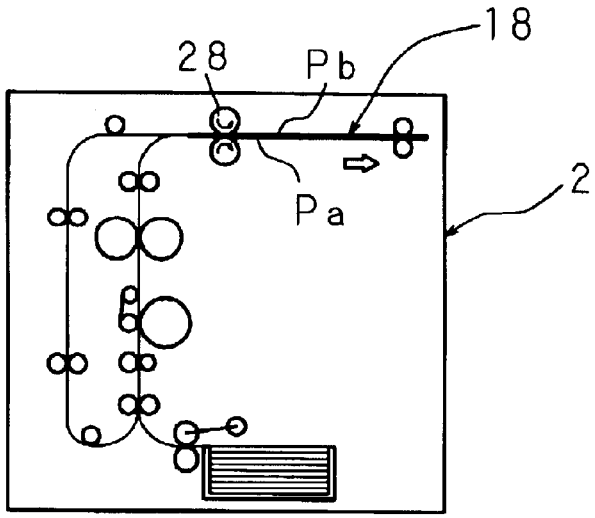
Figure 29C:
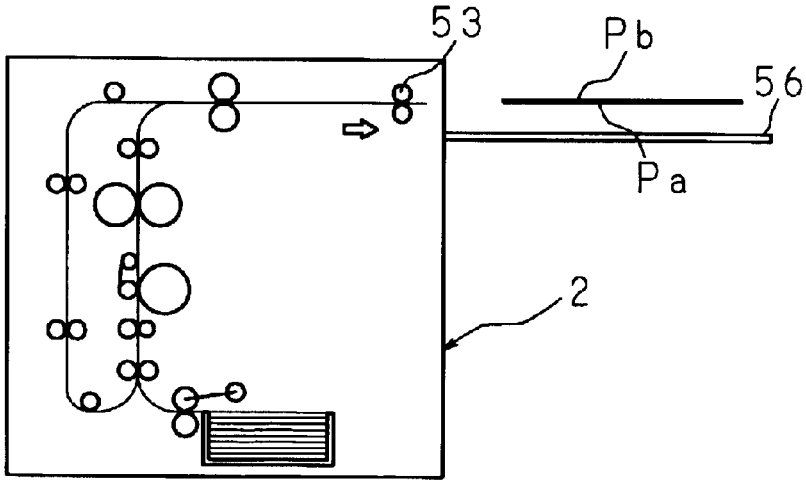

The sheet P on which the first image was fixed onto the front side Pa by the fixer 23 is conveyed in the direction shown by an outline arrow by the guide-in/guide-out roller 28 rotating in the forward direction to the transit conveyance unit 18 (referring to FIG. 29A), reaches the transit conveyance unit 18 with the front side Pa down and the back side Pb up (referring to FIG. 29B) and is discharged to the sheet receiving tray 56 by the guide-out roller 53 (referring to FIG. 29C).

In a case a plurality of sheets P is discharged by the guide-out roller 53, the sheets P are sequentially stacked in the sheet receiving tray 56 with the front side Pa down.

According to the above-described image forming apparatus 2, the single-side printing and the double-side printing for the sheet other than the special sheet are performed by the conventional image forming method, and for performing the double-side printing, idle conveyance is performed and then the image is formed on both sides of the special sheet. As a result, the image-formed sheets can be discharged in order of the originals.

Furthermore, since the idle conveyance is not performed except when the double-side printing is performed for the special sheet, occurrence of a jam during the conveyance can be prevented. In addition, since an image is formed on both side of the special sheet after the idle conveyance, occurrence of a jam during the idle conveyance of the image-formed sheet can be prevented.

Third Embodiment

According to this embodiment, an image forming apparatus 4 (see FIG. 36A) comprises parts corresponding to parts in the image forming apparatus 2 according to the second embodiment. In addition, in a sheet holding tray 610, a special sheet on both sides of which the image can be printed and which has a letterhead on the front side thereof is held with the front side down. Furthermore, in a sheet holding tray 630, a special sheet on both sides of which the image can be printed and which has a punch hole on the left side on the front side is held with the front side down.

Figure 30:
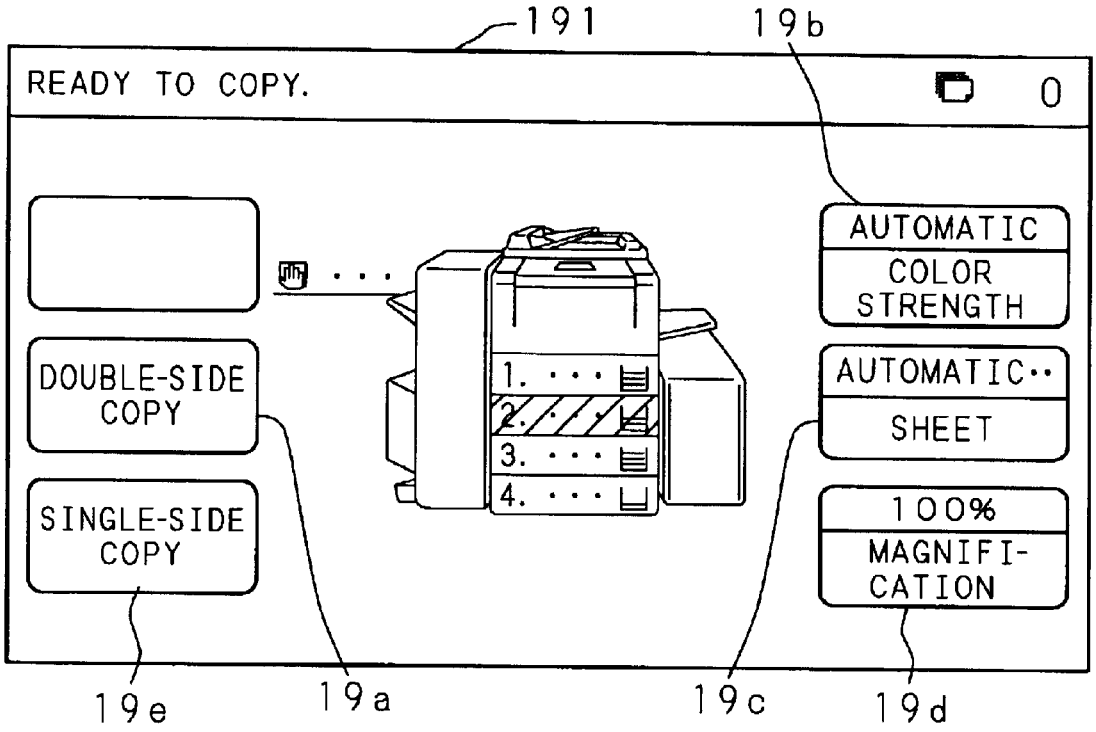
FIG. 30 shows an example of input instructions displayed on the operation display and function keys provided in the operation display constituting the image forming apparatus according to the third embodiment of the present invention.

FIG. 30 shows an example of input instructions displayed on an operation display 19 and function keys provided in the operation display 19 in the image forming apparatus 4, more specifically, shows a basic display screen normally displayed on a display panel 191. The display panel 191 is provided a single-side print key 19*e* to be operated by the user when the single-side printing is performed.

The controller 100 determines whether the sheet is to be reversed or not and whether the idle conveyance is to be performed or not by determining whether the double-side print key 19*a* or the single-side print key 19*e* has been operated or not and whether the first special sheet key 961 or the second special sheet key 963 has been operated or not.

If the single-side input key 19*e* has been operated, or the double-side print key 19*a* has not been operated, and the first special sheet key 961 or the second special sheet key 963 has been operated, the single-side printing including the idle conveyance and the reverse of the sheet is performed. If neither the first special sheet key 961 nor the second special sheet key 963 has been operated, the single-side printing is performed without the idle conveyance and the reverse of the sheet.

If the double-side print key 19*a* has been operated, the double-side printing is performed without the idle conveyance.

The user makes the image forming apparatus 4 form the image in the same procedures as that shown in the flowchart in FIG. 13. In this case, determining to perform the single-side printing at step S102, the user operates the single-side print key 19*e* and the printing key 193 at step S108. Meanwhile, determining to perform the single-side printing at step S102, the user operates the printing key 193 without operating the double-side print key 19*a* and the single-side print key 19*e* at step S108.

The same reference numerals are allotted to the corresponding parts in the first and second embodiments of the present invention and the description thereof will be omitted.

Figure 31:
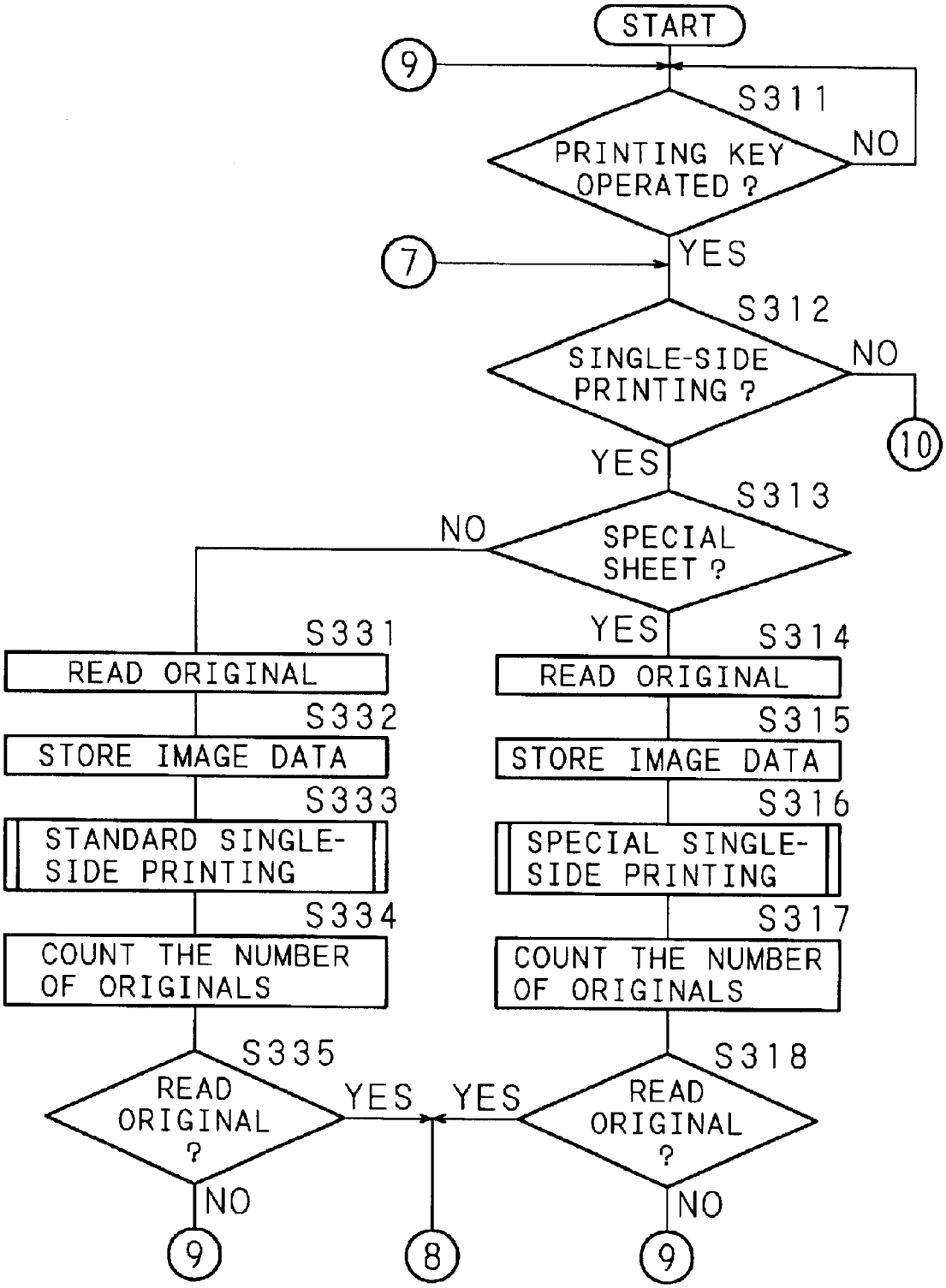
FIGS. 31 and 32 are flowcharts showing processing procedures of image formation and sheet conveyance by the image forming apparatus according to the third embodiment of the present invention.
Figure 32:
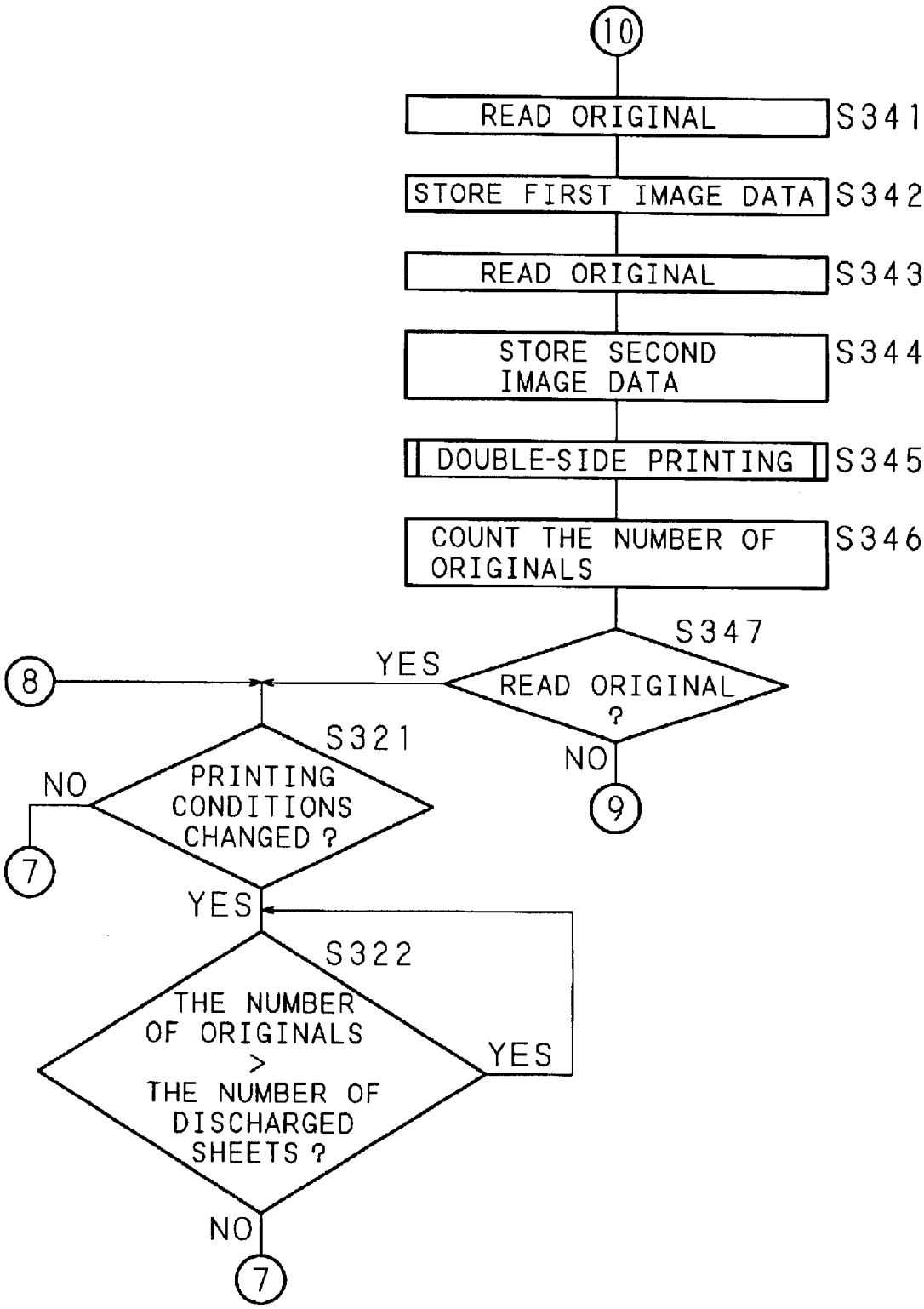
Figure 33:
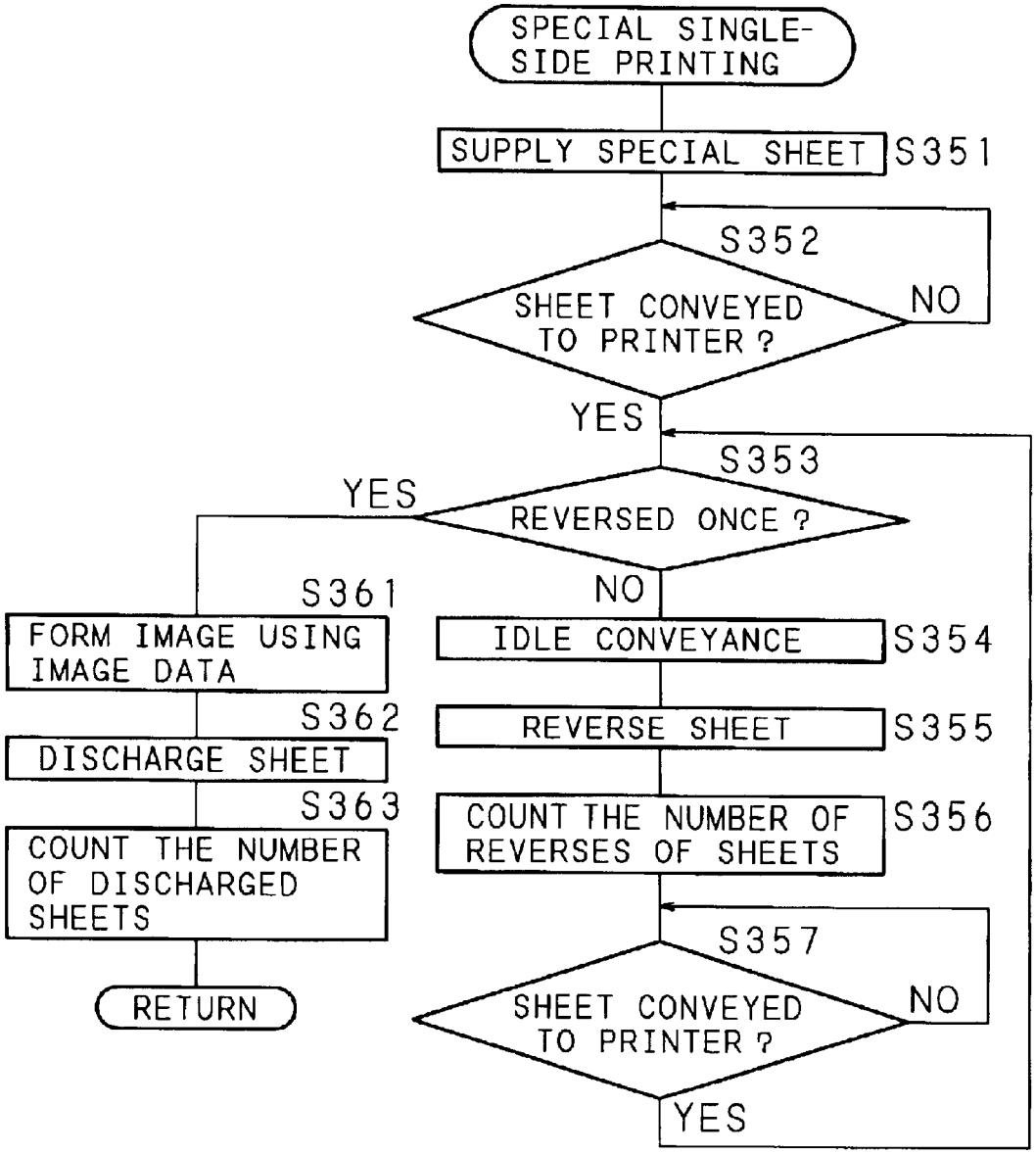
FIGS. 33 through 35 are flowcharts of a subroutine showing processing procedures of image formation and sheet conveyance by the image forming apparatus according to the third embodiment of the present invention.
Figure 34:
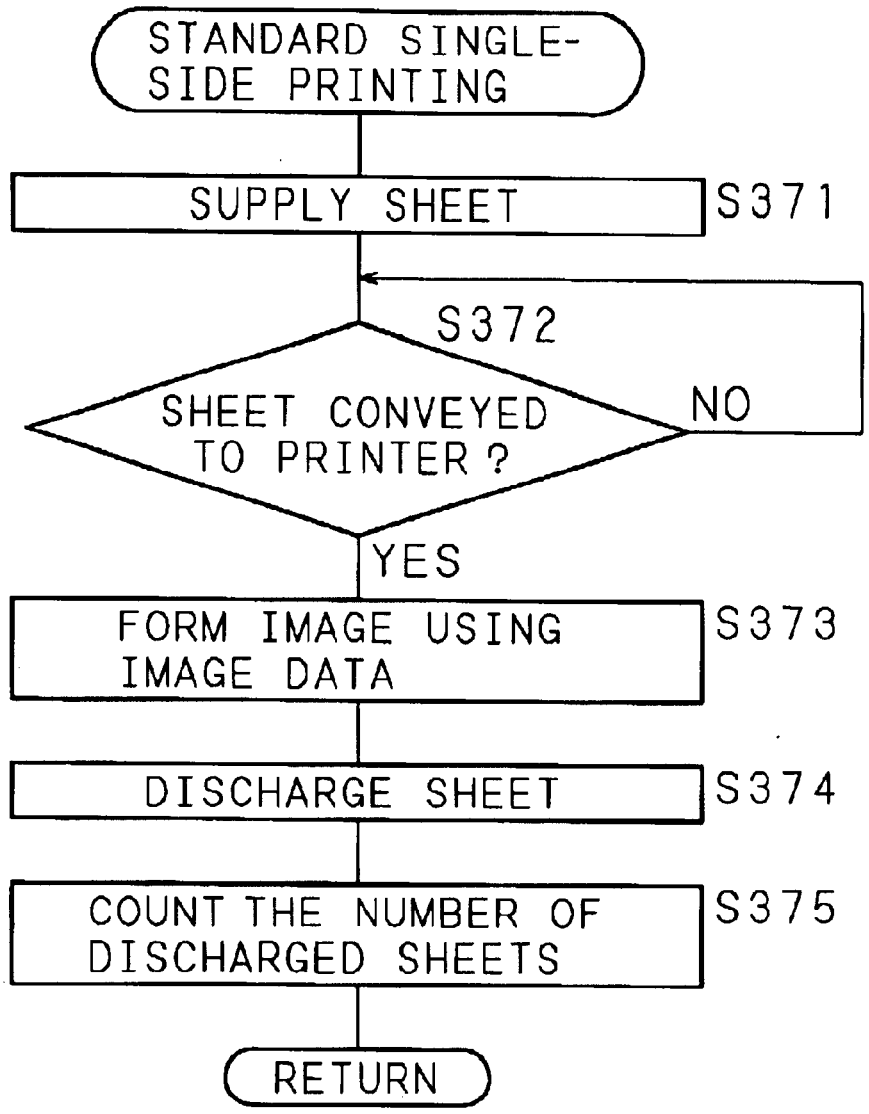
Figure 35:
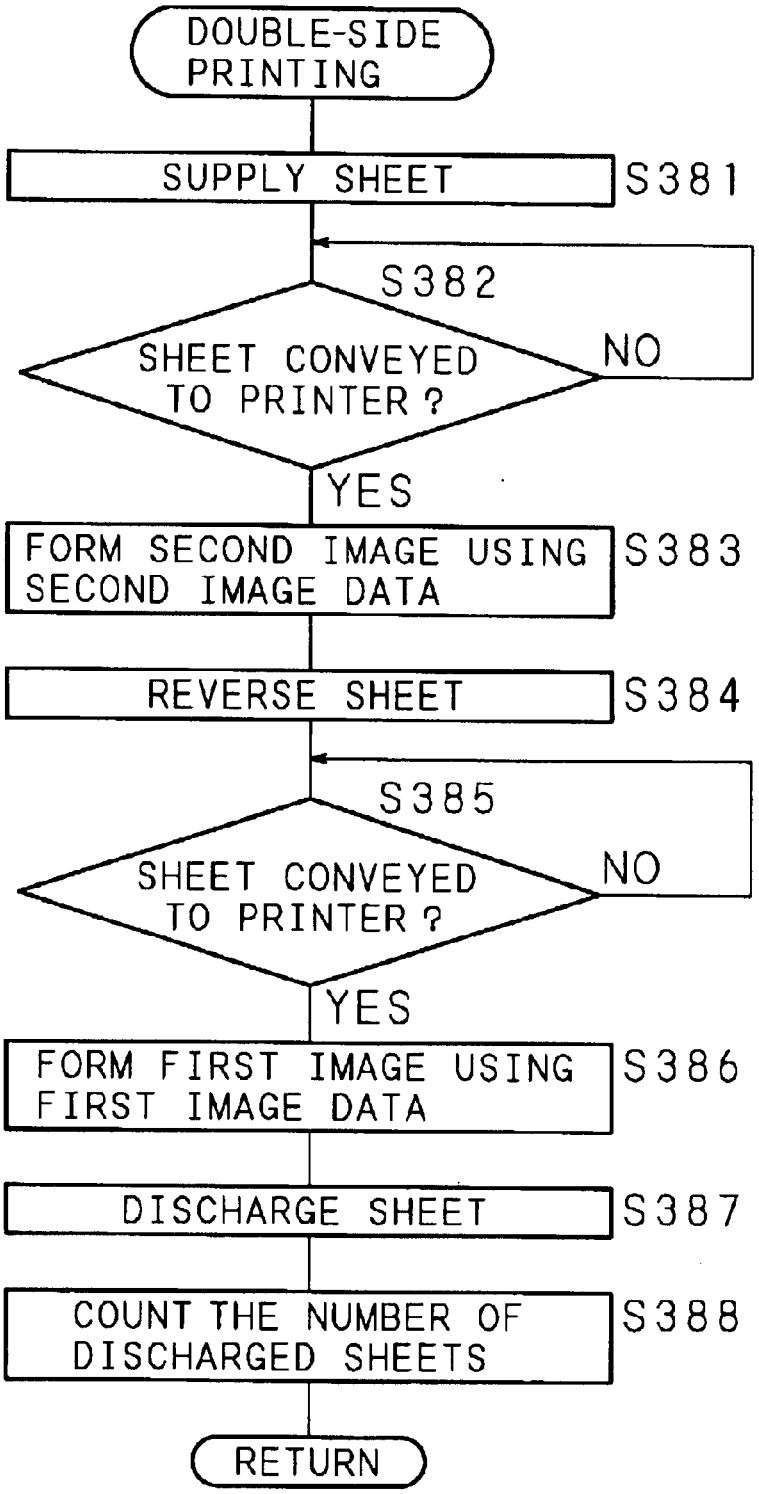

FIGS. 31 and 32 are flowcharts showing processing procedures of image formation and sheet conveyance of the image forming apparatus 4. FIGS. 33 through 35 are flowcharts showing subroutines of the processing procedures.

The controller 100 determines whether the printing key 193 has been operated or not (step S311). If the printing key 193 has not been operated (NO at step S311), the controller 100 waits until the printing key 193 is operated. If the printing key 193 has been operated (YES at step S 311), the controller 100 determines whether the single-side printing is to be performed or not by determining whether the single-side print key 19*e* had been operated or not and whether the double-side print key 19*a* had been operated or not before the printing key 193 was operated (step S312).

If the single-side print key 19*e* had been operated, or if the double-side print key 19*a* had not been operated, the controller 100 determines to perform the single-side printing (YES at step S312) and then determines whether the first special sheet key 961 or the second special sheet key 963 had been operated or not before the printing key 193 was operated (step S313).

If the first special sheet key 961 or the second special sheet key 963 had been operated, the controller 100 determines to form an image on the special sheet (YES at step S313), starts to read the original set in the original retainer 30 or the original retaining tray 40 (step S314) to generate image data from the read image and stores the image data in the image memory 202 (step S315). The controller 100 then starts a subroutine (see FIG. 33) of special single-side printing (step S316).

Regardless of whether the subroutine is under execution or has been completed, the controller 100 counts the number of originals read and stores the number in the system memory 101 as data of the number of originals (step S317). In other words, the data of the number of originals is increased by one at each operation of step S317.

The controller 100 then determines whether the next original is to be read or not (step S318). If the next original is not to be read (NO at step S318), the operation returns to step S311.

If the next original is to be read (YES at step S318), the controller 100 determines whether the printing conditions have been changed or not (step S321). In this case, it is determined whether the single-side printing for the special sheet is changed to the single-side printing for the sheet other than the special sheet, or the double-side printing, or not.

If the printing conditions have not been changed (NO at step S321), the controller 100 returns the operation to step S312.

If the printing conditions have been changed (YES at step S321), the controller 100 compares the data of the number of originals counted at step S317, or step S334 or step S346 to be described later (see FIG. 32) with data of the number of discharged sheets counted at step S363, S375 or S388 to be described later (see FIG. 33, FIG. 34 or FIG. 35), referring to the system memory 101 to determine whether the number of discharged sheets is less than the number of originals or not (step S322). In other words, the controller 100 determines whether all of the sheets corresponding to the read originals (in case of the double-side printing, a half of the number of the read originals) have been discharged or not.

If the number of discharged sheets is less than the number of originals (YES at step S322), the controller 100 determines that all of the sheets corresponding to the read originals are not discharged, i.e., that the image forming operation has not been finished, and waits until the image forming operation is completed.

If the number of discharged sheets is equal to the number of originals (NO at step S322), the controller 100 determines that all of the sheets corresponding to the read originals have been discharged, i.e., that the image forming operation has been finished, and returns the operation to step S312. At this time, the controller 100 deletes the data of the number of originals and the number of discharged sheets stored in the system memory 101.

If neither the first special sheet key 961 nor the second special sheet key 963 had been operated before the printing key 193 was operated, the controller 100 determines that an image is to be formed on the sheet (standard sheet) other than the special sheet (NO at step S313) and returns the operation to step S331. The controller 100 then starts to read the original set in the original retainer 30 or the original retaining tray 40 (step S331) to generate image data from the read image and stores the image data in the image memory 202 (step S332). The controller 100 then starts a subroutine (see FIG. 34) of standard single-side printing (step S333).

Regardless of whether the subroutine is under execution or has been completed, the controller 100 counts the number of originals read and stores the number in the system memory 101 as data of the number of originals (step S334). In other words, the data of the number of originals is increased by one at each operation of step S334.

The controller 100 then determines whether the next original is to be read or not (step S335). If next original is not to be read (NO at step S335), the operation returns to step S311.

If the next original is to be read (YES at step S335), the controller 100 shifts the operation to step S321 and determines whether the printing conditions have been changed or not. In this case, the controller 100 determines whether the single-side printing for the sheet other than the special sheet is changed to the single-side printing for the special sheet, or the double-side printing, or not.

If the double-side print key 19*a* had been operated before the printing key 193 was operated, the controller 100 determines that the double-side printing is to be performed (NO at step S312) and starts to read the original set in the original retainer 30 or the original retaining tray 40 (step S341) to generate image data from the read image and stores the image data in the image memory 202 as first image data (step S342). Furthermore, the controller 100 starts to read the original set in the original retainer 30 or the original retaining tray 40 (step S343) to generate image data from the read image and stores the image data in the image memory 202 as the second image data so as not to overwrite the first image data (step S344).

The controller 100 then starts a subroutine (see FIG. 35) of the double-side printing (step S345).

Regardless of whether the subroutine is under execution or has been completed, the controller 100 counts half of the number of originals read (step 346) and stores the number in the system memory 101 as data of the number of originals. In other words, the data of the number of originals is increased by one at each operation of step S346.

The controller 100 then determines whether the next original is to be read or not (step S347). If the next original is not to be read (NO at step S347), the operation returns to step S311.

If the next original is to be read (YES at step S347), the controller 100 shifts the operation to step S321 and determines whether the printing conditions have been changed or not. In this case, the controller 100 determines whether the double-side printing is changed to the single-side printing for the special sheet, or the single-side printing for the sheet other than the special sheet, or not.

In the subroutine of the special single-side printing (in FIG. 33), the controller 100 drives the feeder 611 or the feeder 631 to supply one special sheet (i.e., the special sheet held in the sheet holding tray 610 or the special sheet held in the sheet holding tray 630) to the printer 20 (step S351).

The controller 100 then determines whether the sheet has been conveyed to the printer 20 or not (step S352). When the sheet has not been conveyed (NO at step S352), the controller 100 continues to drive the feeder 611 or the feeder 631 until the sheet is conveyed. If the sheet has been conveyed (YES at step S352), the controller 100 determines whether the sheet has been reversed once or not referring to the system memory 101 to determine whether an image is to be formed or not on the sheet conveyed to the printer 20 (step S353).

If the sheet has not been reversed (NO at step S353), the controller 100 performs the idle conveyance (step S354) and then reverses the sheet (step S355). At this time, the controller 100 counts the number of reverses of the sheet (in this case, once) (step S356) and stores the number in the system memory 101. The controller 100 then determines whether the sheet has been conveyed to the printer 20 or not (step S357). If the sheet has not been conveyed (NO at step S357), the controller 100 continues to drive the conveyance rollers 110 of the reversal and conveyance unit 11 until the sheet is conveyed to the printer 20. If the sheet has been conveyed to the printer 20 (YES at step S357), the controller 100 returns the operation to step S353 and determines whether the sheet has been reversed once or not.

If the sheet has been reversed once (YES at step S353), the controller 100 deletes the data of the number of reverses stored in the system memory 101.

The controller 100 then forms an image on the sheet by the printer 20 using the printing conditions stored in the system memory 101 and the image data stored in the image memory 202 at step S314 (step S361) and then the image is fixed onto the sheet by the fixer 23.

The controller 100 discharges the sheet (step S362). In this case, the sheet is discharged to the sheet receiving tray 56 (59) with the image-formed side down.

Last of all, the controller 100 counts the number of discharged sheets (step S363) and stores the number in the system memory 101 as data of the number of discharged sheets. In other words, the data of the discharged sheets is increased by one at each operation of step S363.

When the process at step S363 is finished, the controller 100 finishes the subroutine for the special single-side printing.

In the subroutine of the standard single-side printing (in FIG. 34), the controller 100 drives the feeder 211 or the feeder 621 to supply one sheet other than the special sheet (i.e., the standard sheet held in the sheet holding tray 210 or the standard sheet held in the sheet holding tray 620) to the printer 20 (step S371).

The controller 100 then determines whether the sheet has been conveyed to the printer 20 or not (step S372). If the sheet has not been conveyed (NO at step S372), the controller 100 continues to drive the feeder 211 or the feeder 621 until the sheet is conveyed to the printer 20. If the sheet has been conveyed to the printer 20 (YES at step S372), the controller 100 forms an image on the sheet by the printer 20 using the printing conditions stored in the system memory 101 and the image data stored in the image memory 202 at step S332 (step S373) and then the image is fixed onto the sheet by the fixer 23.

The controller 100 then discharges the sheet (step S374). In this case, the sheet is discharged to the sheet receiving tray 56 (59) with the image-formed side down.

Last of all, the controller 100 counts the number of discharged sheets (step S375) and stores the number in the system memory 101 as data of the number of discharged sheets. In other words, the data of the discharged sheets is increased by one at each operation of step S375.

When the process at step S375 is finished, the controller 100 finishes the subroutine for the standard single-side printing.

In the subroutine of the double-side printing (in FIG. 35), if the first special sheet key 961 or second special sheet key 963 had been operated before the printing key 193 was operated, the controller 100 drives the feeder 611 or the feeder 631 to supply one special sheet to the printer 20. Meanwhile, if neither the first special sheet key 961 nor the second special sheet key 963 had been operated before the printing key 193 was operated, the controller 100 drives the feeder 211 or the feeder 621 to supply one sheet other than special sheet to the printer 20 (step S381).

The controller 100 then determines whether the sheet has been conveyed to the printer 20 or not (step S382). If the sheet has not been conveyed (NO at step S382), the controller 100 continues to drive the feeder 211 or the feeder 621 until the sheet is conveyed to the printer 20. If the sheet has been conveyed to the printer 20 (YES at step S382), the controller 100 forms a second image on the sheet by the printer 20 using the printing conditions stored in the system memory 101 and the second image data stored in the image memory 202 at step S344 (step S383) and then the image is fixed onto the sheet by the fixer 23.

The controller 100 then reverses the sheet (step S384) and determines whether the sheet has been conveyed to the printer 20 or not (step S385). If the sheet has not been conveyed (NO at step S385), the controller 100 continues to drive the conveyance rollers 110 of the reversal and conveyance unit 11 until the sheet is conveyed to the printer 20. If the sheet has been conveyed to the printer 20 (YES at step S385), the controller 100 forms a first image on the sheet by the printer 20 using the printing conditions stored in the system memory 101 and the first image data stored in the image memory 202 at step S342 (step S386) and then the image is fixed onto the sheet by the fixer 23.

The controller 100 then discharges the sheet (step S387). In this case, the sheet is discharged to the sheet receiving tray 56 (59) with the side, on which the first image was formed corresponding to the original image read at step S341, facing down.

Last of all, the controller 100 counts the number of discharged sheets (step S388) and stores the number in the system memory 101 as data of the number of discharged sheets. In other words, the data of the number of discharged sheets is increased by one at each operation of step S388.

When the process at step S388 is completed, the controller 100 finishes the subroutine of the double-side printing.

FIGS. 36A through 38C are explanatory diagrams showing the procedures of the image formation and sheet conveyance of the image forming apparatus 4. Hereinafter, description will be made of a case where an image is printed on a single side of a sheet P (a special sheet in this case) stored in the sheet holding tray 610 with a front side Pa down and a back side Pb up. At this time, it is assumed that the stapling process is not performed.

Figure 36A:
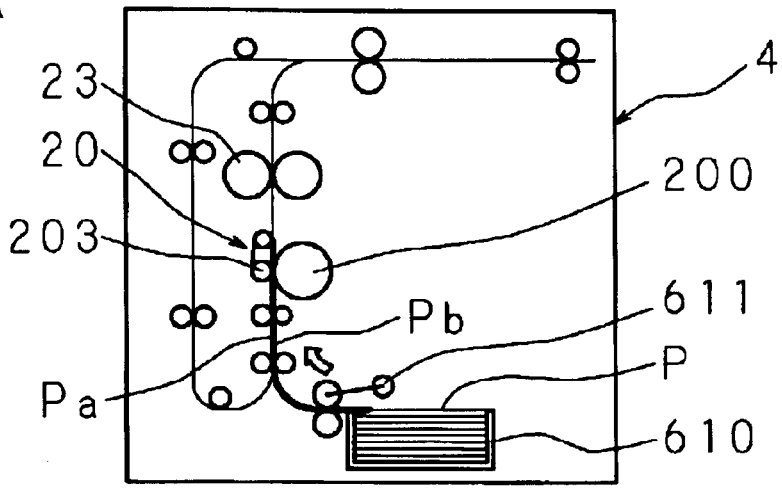
FIGS. 36A through 38C are explanatory views showing procedures of image formation and sheet conveyance by the image forming apparatus according to the third embodiment of the present invention.
Figure 36B:
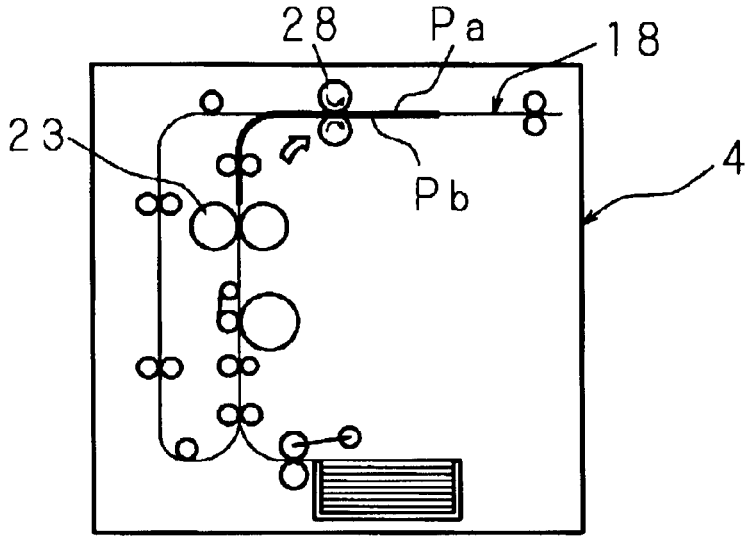

The sheet P which has been supplied to the printer 20 from the sheet holding tray 610 by the feeder 611 is conveyed to a position between the photoconductor 200 and the imprinter 203 in the direction shown by an outline arrow such that the back side Pb is in contact with the photoconductor 200 (referring to FIG. 36A). At this time, an image is not formed.

Figure 36C:
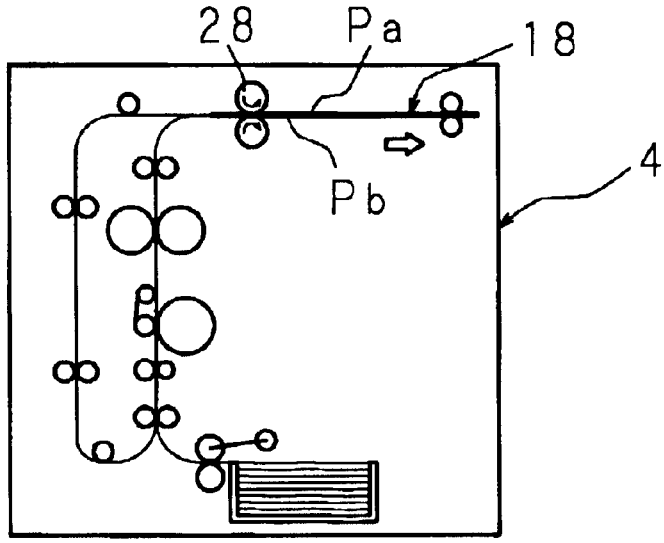
Figure 37A:
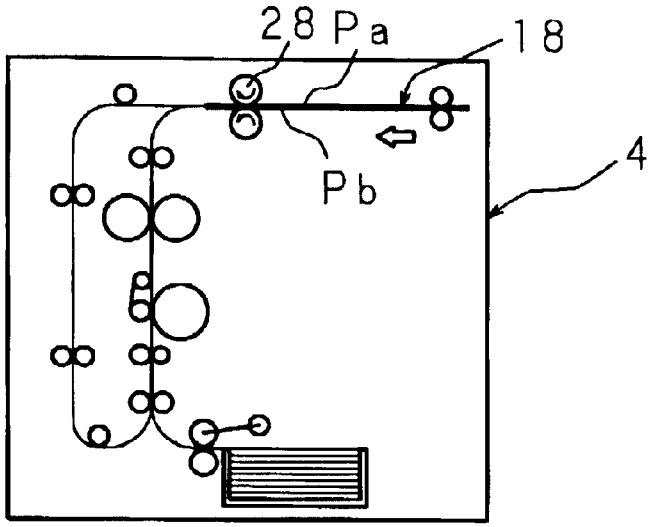
Figure 37B:
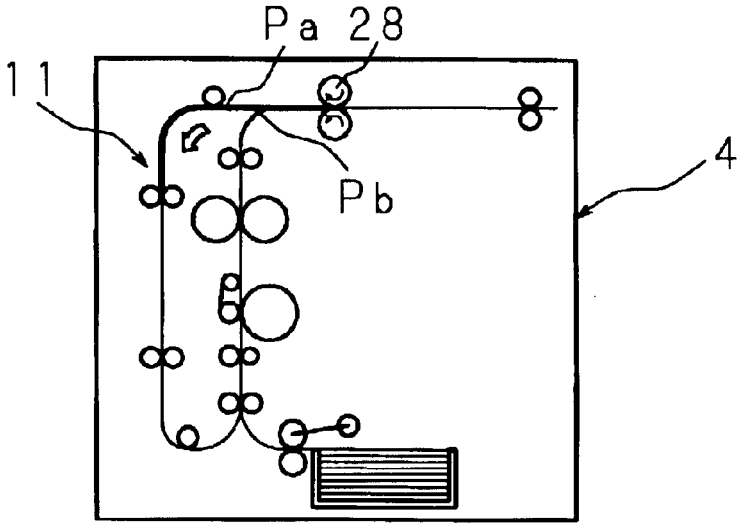
Figure 37C:
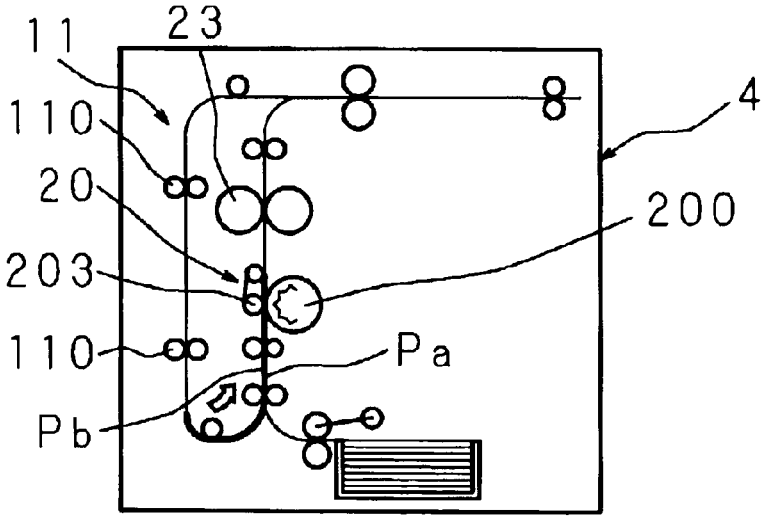

The sheet P which has passed through the fixer 23 is conveyed in the direction shown by an outline arrow by the guide-in/guide-out roller 28 rotating in the forward direction to the transit conveyance unit 18 (referring to FIG. 36B) and reaches the transit conveyance unit 18 with the back side Pb down and the front side Pa up (referring to FIG. 36C). The sheet P is then conveyed in the backward direction (shown by an outline arrow) by the guide-in/guide-out roller 28 rotating in the backward direction (referring to FIG. 37A) to the reversal and conveyance unit 11 (referring to FIG. 37B) and is made to pass through the reversal and conveyance unit 11 by the conveyance rollers 110 of the reversal and conveyance unit 11. The sheet P is then conveyed to a position between the photoconductor 200 and the imprinter 203 of the printer 20 such that the front side Pa is in contact with the photoconductor 200, whereby the image is formed on the front side Pa (referring to FIG. 37C).

Figure 38A:
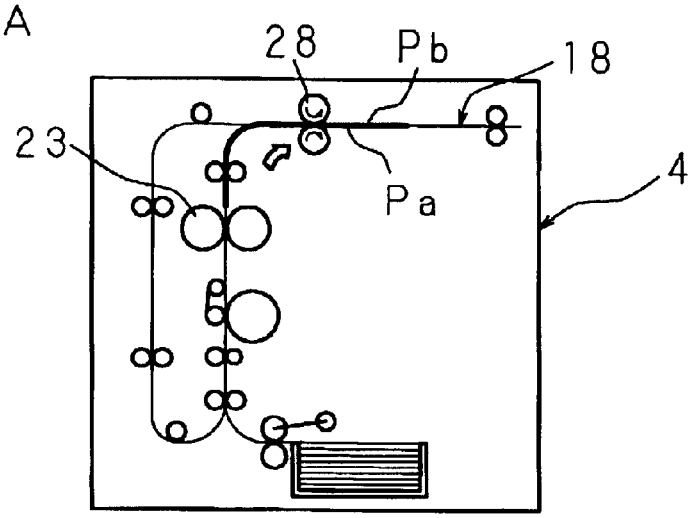
Figure 38B:
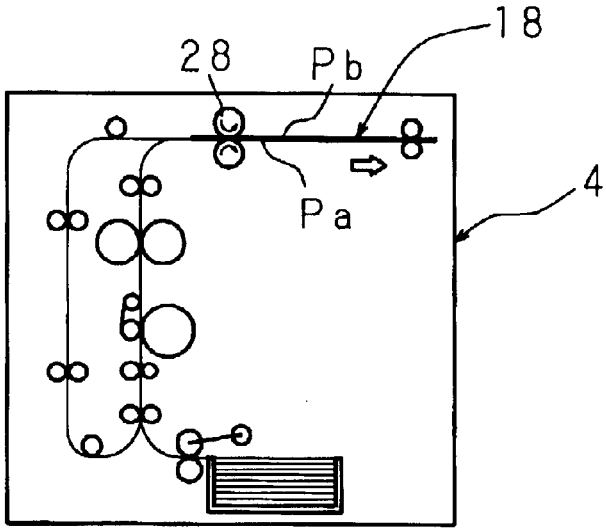
Figure 38C:
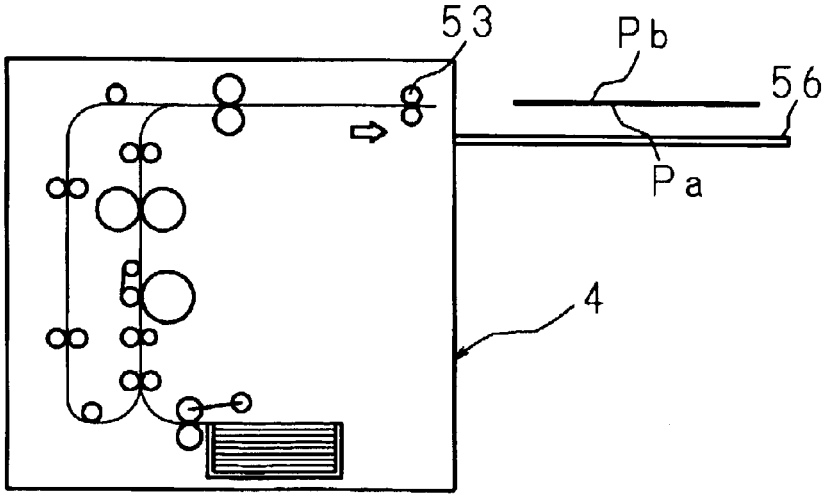

The sheet P having the front side Pa on which the image was fixed by the fixer 23 is conveyed in the direction shown by an outline arrow by the guide-in/guide-out roller 28 rotating in the forward direction to the transit conveyance unit 18 (referring to FIG. 38A) and reaches the transit conveyance unit 18 with the front side Pa down and the back side Pb up (referring to FIG. 38B). The sheet P is then discharged to the sheet receiving tray 56 by the guide-out roller 53 (referring to FIG. 38C).

In a case where a plurality of sheets P is discharged by the guide-out roller 53, the sheets P are sequentially stacked in the sheet receiving tray 56 with the front side Pa down.

According to the above-described image forming apparatus 4, the double-side printing and the single-side printing for the sheet other than the special sheet are performed by the conventional image forming method, and for performing the single-side printing for the special sheet, idle conveyance is performed and then the image is formed on both sides of the special sheet. As a result, the image-formed sheets can be discharged in order of the originals.

Furthermore, according to the image forming apparatus 4 as described above, since the idle conveyance is not performed except when the single-side printing for the special sheet is performed, occurrence of a jam or deterioration of the sheet during the conveyance can be prevented. In addition, since the image is formed on single side of the special sheet after the idle conveyance, occurrence of a jam during the idle conveyance of the image-formed sheet can be prevented.

Furthermore, if the double-side printing or the single-side printing is performed for the sheet other than the special sheet sequentially after the double-side printing for the special sheet or the single-side printing for the special sheet is performed by a front page insertion printing, an inserting paper printing or the like, since the sheet is not reversed and a conveyance distance is short in the single-side printing, for example, the single-side printing for the sheet other than the special sheet is started after the previously started double-side printing or the single-side printing for the special sheet is completed and all of the sheets on which the single-side printing is to be performed are discharged. Therefore, while the sheet to be discharged in advance on which the double-side printing to be performed or the special sheet on which the single-side printing is to be performed is reversed by the idle conveyance or the like, the next sheet for the single-printing is supplied and the sheet on which the single printing is to be performed after the special sheet is prevented from being discharged in advance even when the single-side printing was performed. Consequently, the sheets can be discharged in order of the originals.

Furthermore, if there are mixed originals because of the front page insertion printing, the inserting paper printing or the like in the first and second embodiments of the present invention also, the single-side printing for the sheet other than the special sheet may be started after the single-side printing for the special sheet is completed and the special sheets are all discharged. In this case, the sheet can be prevented from being discharged before the special sheet is discharged, and the sheets can be discharged in order of the originals.

Fourth Embodiment

According to this embodiment of the present invention, an image forming apparatus comprises parts corresponding to the parts in the image forming apparatus 4 according to the third embodiment of the present invention. A special sheet having a letterhead on a front side, on both sides of which image can be printed, is held in a sheet holding tray 610 with the front side down. A special sheet having a punch hole on the left side on a front side, on both sides of which image can be printed, is held in a sheet holding tray 630 with the front side down.

If a single-side print key 19*e* has been operated, or if a double-side print key 19*a* has not been operated, the image forming apparatus performs single-side printing including idle conveyance and reversal of a sheet. If the double-side print key 19*a* has been operated, the image forming apparatus performs the double-side printing without the idle conveyance.

In this embodiment, the same reference numerals are allotted to the corresponding parts in the first through third embodiments of the present invention and description thereof will be omitted.

Figure 39:
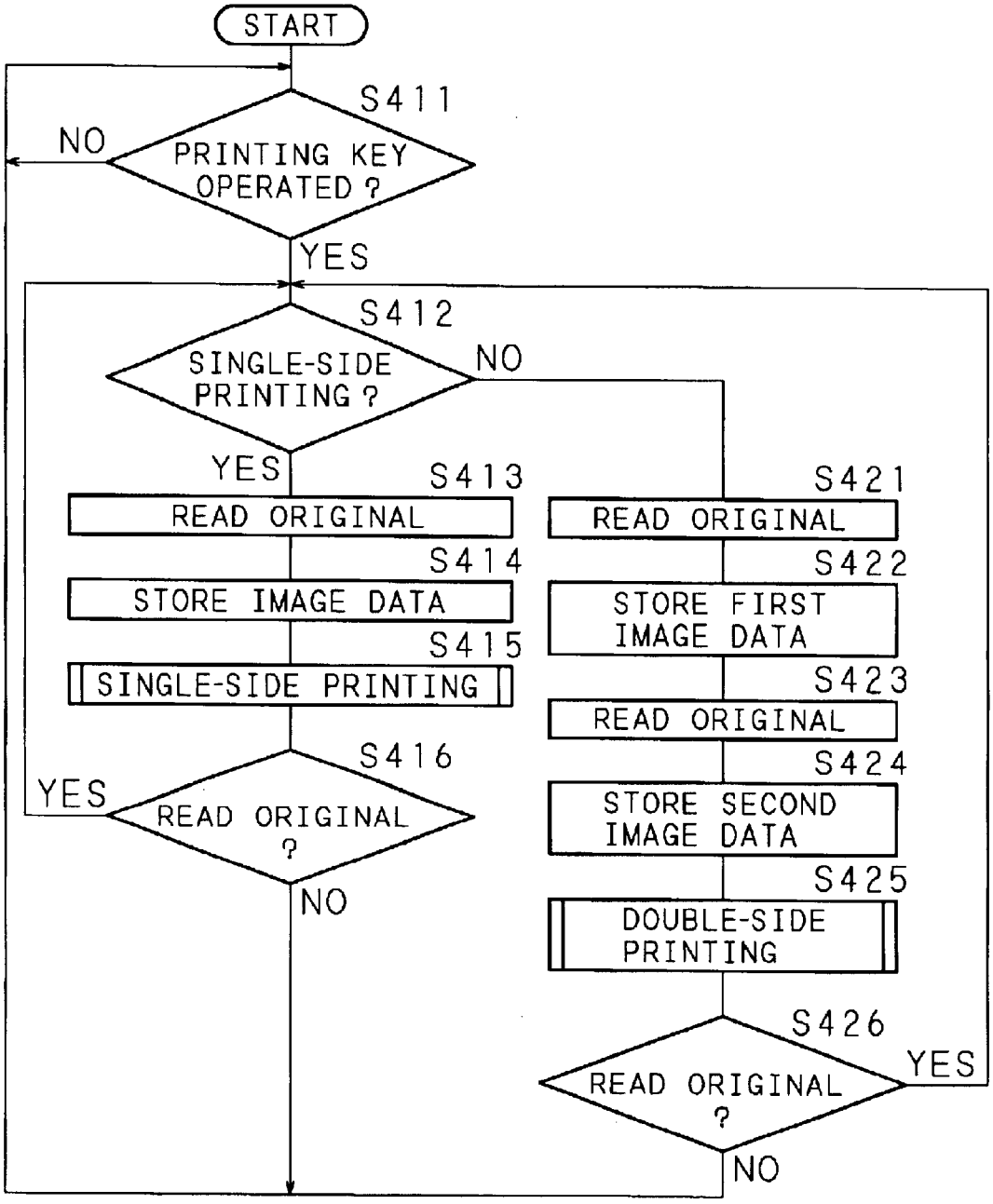
FIG. 39 is a flowchart showing processing procedures of image formation and sheet conveyance by an image forming apparatus according to the fourth embodiment of the present invention.

FIG. 39 is a flowchart showing processing procedures of the image formation and sheet conveyance of the image forming apparatus.

A controller 100 determines whether a printing key 193 has been operated or not (step S411). If the printing key 193 has not been operated (NO at step S411), the controller 100 waits until the printing key 193 is operated. If the printing key 193 has been operated (YES at step S411), the controller 100 determines whether the single-side printing is to be performed or not by determining whether the single-side print key 19*e* had been operated or not and whether the double-side print key 19*a* had been operated or not before the printing key 193 was operated (step S412).

If the single-side print key 19*e* had been operated, or if the double-side print key 19*a* had not been operated, the controller 100 determines to perform the single-side printing (YES at step S412) and then starts to read the original set in an original retainer 30 or an original retaining tray 40 (step S413) to generate image data from the read image and stores the image data in an image memory 202 (step S414). The controller 100 then starts a subroutine for the single-side printing (step S415).

The subroutine corresponds to the subroutine for the special single-side printing according to the third embodiment of the present invention (see FIG. 33). However, if it is determined at step S351 in this subroutine that a first special sheet key 961 or a second special sheet key 963 had been operated before the printing key 963 was operated, the controller 100 drives a feeder 611 or a feeder 631 to supply one special sheet to a printer 20. In addition, if neither the first special sheet key 961 nor the second special sheet key 963 had been operated before the printing key 193 was operated, the controller 100 drives a feeder 211 or a feeder 621 to supply one sheet other than the special sheet to the printer 20. However, it is not necessary to perform the operation of step S363.

Regardless of whether the subroutine is under execution or has been completed, the controller 100 determines whether the next original is to be read or not (step S416). If the next original is to be read (YES at step S416), the operation returns to step S412. If the next original is not to be read (NO at step S416), the controller 100 returns the operation to step S411.

If the double-side print key 19*a* had been operated before the printing key 193 was operated, the controller 100 determines that the double-side printing is to be performed (NO at step S412) and starts to read the original set in the original retainer 30 or the original retaining tray 40 (step S421) to generate image data from the read image and stores the image data in the image memory 202 as first image data (step S422). The controller 100 then starts to read the original set in the original retainer 30 or the original retaining tray 40 (step S423) to generate image data from the read image and stores the image data in the image memory 202 as second image data so as not to overwrite the first image data (step S424).

The controller 100 then starts a subroutine of the double-side printing (step S425). The subroutine corresponds to the subroutine for the double-side printing according to the third embodiment of the present invention (see FIG. 35). In this subroutine, however, it is not necessary to perform the operation of step S388.

Regardless of whether the subroutine is under execution or has been completed, the controller 100 determines whether the next original is to be read or not (step S426). If the next original is to be read (YES at step S426), the operation returns to step S412. If the next original is not to be read (NO at step S426), the controller 100 returns the operation to step S411.

According to the above-described image forming apparatus, the double-side printing is performed by the conventional image forming method, and for performing the single-side printing, an image is formed on the sheet after idle conveyance. Consequently, the image-formed sheets can be discharged in order of the originals.

Furthermore, according to the above image forming apparatus, when the double-side printing and the single-side printing for the special sheet or the sheet other than the special sheet are performed sequentially by mixture, since the conveyance distance for each sheet is approximately the same, the previously supplied sheet is discharged before the sheet supplied later. Consequently, the image-formed sheets can be discharged in order of the originals.

According to the image forming apparatus of the present invention, even when the image is formed on both sides of the sheet, or even when the image is formed on a single side or both sides of the special sheet having different attributes at respective sides, the sheets can be discharged in the order of the original read, by a face-down method. Furthermore, the image can be formed in such a manner that the front side of the original corresponds to the front side of the special sheet. In addition, for example, it is not necessary for the user to determine whether to put the front side up or down when setting the special sheet in the sheet supply means, nor to reverse the sheet manually when the special sheet set in the sheet supply means is upside down. As a result, since there is no such troublesome procedure, user convenience can be improved.

Furthermore, although conveyance time is increased when the idle conveyance is performed, the idle conveyance is performed in case where the sheet has different attributes at respective sides or in case where an image is formed on both sides of the sheet, and the idle conveyance is not performed in case where an image is formed on the sheet other than the special sheet, which is more frequent than a case where the image is formed on the special sheet in general, or in case where an image is formed on a single side, which is more frequent than a case where an image is formed on both sides of the sheet. As a result, efficiency of the image formation can be improved.

Furthermore, when the idle conveyance is performed in case where the image is formed on both sides, the conveyance time and conveyance distance are increased. However, it is possible to prevent increase in the conveyance time and the conveyance distance when the image is formed on both sides of the sheet by performing the idle conveyance when an image is formed on the single side. As a result, the efficiency of the image formation can be improved and occurrence of jam, sheet deterioration or the like can be also prevented.

Still further, since an image is formed without performing the idle conveyance for a sheet which does not need the idle conveyance, the efficiency of the image formation can be improved and sheet deterioration and jam caused by the idle conveyance can be prevented.

In addition, according to the image forming method of the present invention, since the image is formed on both sides of the sheet and then the sheet is idly conveyed, image data for one side of the original is stored in storage means which stores the data of the image until the image is formed on the sheet and then the image is formed. For storing image data for another side, the data is overwritten on the image data for one side and then the image is formed. As a result, since it is not necessary to store the image data for both sides of the original in the storage means provided in the image forming apparatus, storage capacity of the storage means can be reduced.

Furthermore, since the sheet on which an image is not formed is idly conveyed and then the image is formed on both sides or one side of the sheet, even when the jam occurs at the time of the idle conveyance, the image-formed sheet is not contaminated nor damaged. As a result, the image formation process is prevented from being wasted.

Still further, as for the image forming process which comprises the idle conveyance and the image forming process which does not comprise the idle conveyance, one process is started after the other is completed. As a result, in case a plurality of sheets is sequentially processed, occurrence of jam or sheet deterioration can be prevented and the efficiency of the image formation is not decreased. Consequently, the present invention provides a superior effect that the sheets can be discharged in order of the originals, for example.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A method for forming an image on one side of a sheet using an image forming apparatus which comprises:

an image forming unit for forming an image on a sheet;

a conveying unit for conveying the sheet to the image forming unit;

a reversal unit for reversing the sheet;

a control unit for determining whether the sheet is to be reversed or not and controlling the conveying unit and the reversal unit so as to reverse the sheet and convey the sheet to the image forming unit when it has been determined that the sheet is to be reversed; and an obtaining unit for obtaining information on whether an image is to be formed on one side of the sheet or both sides thereof, the control unit being capable of performing operations of:

determining whether an image is to be formed or not on the sheet conveyed to the image forming unit;

controlling the conveying unit and the image forming unit to convey the sheet to the image forming unit and to form the image on the sheet when it has been determined that an image is to be formed; and controlling the conveying unit to convey the sheet to the image forming unit when it has been determined that an image is not to be formed, wherein the control unit determines whether an image is to be formed or not on the sheet conveyed to the image forming unit when the obtaining unit has obtained information that an image is to be formed on one side of the sheet, the method comprising steps of:

conveying a sheet to the image forming unit by the conveying unit with one side of the sheet facing toward the image forming unit;

reversing the sheet by the reversal unit;

conveying the sheet to the image forming unit by the conveying unit; and forming an image on the other side of the sheet by the image forming unit.

* * * * *